US005599119A

United States Patent [19]

Nunokawa et al.

[11] Patent Number: 5,599,119

[45] Date of Patent: Feb. 4, 1997

[54] TAPE PRINTING DEVICE AND TAPE CARTRIDGE USED THEREIN

[75] Inventors: Masahiko Nunokawa, Nagano-ken; Kenji Watanabe, Tokyo, both of Japan

[73] Assignees: Seiko Epson Corporation; King Jim Co., Ltd., both of Tokyo, Japan

[21] Appl. No.: 369,680

[22] Filed: Jan. 6, 1995

Related U.S. Application Data

[62] Division of Ser. No. 132,556, Oct. 6, 1993, Pat. No. 5,492, 420.

[30] Foreign Application Priority Data

| | | | |
|---|---|---|---|
| Oct. 6, 1992 | [JP] | Japan | 4-267166 |
| Oct. 13, 1992 | [JP] | Japan | 4-300304 |
| Nov. 4, 1992 | [JP] | Japan | 4-294991 |
| Feb. 12, 1993 | [JP] | Japan | 5-047492 |

[51] Int. Cl.[6] ..... B41J 11/26

[52] U.S. Cl. ..... 400/621; 400/76; 400/488; 400/208; 400/279

[58] Field of Search ..... 400/621, 207, 400/208, 208.1, 76, 279, 488; 101/227, 288

[56] References Cited

U.S. PATENT DOCUMENTS

| | | |
|---|---|---|
| 3,555,245 | 1/1971 | Lemelson . |
| 4,479,730 | 10/1984 | Yoshioka . |
| 4,569,608 | 2/1986 | Watanabe . |
| 4,623,418 | 11/1986 | Combrich . |
| 4,651,288 | 3/1987 | Zeising . |
| 4,755,955 | 7/1988 | Kimura . |

(List continued on next page.)

FOREIGN PATENT DOCUMENTS

| | | |
|---|---|---|
| 0506460A2 | 3/1992 | European Pat. Off. . |
| 0497352A3 | 5/1992 | European Pat. Off. . |
| 0497352A2 | 8/1992 | European Pat. Off. . |
| 0506461A3 | 9/1992 | European Pat. Off. . |
| 0526078A2 | 2/1993 | European Pat. Off. . |
| 0534794A2 | 3/1993 | European Pat. Off. . |
| 0574165A1 | 12/1993 | European Pat. Off. . |
| 58-63194 | 4/1983 | Japan . |
| 58175671 | 10/1983 | Japan . |
| 1-85050 | 3/1989 | Japan . |
| 2-106555 | 4/1990 | Japan . |
| 2-139271 | 5/1990 | Japan . |
| 3-72461 | 7/1991 | Japan . |
| 4-122660 | 4/1992 | Japan . |
| 4237097 | 8/1992 | Japan . |
| 2077970 | 2/1981 | United Kingdom . |

OTHER PUBLICATIONS

IBM Technical Disclosure Bulletin, Implicit Object Definition in Multiple Data Editor, Mar. 1985, New York, p. 6002.

Neues Aus Der Technik, Feb. 15, 1990, No. 1, Wurzburg, DE.

(List continued on next page.)

*Primary Examiner*—Eugene H. Eickholt

*Attorney, Agent, or Firm*—Hickman Beyer & Weaver

[57] ABSTRACT

The present invention provides a tape printing device for printing a desirable series of characters on a tape and cutting the tape to a label of a desirable length, and also a tape cartridge used in the tape printing device. The tape cartridge has a characteristic element readably storing specific information on the tape such as a width of the tape. The tape printing device reads the characteristic element to control printing conditions according to the type of the tape cartridge. More specifically, the tape printing device determines a variety of parameters including a number of lines and character sizes of the character series printed on the tape as well as lengths of left and right margins. When a tape of a relatively large width is set in the tape cartridge, the device increases a rotation torque of a platen for feeding the tape. When a tape of a relatively small width is set in the tape cartridge, on the contrary, the device drives only specific dot elements in a range of the tape width out of all dot elements arranged on a printing head. The characteristic element of the tape cartridge stores the specific information expressed as depths of a plurality of holes or electric data. This specific information may be updated to identify a user or detect a residual amount of the tape.

21 Claims, 33 Drawing Sheets

U.S. PATENT DOCUMENTS

| | | | |
|---|---|---|---|
| 4,760,405 | 7/1988 | Nagira . | |
| 4,797,018 | 1/1989 | Hofmann . | |
| 4,798,485 | 1/1989 | Onoda . | |
| 4,815,874 | 3/1989 | Richardson . | |
| 4,849,747 | 7/1989 | Ogawa . | |
| 4,917,514 | 4/1990 | Richardson et al. | 400/208 |
| 4,924,411 | 5/1990 | Kashiwagi . | |
| 4,948,276 | 8/1990 | Haftmann . | |
| 4,966,476 | 10/1990 | Kuzuya . | |
| 4,984,916 | 1/1991 | Sekine et al. | 400/613.1 |
| 5,035,325 | 7/1991 | Kitsuki . | |
| 5,040,845 | 8/1991 | Ohkubo et al. | 400/621 |
| 5,053,814 | 10/1991 | Takano . | |
| 5,056,940 | 10/1991 | Basile | 400/208 |
| 5,078,523 | 1/1992 | McQourty . | |
| 5,099,290 | 3/1992 | Yokota | 355/310 |
| 5,131,772 | 7/1992 | Yamaguchi | 400/621 |
| 5,165,806 | 11/1992 | Collins . | |
| 5,209,151 | 5/1993 | Takagi et al. | 83/564 |
| 5,210,547 | 5/1993 | Watanabe . | |
| 5,222,818 | 6/1993 | Akiyama et al. | 400/61 |
| 5,224,784 | 7/1993 | Haftmann . | |
| 5,224,786 | 7/1993 | Takagi et al. | 400/621 |
| 5,230,572 | 7/1993 | Hirono . | |
| 5,232,297 | 8/1993 | Kitazawa | 400/621 |
| 5,253,334 | 10/1993 | Kimura . | |
| 5,259,681 | 11/1993 | Kitazawa et al. | 400/621 |
| 5,295,753 | 3/1994 | Godo et al. | 400/207 |
| 5,314,256 | 5/1994 | Niwa . | |
| 5,315,398 | 5/1994 | Otsuki | 358/304 |
| 5,336,000 | 8/1994 | Handa . | |
| 5,348,401 | 9/1994 | Yoshiaki et al. | 400/621 |
| 5,352,049 | 10/1994 | Shiraishi . | |

OTHER PUBLICATIONS

PC Magazine, Envelope Printers, Dec. 13, 1988, pp. 221–222.

IBM Technical Disclosure Bulletin, Method to Display Paper Edges With Pitch Changes in a Word Processor Dec. 1986, New York, p. 3147.

Research Disclosure Feb. 1988, No. 286, New York, NY USA Ribbon Cartridge Detection.

Fig. 8

| Tape Width | Depth of detection holes 18K | | |
|---|---|---|---|
| [mm] | 18Ka | 18Kb | 18Kc |
| 6 | S | D | D |
| 9 | D | S | D |
| 12 | S | S | D |
| 18 | D | D | S |
| 24 | S | D | S |

S:Shallow D:Deep

Fig. 19

| FONT NAME | DOT POINT | NOTES |
|---|---|---|
| P | 16dot | STANDARD FONT |
| S | 24dot | STANDARD FONT |
| M | 32dot | STANDARD FONT |
| L | 48dot | STANDARD FONT |
| XM | 32dot×64dot | 32dot×2 |
| XL | 48dot×96dot | 48dot×2 |
| G | 64dot×64dot | 32dot×4 |
| U | 96dot×96dot | 48dot×4 |
| XG | 64dot×128dot | 32dot×8 |
| XU | 96dot×192dot | 48dot×8 |

Fig. 20

FONT MAP FOR 3 LINE PRINTING

| TAPE WIDTH \ COMBINATION | SAME×3 | AAB | ABB | BAA | BBA |
|---|---|---|---|---|---|
| ⋮ | ⋮ | ⋮ | ⋮ | ⋮ | ⋮ |
| 12mm | P×3 | PPS | PSS | SPP | SSP |
| 18mm | S×3 | SSM | PMM | MSS | MMS |
| ⋮ | ⋮ | ⋮ | ⋮ | ⋮ | ⋮ |

A : SMALL B : LARGE

TAPE PRINTING DEVICE AND TAPE CARTRIDGE USED THEREIN

This application is a Divisional of application, Ser. No. 08/132,556 now U.S. Pat. No. 5,492,420, filed Oct. 6, 1993, which is incorporated herein by reference.

BACKGROUND OF THE INVENTION

1. Field of the Invention

The present invention relates to a tape printing device for printing a desirable series of characters on a tape and cutting the tape to a label of a desirable length, and also to a tape cartridge used in the tape printing device for receiving a tape therein. More specifically, the invention is to technique attaining accurate but simple printing on a variety of tapes such as different widths, colors, and materials.

2. Description of the Related Art

Devices for printing a desirable series of characters on a surface of an adhesive tape, which has a rear face with an adhesive previously applied thereon, and cutting the tape to a label of a desirable length (hereinafter referred to as tape printing device) are generally known and conveniently used in houses and offices. Such a tape printing device does not require any additional or specific peripheral equipment, but realizes efficient direct printing of characters or symbols on an adhesive tape and cutting of the tape to an adhesive label. With this tape printing device, for example, a user can print a title of a business file, music, or movie on a tape and apply an adhesive label with the title onto a spine of a file or a back of an audio cassette tape or a video tape conveniently at any desirable place.

A variety of tape cartridges including tapes of different widths and ink of different colors are commercially available to meet various demands for such a tape printing device. The tapes in the tape cartridge range from a relatively wide tape preferably applicable to a thick spine of a large file to a relatively narrow tape as of several millimeters in width desirably applicable to a narrow back of an audio cassette tape. The tape printing device itself has been improved greatly to have a plurality of functions to realize beautiful printing and allow selection of a desirable printing style.

The inventors have found that it is unexpectedly difficult to obtain desirable labels using the conventional tape printing device with tapes of significantly different widths. When the difference in the tape width is relatively small, such a problem is not clearly recognized.

A variety of tapes and printing styles make operation and control of the tape printing device undesirably complicated, thus damaging the essential advantage of the tape printing device that realizes simple label printing. When printing of a large point number is implemented while a tape cartridge with a narrow tape is set in the tape printing device, or when a series of characters of a standard font are changed to have a wider font, the characters may be mistakenly printed out of the tape width or a predetermined length.

In the tape printing device, a desirable series of characters and symbols are printed on a certain length of a long tape, and the certain length of the tape with the print thereon is then cut to a label of a desirable length manually or automatically. Left and right margins in a longitudinal direction of the tape on the cut tape (hereinafter referred to as the label) are respectively defined as feeding distances of the tape from a cut end of the tape to a starting position of printing and from an end position of printing to a cutting position. In the conventional tape printing devices, the lengths of the left and right margins are generally fixed. The tape used in the tape printing device has a peeling sheet attached on a rear face thereof to become adhesive when the peeling sheet is peeled off, and is formed to allow thermal transfer printing. This makes the tape relatively expensive, and the margins on the tape are thereby fixed to have lengths as small as possible.

Each label includes a printed portion of desirable characters and left and right margins. Since the lengths of the margins are fixed in the conventional tape printing device, the ratio of the printed portion to the margins can not be determined arbitrarily by the user and may be unbalanced.

A mechanism allowing the user to specify the lengths of margins has been proposed. When a plurality of tapes of different widths are used, however, optimal setting of margins for a tape of a certain width is not suitable for other tapes of different widths. Setting of the margin lengths is thus required every time when the tape cartridge is changed to have a tape of a different width.

The tape printing device generally uses a thermal transfer printing mechanism to make the printing mechanism and thereby the whole device preferably compact. For the same purpose, a fixed printing head of a sufficient printing range is used to implement printing.

In the thermal transfer printing, an ink ribbon as well as the tape is accommodated in the tape cartridge so as to be overlapped with each other at a position of a platen roller. When the tape cartridge is set in the tape printing device to ready for printing, the tape and the ink ribbon are held at the overlapped position between the thermal head and the platen roller. When power is supplied to the printing head synchronously with feeding of the tape, ink on the ink ribbon is melted and transferred onto the surface of the tape for printing.

When the user arbitrarily selects the tape width, a printing range of the thermal head may become greater than the actual width of the tape set in the device, that is, characters may be printed outside the tape width.

A method of prohibiting execution of printing has been proposed to prevent waste of labels. In the compact tape printing device, however, a display unit is made relatively small and insufficient for informing the user of a detailed cause of such prohibition. The user needs to operate a layout display function to find the cause.

Another proposed method executes printing irrespective of the printing range out of the tape width to obtain a label with partly missing characters. The defective label informs the user of a cause of printing failure. There are problems described below.

Even when the tape cartridge has a relatively narrow tape therein, the ink ribbon accommodated in the tape cartridge has a width equal to or greater than a printing range of the printing head. This makes the ink ribbon to be positioned between the printing head and the platen roller and prevents the printing head to be directly slid against the platen roller.

When the printing range exceeds the tape width, ink on the ink ribbon is undesirably applied on the platen roller. This leads to unintentional spots on a rear face of the label when another tape of a greater width is subsequently used for printing. Ink adhering to the platen roller changes the diameter of the platen roller to vary the left and right margins of the tape or the character size or to cause mechanical troubles.

According to the above results, the user of the conventional tape printing device should change the form, the font size, and the margin setting every time when a tape of a different width is used for printing. The user also needs to check whether the tape cartridge set in the tape printing device includes a tape of a certain width corresponding to the printing range to prevent characters from being printed out of the tape width.

SUMMARY OF THE INVENTION

One object of the invention is accordingly to provide a novel tape printing device and a tape cartridge used therein which do not require any troublesome management according to the type of a tape used in the device.

Another object of the invention is to realize simple and efficient printing of a desirable series of characters on a tape.

Still another object of the invention is to improve the operation conditions by applying a plurality of different types of tape cartridges each receiving a tape of a different type to a tape printing device.

The above and other related objects are realized by a tape cartridge of the invention, which receives a tape and is detachably attached in a tape printing device for printing a desirable series of characters on the tape. The tape cartridge includes a characteristic element storing specific information on the tape in a certain form readable by the tape printing device.

The specific information in the characteristic element may include a contour of the tape cartridge and a combination of a plurality of openings, which are mechanically readable by the tape printing device. Alternatively, the characteristic element may store the specific information on the tape as electric or magnetic data. In the latter case, the electric data or magnetic data stored in the characteristic element may be updated.

The specific information on the tape stored in the characteristic element favorably includes a width of the tape, but may include other data such as the color or material of the tape, identification of a user, a password and a residual amount of the tape.

The invention also provides a tape printing device detachably receiving such a tape cartridge with a tape accommodated therein for printing a desirable series of characters on the tape. The tape printing device of the invention characteristically includes an input unit for inputting the desirable series of characters, a characteristic element recognition unit for recognizing a characteristic element previously and mechanically provided on the tape cartridge, and a character series modification unit for modifying and printing the desirable series of characters input by the input unit based on results of the recognition by the characteristic element recognition unit.

In another application of the invention, a tape printing device for printing a desirable series of characters on a tape detachably receives a tape cartridge which has a characteristic element showing at least a difference of a tape width to discriminate the tape. Such a tape printing device characteristically includes an input unit for inputting the desirable series of characters, a characteristic element reading unit for reading the characteristic element of the tape cartridge to extract specific information electrically or magnetically stored therein, and a printing unit for determining at least one out of a number of points of the desirable series of characters to be printed on the tape, a layout of the desirable series of characters, and a feeding torque of the tape based on results of the reading by the characteristic element reading unit, and printing the desirable series of characters on the tape according to the determination.

Alternatively, the tape printing device detachably receiving a tape cartridge, which has a characteristic element showing at least a difference of a tape width to discriminate the tape, so as to print a desirable series of characters on a tape specifically includes an input unit for inputting the desirable series of characters, a characteristic element reading unit for reading the characteristic element of the tape cartridge to extract specific information electrically or magnetically stored therein, a possible arrangement display unit for displaying a plurality of possible arrangements, on the tape, of the desirable series of characters input by the input unit, based on results of the reading by the characteristic element reading unit, a character series arranging unit for selecting a specific character arrangement out of the possible arrangements and arranging the desirable series of characters input by the input unit according to the specific character arrangement, and a printing unit for printing the series of characters arranged by the character series arranging unit on the tape.

In still another application, a tape printing device detachably receiving a tape cartridge for updating specific information on a tape and printing a desirable series of characters on the tape characteristically includes a characteristic element reading unit for reading the characteristic element of the tape cartridge to extract specific information electrically stored therein, and an updating unit for updating the specific information electrically or stored in the characteristic element of the tape cartridge.

In this case, the specific information updated by the updating unit includes at least one of a residual amount of the tape in the tape cartridge, a code representing a user, a consumed amount of the tape, and a password.

The specific information on the tape may be used for setting left and right margins. For this purpose, a tape printing device for printing a sentence on a tape and cutting and discharging the tape specifically includes a margin information setting and storing unit for setting and storing margin information representing at least one of lengths of a left margin and a right margin to be set before and after the sentence printed on the cut tape, a tape width detection unit for detecting tape width information representing a width of the tape set in the device, and a margin setting unit for setting the left margin and the right margin in printing, based on the margin information stored in the margin information setting and storing unit as well as the tape width information detected by the tape width detection unit.

In one application, the margin information setting and storing unit sets and stores the lengths of the left margin and the right margin as relative values, and the margin setting unit then converts the relative values to absolute values based on the tape width information and sets the left and right margins corresponding to the absolute values.

The specific information on the tape may also be used for driving a printing head. For this purpose, a tape printing device for printing a sentence including one or a plurality of lines of input characters on a tape and cutting and discharging the tape specifically includes a tape width information reading unit for reading tape width information representing a width of the tape set in the device, and a head driving range control unit for driving specific dot elements in a certain range according to the tape width information out of a plurality of dot element arranged in series on a printing head.

BRIEF DESCRIPTION OF THE DRAWINGS

FIG. 8 shows a relationship between the width of a tape T accommodated in the tape cartridge 10 and the depth of three detection holes 18K;

FIG. 19 shows a set of printing fonts stored in a mask ROM 118;

FIG. 20 shows a font map used in three-line printing;

DESCRIPTION OF THE PREFERRED EMBODIMENT

Structures and functions of the present invention will become more apparent through description of the following preferred embodiments of the invention.

Figure 1:
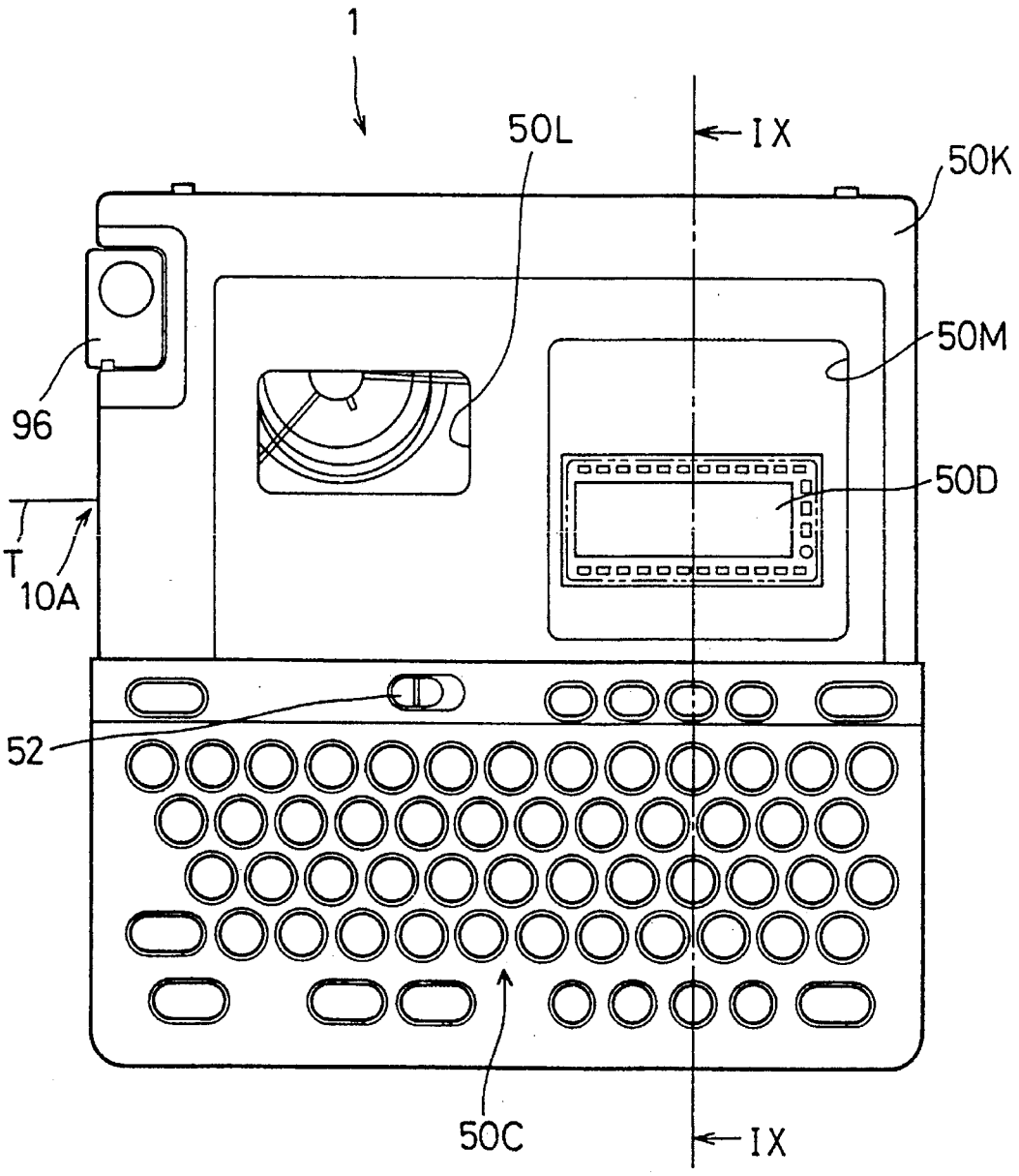
FIG. 1 is a plan view illustrating a tape printing device 1 as a first embodiment according to the invention.
Figure 2:
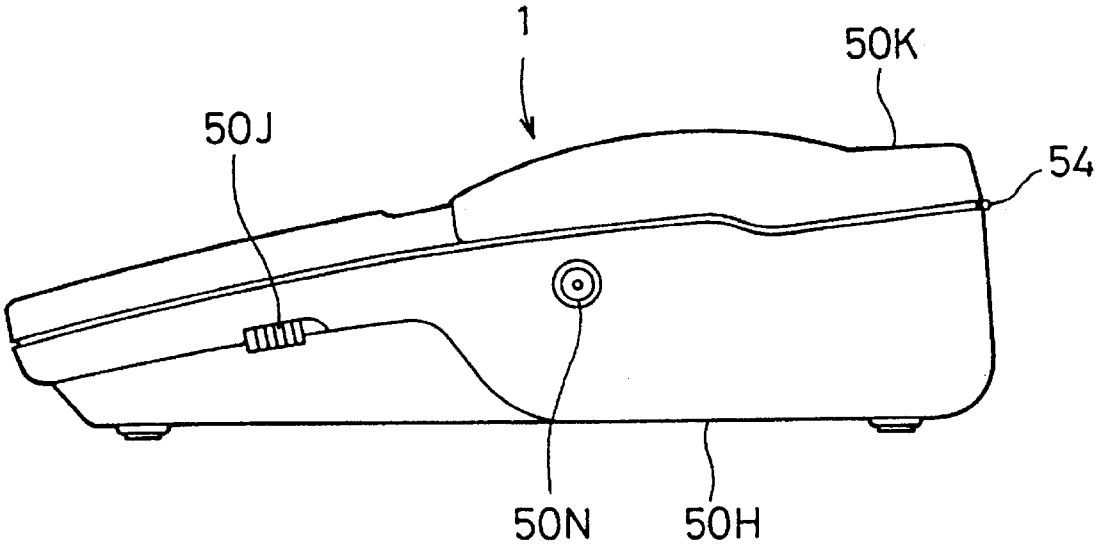
FIG. 2 is a right side view showing the tape printing device 1 of FIG. 1.

FIG. 1 is a plan view illustrating a tape printing device 1 embodying the invention, and FIG. 2 is a right side view of the tape printing device 1. In the description below, the relative position of each constituent, for example, right, left, upper, or lower, corresponds to the drawing of FIG. 1.

As shown in FIGS. 1 and 2, the tape printing device 1 includes a casing 50H for accommodating a variety of constituents, an input unit 50C having sixty-three keys, a freely openable cover 50K, a display unit 50D arranged visibly through a window 50M of the cover 50K for displaying a series of characters or other required information, and a tape cartridge holder unit 50A (see FIG. 10) disposed on a left upper portion of the device 1, which a tape cartridge 10 is detachably attached to. A window for checking attachment of the tape cartridge 10 is provided on the cover 50K. Both windows 50L and 50M are covered with transparent plastic plates.

Operation of the tape printing device 1 thus constructed is described briefly. In a first step, an operator opens the cover 50K and attaches the tape cartridge 10 to the tape cartridge holder unit 50A. After closing the cover 50K, the operator turns on a power switch 50J externally mounted on a right side wall of a main body of the device 1 as shown in FIG. 2. The device 1 subsequently executes an initial processing to ready for an input of letters or characters. The operator then inputs a desirable series of letters or characters with the keys on the input unit 50C. Although input of letters is implemented directly through key operation of the input unit 50C, an additional process such as conversion from the input letters into Chinese characters may be required in certain linguistic areas using two-bite characters like Chinese characters. When the operator instructs printing through a key operation, the device 1 drives a thermal transfer printer unit 50B to start printing on a tape T fed from the tape cartridge 10. The tape T with the letters or characters printed thereon is fed out of a tape outlet 10A disposed on a left side wall of the tape printing device 1.

The tape T used in the embodiment has a printing surface specifically processed for preferable ink spread by thermal transfer and an adhesive rear face which a peel tape is applied on. After the printed tape T is cut by a desirable length to a label with a built-in blade cutter and the peel tape is peeled off, the label with characters and symbols printed thereon is applied onto any desirable place.

Figure 3:
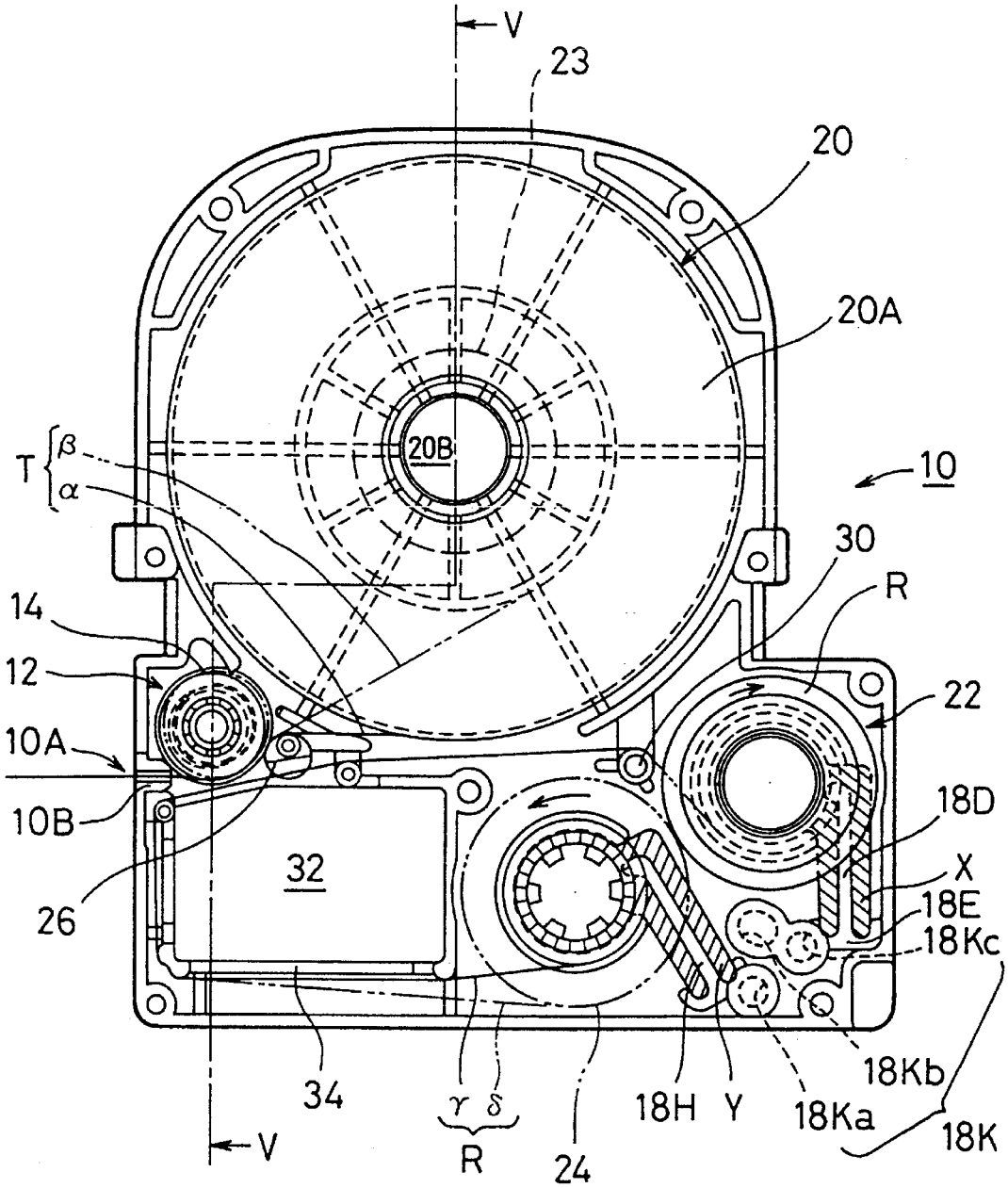
FIG. 3 is a plan view showing assembly of a tape cartridge 10 in the first embodiment.
Figure 4:
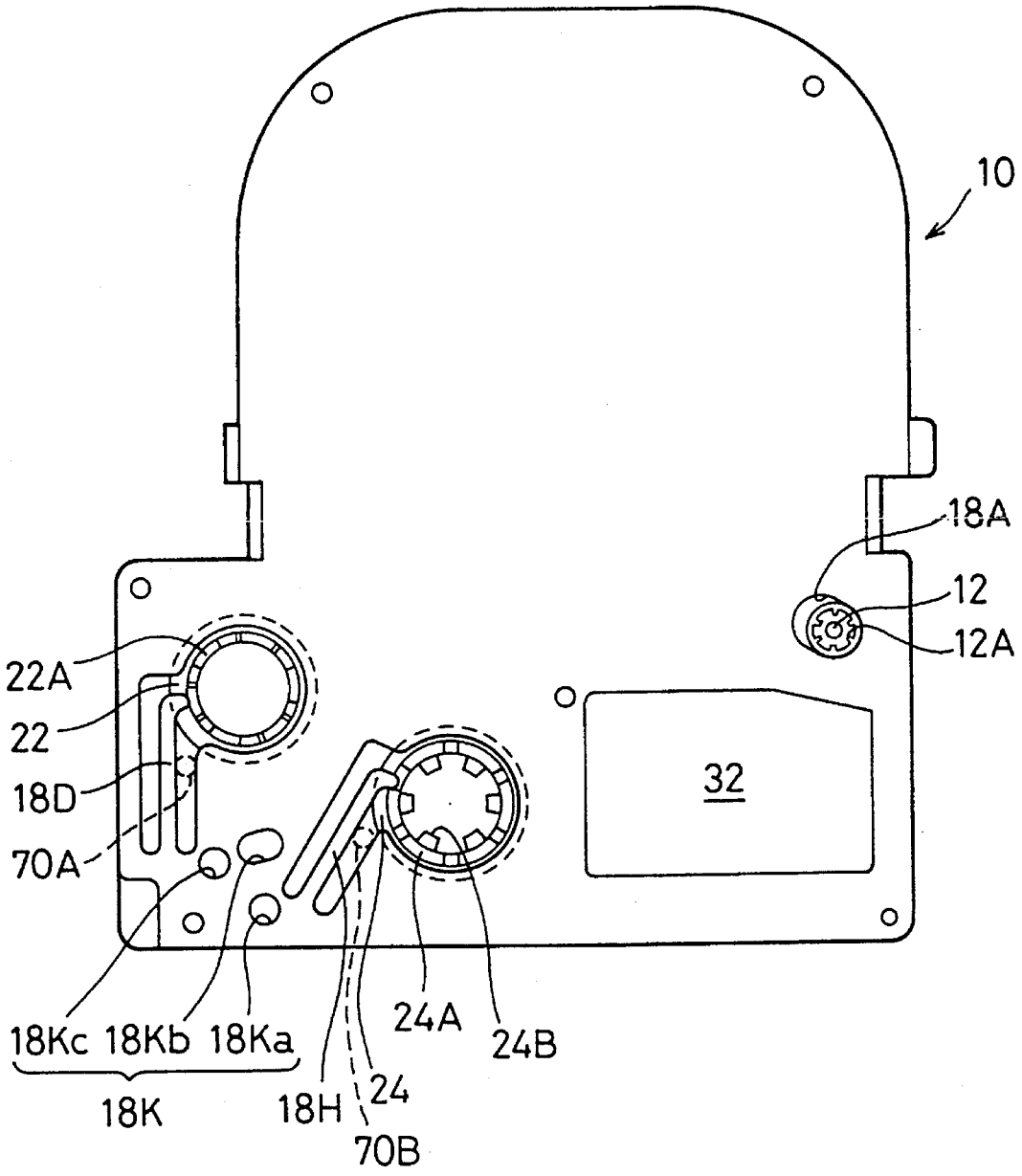
FIG. 4 is a bottom view showing the tape cartridge 10 of FIG. 3.
Figure 5:
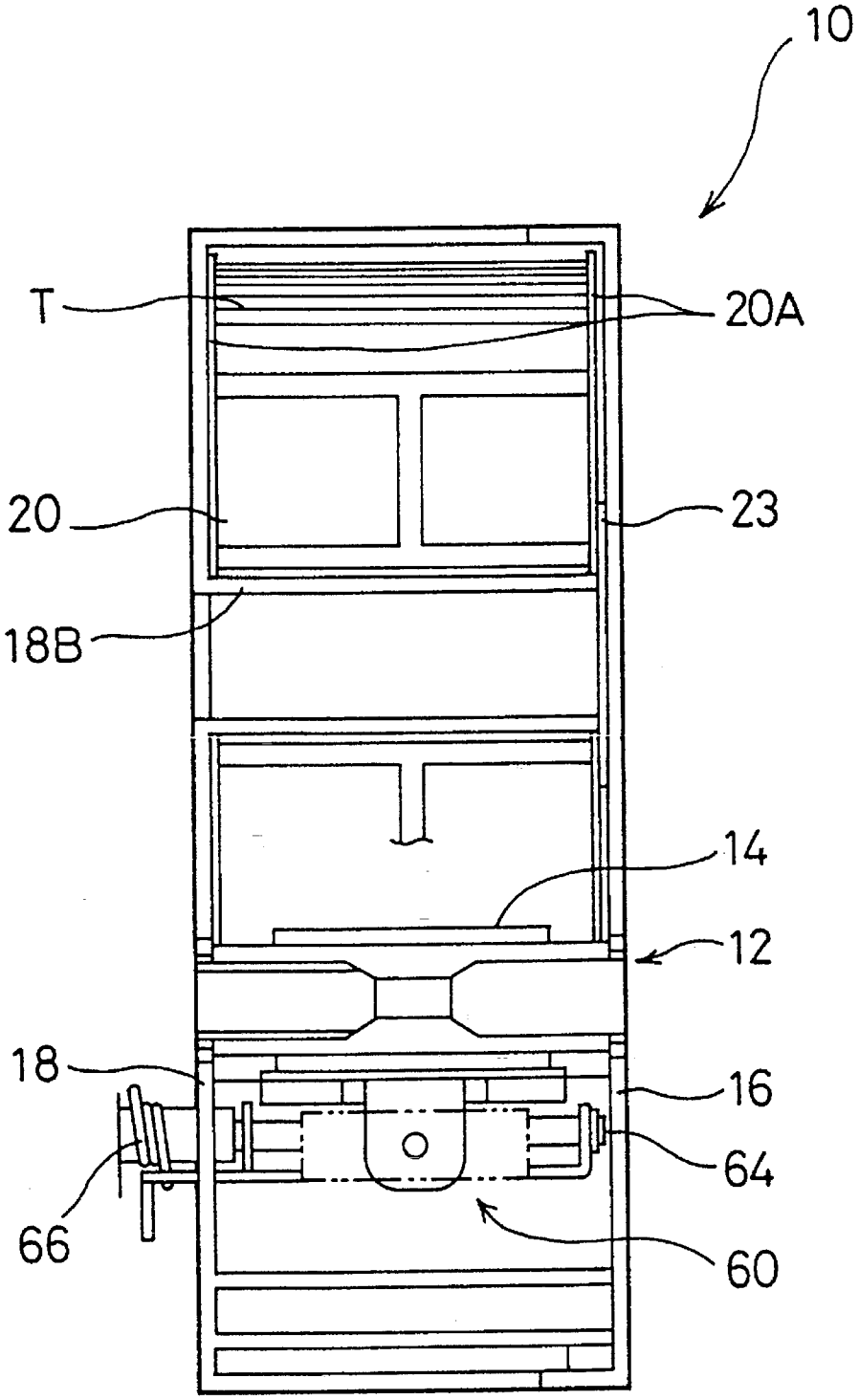
FIG. 5 is an end view illustrating the tape cartridge 10 taken on the line V—V of FIG. 3.
Figure 6:
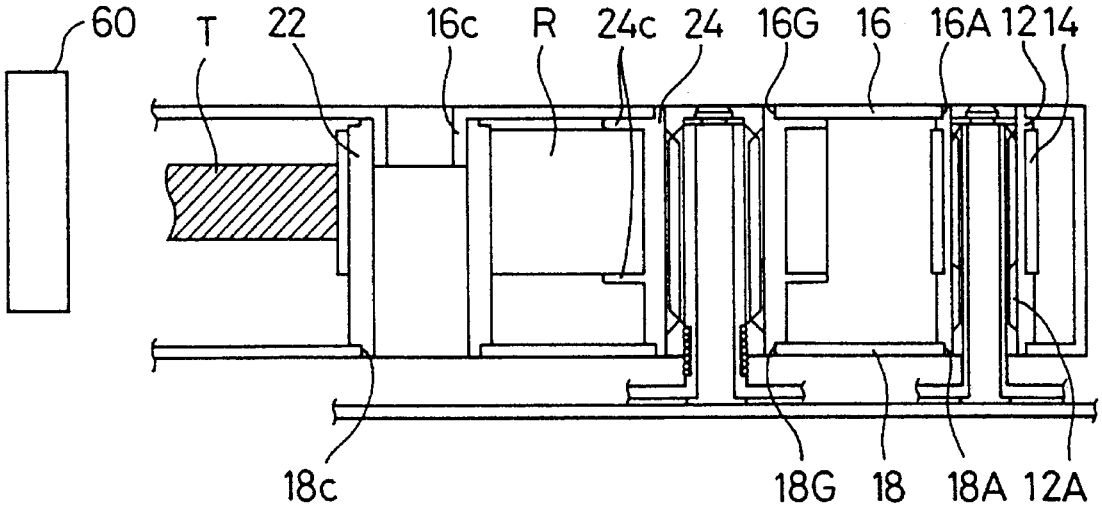
FIG. 6 is an end view showing an internal structure of the tape cartridge 10 with a 6 mm wide tape.
Figure 7:
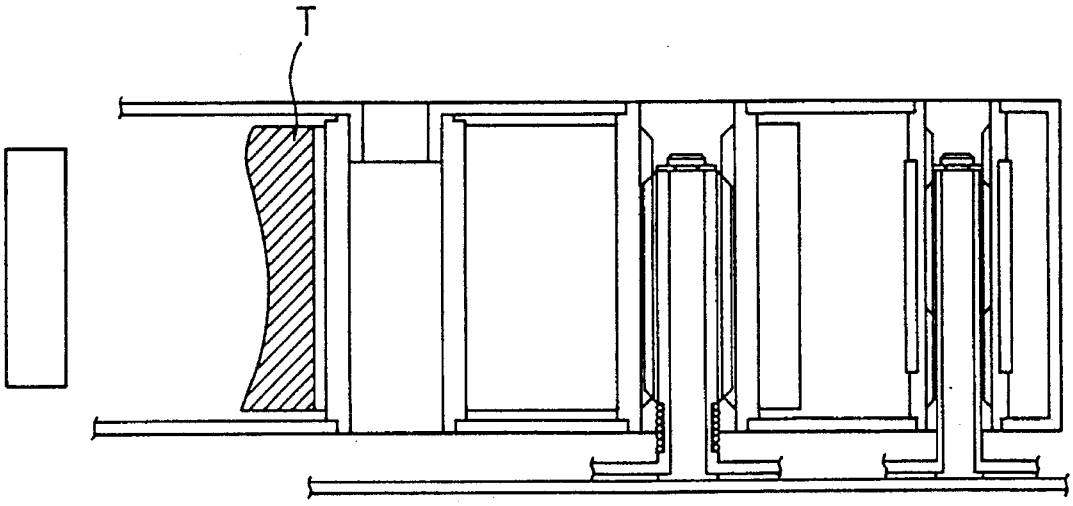
FIG. 7 is an end view showing an internal structure of the tape cartridge 10 with a 24 mm wide tape.

Structure and functions of the tape cartridge 10 are described mainly based on the plan view of FIG. 3, the bottom view of FIG. 4, and the cross sectional view of FIG. 5 taken on the line V—V of FIG. 3. Each tape cartridge 10 having a similar structure can hold a tape of a predetermined width. Five types of tape cartridges for tapes of 6 mm, 9 mm, 12 mm, 18 mm, and 24 mm in width are prepared in the embodiment. FIG. 6 is a partly broken cross sectional view showing an internal structure of the tape cartridge 10, which includes a 6 mm wide tape T running through centers of an ink ribbon core 22, a ribbon winding core 24, and a platen 12. FIG. 7 is also a cross sectional view showing the same with a 24 mm wide tape T. Numbers or symbols representing respective constituents are omitted in FIG. 7 for clarity of the drawing. In FIGS. 6 and 7, part of a printing head 60 is drawn together with the cross section of the tape cartridge 10 to show attachment of the tape T in the tape printing device 1.

The platen 12 is a hollow cylindrical member covered with a platen rubber 14 of a predetermined width corresponding to the width of the tape T. The platen rubber 14 improves contact of the tape T to an ink ribbon R and the printing head 60 for desirable printing. In the embodiment, two types of the platen rubber 14 are used; a 12 mm wide platen rubber for 6 mm, 9 mm, and 12 mm tapes (see FIG. 6), and a 18 mm wide platen rubber for 18 mm and 24 mm tapes (see FIG. 7).

The platen 12 has a smaller-diametral upper end and a smaller-diametral lower end. The platen 12 is freely rotatable since the smaller-diametral upper end and the smaller-diametral lower end are rotatably fit in apertures 16A and 18A of a top wall 16 and a bottom wall 18 of the tape cartridge 10, respectively. The apertures 16A and 18A are formed in substantially elliptic shape as seen in FIG. 4. The hollow platen 12 accommodated in the tape cartridge 10 is attached to and detached from a platen driving shaft (described later) disposed in the tape printing device 1 according to attachment and detachment of the tape cartridge 10. The platen 12 has six engagement grooves 12A arranged at the equal intervals on an inner surface thereof along a rotational axis of the platen 12 as shown in FIGS. 4 and 6. The engagement grooves 12A engage with the platen driving shaft to transmit a driving force of the driving shaft.

The tape cartridge 10 is also provided with a tape core 20 which a long tape T is wound on, the ink ribbon core 22, and the ribbon winding core 24. The tape cartridge 10 further includes a printing head receiving hole 32 which the printing head 60 enters and goes in. The printing head receiving hole 32 is defined by a guide wall 34.

The tape core 20 is a hollow, large-diametral cylindrical reel for placing a long tape T wound on a relatively large-diametral bobbin in the tape cartridge 10. Since a total thickness of the wound tape T on the tape core 20 is small as compared with the diametral of the tape core 20, a rotational angular velocity of the tape core 20 for pulling an outer-most wind of the tape T (shown as $\alpha$ in FIG. 3) out of the tape core 20 at a certain rate is approximately same as a rotational angular velocity of the tape core 20 for pulling an inner-most wind of the tape (shown as $\beta$ in FIG. 3) at the same rate. A sufficiently large radius of curvature of tape core 20 allows even a tape T having poor resistance to a bending stress to be wound on the tape core 20 without difficulty.

As shown in FIG. 3, the tape core 20 has a shaft hole 20B on a center thereof, which rotatably receives a shaft member 18B uprightly projecting from the bottom wall 18 of the tape cartridge 10 as clearly seen in FIG. 5. The tape core 20 is provided with a pair of circular thin films 20A respectively applied on axial upper and lower ends of the tape core 20. The thin film 20A has an adhesive layer. Since the film 20A functioning as a flange with respect to the tape T has the adhesive layer facing the tape T, side edges of the tape T lightly adhere to the film 20A. This keeps the roll of the tape T wound when rotation of the platen 12 pulls the tape T out and makes the tape core 20 drivingly rotate.

As shown in FIG. 3, the tape T wound and accommodated in the tape core 20 runs to the platen 12 via a tape guide pin 26 uprightly projecting from the bottom wall 18 of the tape cartridge 10 and goes out of the tape outlet 10A of the tape cartridge 10. The tape outlet 10A has a guide element 10B of a predetermined length formed along a feeding direction of the tape T. While the tape cartridge 10 is set in the tape cartridge holder unit 50A, the printing head 60 is placed in the printing head receiving hole 32. Under such conditions, the tape T is held between the printing head 60 and the platen 12 and fed according to rotation of the platen 12.

The apertures 16A and 18A receiving the upper and lower ends of the platen 12 are formed in elliptic shape as mentioned above, and the platen 12 is movable along longitudinal axes of the apertures 16A and 18A when the tape cartridge 10 is not set in the tape printing device 1. When the tape T outside the tape cartridge 10 is being pressed into the tape cartridge 10, the platen 12 moves along a feeding direction of the tape T. Movement of the platen 12 causes the platen rubber 14 on the platen 12 to be in contact with a circumference of the tape guide pin 26 and securely holds the tape T between the platen rubber 14 and the tape guide pin 26. This interferes with further movement of the tape T. Such a structure effectively prevents from the tape T being mistakenly pressed into the tape cartridge 10.

Winding procedure of the ink ribbon R is now described. The ink ribbon core 22 includes a hollow, small-diametral cylindrical member having smaller-diametral upper and lower ends as clearly seen in FIGS. 6 and 7. The smaller-diametral lower end has six engagement grooves formed as first engaging elements 22A arranged at the equal intervals as shown in FIGS. 3 and 4. The smaller-diametral lower end of the ink ribbon core 22 is loosely fitted in a circular first fitting aperture 18C formed on the bottom wall 18 of the tape cartridge 10. The upper hollow end of the ink ribbon core 22 is loosely fitted in a cylindrical guide projection 16C protruded from the top wall 16 of the tape cartridge 10. The ink ribbon core 22 is accordingly held to be drivingly rotatable according to pull-out of the ink ribbon R.

As shown in FIGS. 3 and 4, a substantially L-shaped first engagement piece 18D is formed on the bottom wall 18 of the tape cartridge 10 to be positioned in the vicinity of the lower ends of the ink ribbon core 22 and the ribbon winding core 24 (described later). The first engagement piece 18D is formed by cutting part of the bottom wall 18 of the tape cartridge 10 (hatched portion designated as X in FIG. 3). Resilience of the material of the bottom wall 18 allows a free end of the first engagement piece 18D to be movable around a base portion 18E integrally formed with the bottom wall 18 along the plane of the bottom wall 18. When no force is applied onto the first engagement piece 18D, the free end of the first engagement piece 18D is positioned inside the circumference of the first fitting aperture 18C and engages with one of the six engaging elements 22A formed on the lower end of the ink ribbon core 22 loosely fitted in the fitting aperture 18C. This effectively prevents the ink ribbon core 22 from being unintentionally rotated and the ink ribbon R from being slack.

The ink ribbon R wound and accommodated in the ink ribbon core 22 is pulled out via a ribbon guide roller 30 and runs along the guide wall 34 to the ribbon winding core 24. In the middle of the ribbon path, the ink ribbon R reaches a position facing the platen 12 to be overlapped with the tape T. In FIG. 3, $\gamma$ and $\delta$ respectively show the running conditions of the ink ribbon R when the tape cartridge 10 is still unused and new, that is, when only a starting end of the ink ribbon R is on the ribbon winding core 24, and when the whole ink ribbon R is wound on the ribbon winding core 24.

The ribbon winding core 24 includes a hollow cylindrical member of substantially the same shape as the ink ribbon core 22 as shown in FIGS. 3 and 4. The hollow cylindrical member has smaller-diametral upper and lower ends in the same manner as the ink ribbon core 22. The lower end has six engagement grooves formed as second engaging elements 24A arranged at the equal intervals. As is the platen 12, the ribbon winding core 24 rotates through engagement with a ribbon winding core driving shaft (described later) disposed in the tape printing device 1. The ribbon winding core 24 thus has six engagement grooves 24B arranged at the equal intervals on an inner surface of the hollow cylindrical member along a rotational axis of the ribbon winding core 24. The smaller-diametral upper and lower ends of the ribbon winding core 24 are loosely and rotatable fitted in a top circular fitting aperture 16G and a bottom circular fitting aperture 18G formed on the top wall 16 and the bottom wall 18 of the tape cartridge 10, respectively.

In the same manner as the ink ribbon core 22, a substantially L-shaped second engagement piece 18H is formed on the bottom wall 18 of the tape cartridge 10 to prevent unintentional rotation of the ribbon winding core 24. The second engagement piece 18H is formed by cutting part of the bottom wall 18 of the tape cartridge 10 (hatched portion designated as Y in FIG. 3). When the tape cartridge 10 is not set in the tape printing device 1, a free end of the second engagement piece 18H is positioned inside the circumference of the bottom fitting aperture 18G and engages with one of the six second engaging elements 24A formed on the lower end of the ribbon winding core 24. The ribbon winding core 24 is thereby not rotated in such a direction as to slacken the ink ribbon R wound thereon. The free ends of the first engagement piece 18D and the second engagement piece 18H are respectively positioned not to be perpendicular but to be inclined to the first and second engaging elements 22A and 24A. This prevents the ink ribbon core 22 and the ribbon winding core 24 from rotating in undesirable directions as described above. The ribbon winding core 24 readily rotates in a normal winding direction of the ink ribbon R.

Engagement of the first engaging element 22A of the ink ribbon core 22 with the first engagement piece 18D and that of the second engaging element 24A of the ribbon winding core 24 with the second engagement piece 18H effectively prevent the ink ribbon R from undesirably slackening while the tape cartridge 10 is not set in the tape printing device 1. The engagement is released when the tape cartridge 10 is set in the tape cartridge holder unit 50A. The releasing procedure is described later with a typical structure of the tape cartridge holder unit 50A.

The ink ribbon R wound on the ribbon winding core 24 is a thermal transfer ribbon having a predetermined width corresponding to the width of the tape T used for printing. In the embodiment, a 12 mm wide ink ribbon R is used for 6 mm, 9 mm, and 12 mm wide tapes T as shown in FIG. 6, a 18 mm wide ink ribbon R for a 18 mm wide tape T (not shown), and a 24 mm wide ink ribbon R for a 24 mm wide tape T as shown in FIG. 7.

When the width of the ink ribbon R is equal to the height of the tape cartridge 10 (see FIG. 7), the top wall 16 and the bottom wall 18 of the tape cartridge 10 guide the ink ribbon R. No additional flange is thus required on the circumference of the ribbon winding core 24 for controlling and adjusting a winding position of the ink ribbon R. When the width of the ink ribbon R is smaller than the height of the tape cartridge 10, on the other hand, a flange 24C is formed on the circumference of the ribbon winding core 24 to guide the ink ribbon R to go through a printing position of the platen 12. The flange 24C is formed in a certain size corresponding to the width of the ink ribbon R.

In the embodiment, there are tape cartridges 10 of five different sizes corresponding to the width of the tape T as described above. Since a printable area of the tape T differs according to the width of the tape T, a variety of condition setting procedures are required. The tape printing device 1 detects the size of the tape cartridge 10 and automatically executes required setting, thus making the user free from troublesome setting. The tape cartridge 10 of the embodiment has first through third detection holes 18Ka, 18Kb, and 18Kc formed on the bottom wall 18 corresponding to the size of the tape T as shown in FIG. 4. Namely, depths of the three detection holes 18Ka, 18Kb, and 18Kc are changed according to the width of the tape T accommodated in the tape cartridge 10.

FIG. 8 shows a relationship between the width of the tape T accommodated in the tape cartridge 10 and the depths of the three detection holes 18Ka, 18Kb, and 18Kc. As shown in FIG. 8, the first detection hole 18Ka is formed shallow and the second and third detection holes 18Kb, 18Kc of the tape cartridge 10 are formed deep for a 6 mm wide tape. The first and third detection holes 18Ka, 18Kc are formed deep for a 9 mm wide tape; only the third detection hole 18Kc is deep for a 12 mm wide tape; and the first and second detection holes 18Ka, 18Kb are deep for a 18 mm wide tape. Only second detection hole 18kb is formed deep for a 24 mm wide tape. Since the size of the tape cartridge 10 is designated as a combination of the depths of the three detection holes 18Ka through 18Kc, the user can also check the tape cartridge 10 with eyes.

Figure 9:
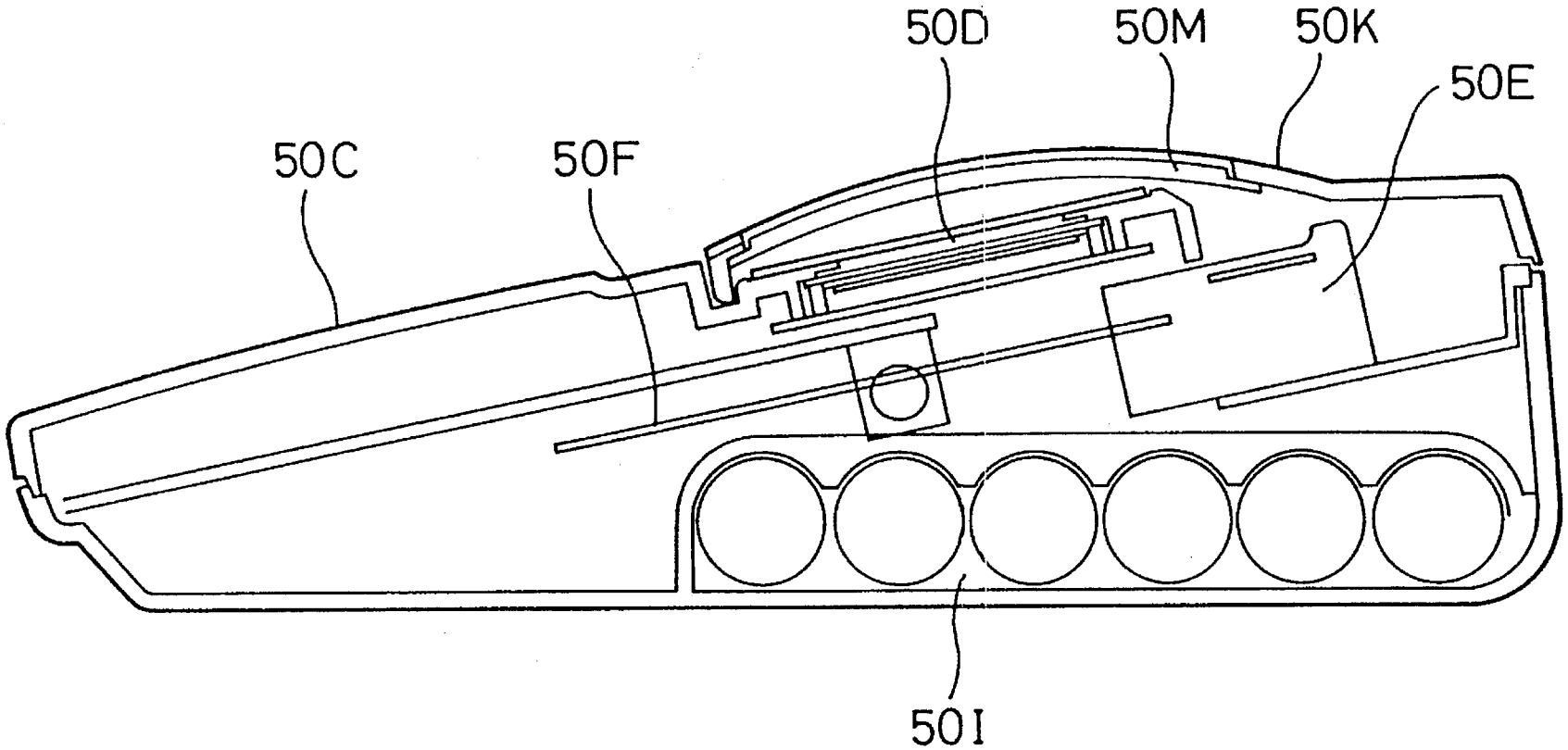
FIG. 9 is an end view illustrating the tape printing device 1 taken on the line IX—IX of FIG. 1.

The tape cartridge 10 thus constructed is set in the tape cartridge holder unit 50A of the tape printing device 1. The tape printing device 1 includes an extension unit 50E for connecting various packs optionally supplied as external memory elements, the input unit 50C, and a control circuit unit 50F for controlling the display unit 50D and the printer unit 50B as shown in the cross sectional view of FIG. 9 taken on the line IX—IX of FIG. 1.

The tape printing device 1 is also provided on a bottom face thereof with a battery holder unit 50I for receiving six SUM-3 cells working as a power source of the whole device 1. The power switch 50J is mounted on the right side wall of the tape printing device 1 (see FIG. 2). Power may be supplied from a plug 50N (see FIG. 2) formed on the right side wall of the device 1 to be connectable with an AC adapter (not shown).

Figure 10:
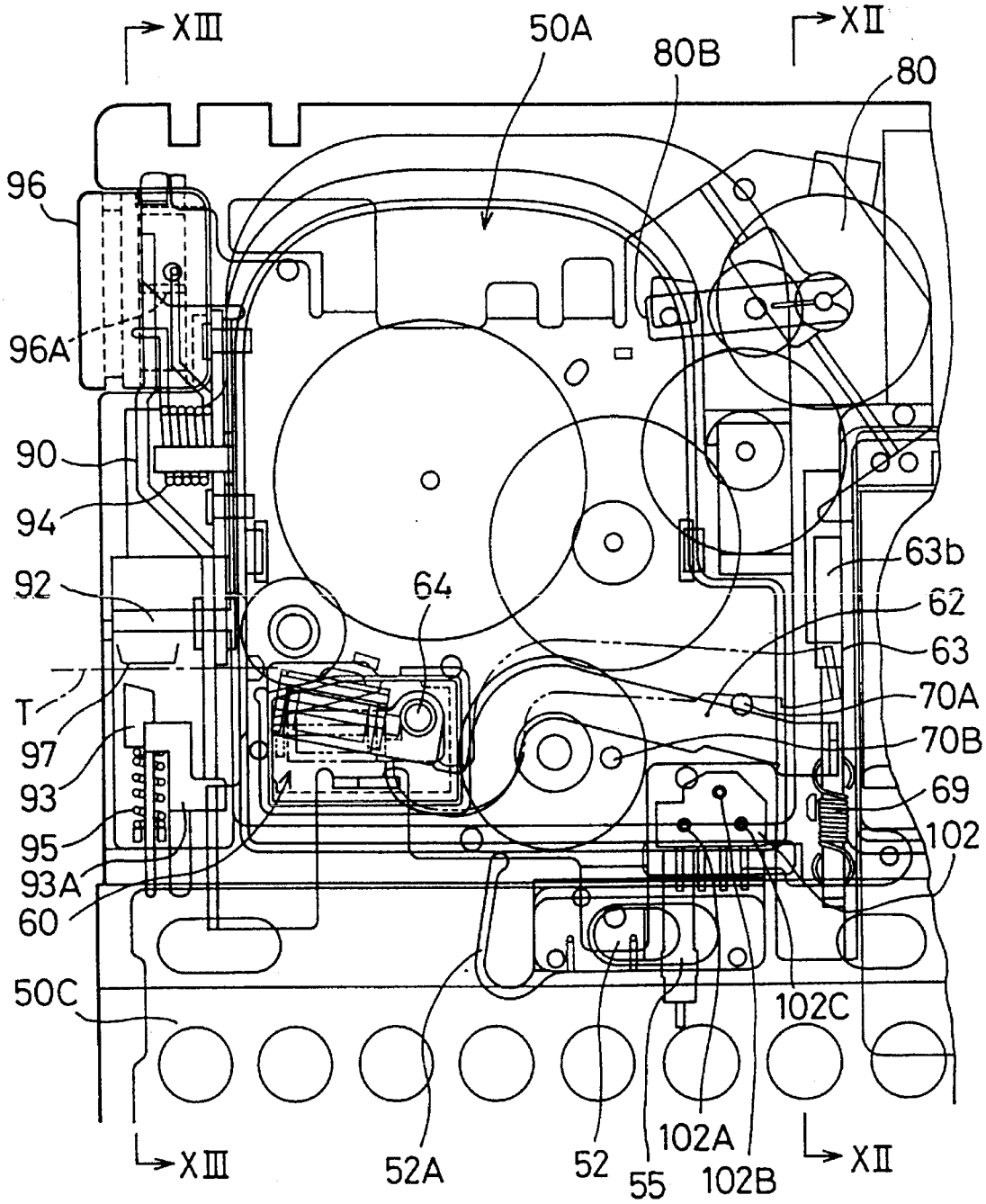
FIG. 10 is a plan view showing a typical structure of a tape cartridge holder unit 50A.
Figure 11:
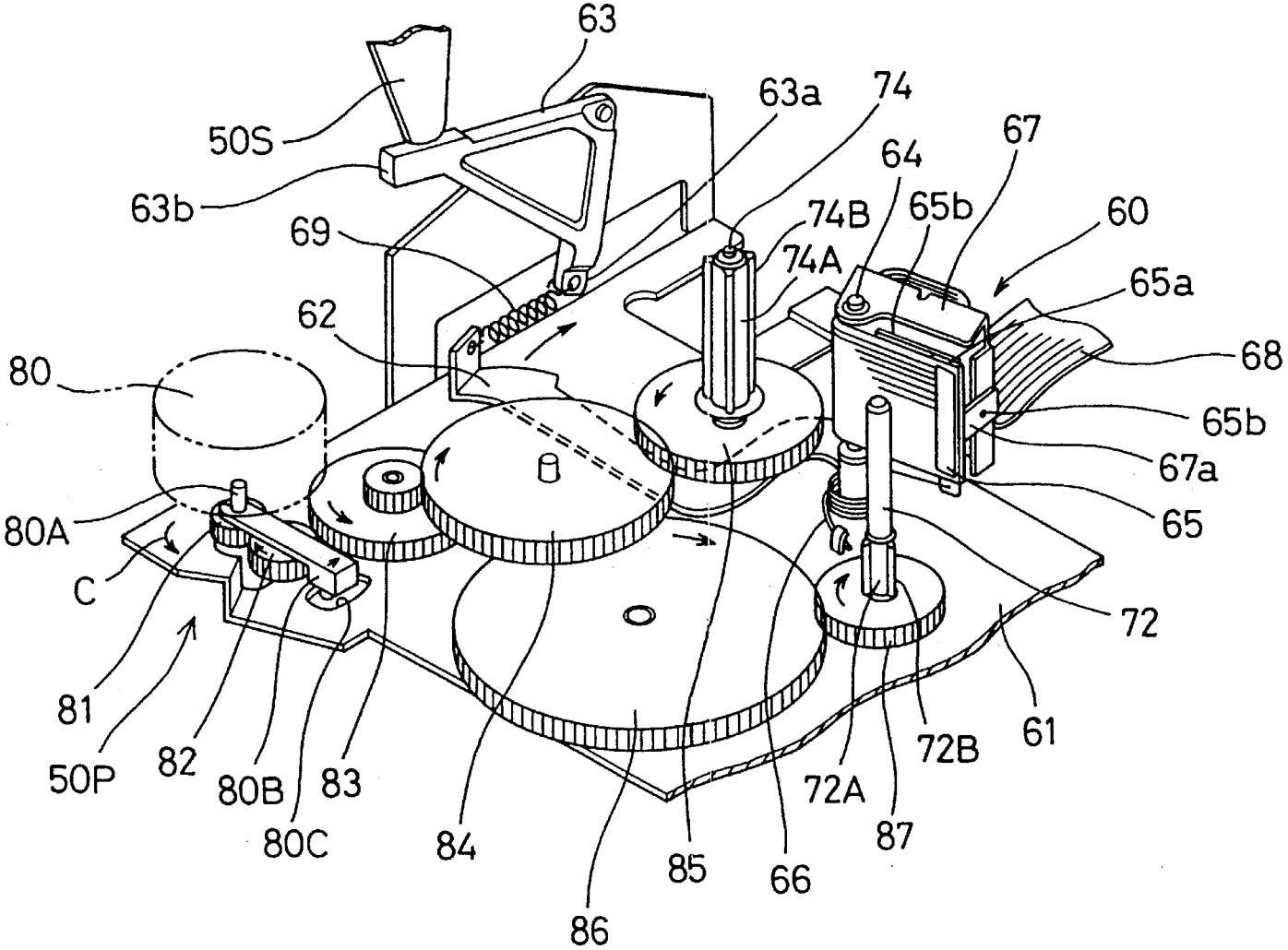
FIG. 11 is a perspective view illustrating a gear train and a mechanism for shifting a printing head 60 between a retreated position and a printing position.

Mechanical constituents of the tape printing device 1 are described hereinafter. FIG. 10 is a plan view showing a typical structure of the tape cartridge holder unit 50A, and FIG. 11 is a perspective view illustrating an essential structure of a driving mechanism 50P for driving the platen 12 and the other elements by means of power of a stepping motor 80.

The tape cartridge holder unit 50A is disposed in a left upper position of a main body of the tape printing device 1 and defines an attachment space corresponding to the shape of the tape cartridge 10 as shown in FIG. 10. The platen driving shaft and the ribbon winding core driving shaft respectively engaging with the hollow members of the platen 12 and the ribbon winding core 24 as well as the printing head 60 are uprightly disposed in the attachment space of the tape cartridge holder unit 50A as shown in FIG. 11. The tape cartridge holder unit 50A is also provided on a lower portion thereof with the driving mechanism 50P for transmitting rotation of the stepping motor 80 to the platen 12 and other elements. The driving mechanism 50P disposed below the tape cartridge holder unit 50A is not observable even when the cover 50K is open. FIG. 11 shows the driving mechanism 50P when the inner case of the tape cartridge holder unit 50A is eliminated. The attachment space of the tape cartridge holder unit 50A is covered with the cover 50K while the tape printing device 1 is in service.

The tape cartridge 10 is attached to or replaced in the tape cartridge holder unit 50A while the cover 50K is open. When a slide button 51 (see FIGS. 1 and 10) disposed before the tape cartridge holder unit 50A is slid rightward (in the drawing), engagement of the cover 50K with the main body of the device 1 is released, so that the cover 50K rotates around a cover hinge 54 mounted on a rear portion of the main body of the device 1 to be opened. A spring arm 52A integrally formed with the slide button 52 engages with an engaging element of the main body of the device 1 to continuously apply a leftward (in the drawing) pressing force to the slide button 52.

When the cover 50K is opened through operation of the slide button 52, the printing head 60 for printing the tape T of the tape cartridge 10 is retreated to allow the tape cartridge 10 to be attached or detached. The printing head 60 is rotatably mounted on a head rotating shaft 64 projected from a base board 61 as clearly seen in FIG. 11. The printing head 60 includes a head body 65 having a plurality of heating dot elements, a radiator plate **65*b* holding the head body 65 via an insulator 65*a*, a frame element 67 for supporting the radiator plate 65*b* through a connection plate 67*a*, a coil spring 66 pressing the printing head 60 in an initial direction, and a flexible cable constituting an electric wiring to the head body 65**.

The printing head 60 is only roughly aligned with the platen 12 in the tape cartridge 10 through attachment of the tape cartridge 10 in the tape printing device 1. Namely, the printing head 60 is not always in contact with the platen rubber 14 along the height of the platen 12 uniformly when the tape cartridge 10 is set in the device 1. In the tape printing device 1 of the embodiment, the connection plate **67*a* is fixed to the frame element 67 via a pin 67*b* inserted into an opening of the connection plate 67*a*, and the radiator plate 65*b* holding the head body 65 is thus rotatable around the pin 67*b*. This allows the head body 65 to hold the tape T between the platen 12 and the head body 65 and to be uniformly in contact with the height of the platen 12 irrespective of the attachment conditions of the tape cartridge 10 with respect to the tape cartridge holder unit 50A when the printing head 60 is pressed towards the platen 12**.

A lower end of the frame element 67 is extended to form a link plate 62. The link plate 62 is positioned in a gear train shown in FIG. 11, and has a free end positioned in the vicinity of a boundary of the display unit 50D (see FIG. 10). The free end of the link plate 62 holds one end of a coil spring 69 to connect a driving member 63 with the link plate 62. The driving member 63 having a substantially triangular shape has a first end **63*a* holding the other end of the coil spring 69 and a second end 63*b* placed opposite to the cover 50K as shown in FIG. 11. An operation arm 50S is extended from the cover 50K to be positioned opposite to the second end 63*b* of the driving member 63, and presses the second end 63*b* when the cover 50K** is closed.

Figure 12:
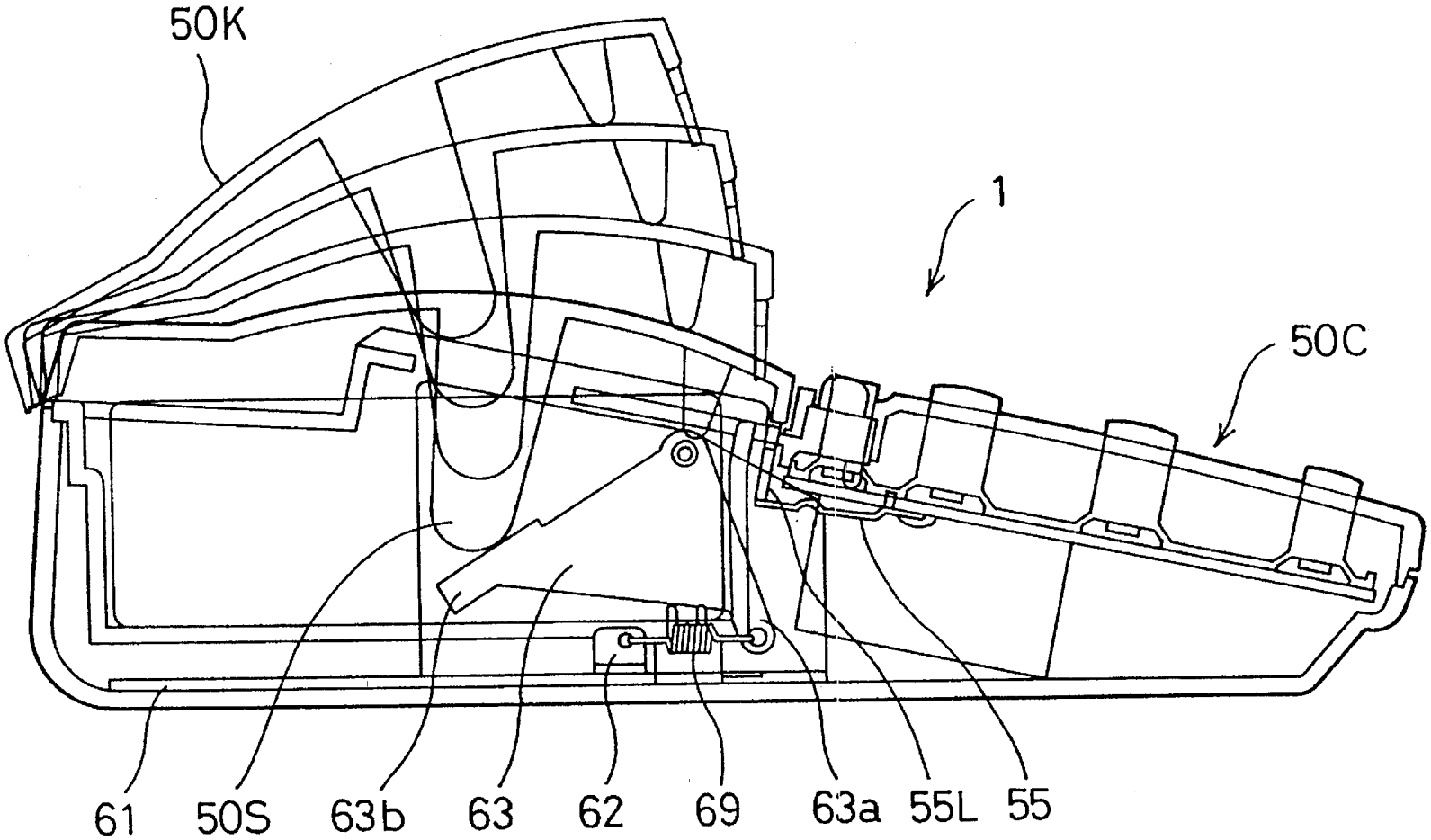
FIG. 12 is an end view showing the mechanism for shifting the printing head 60 taken on the line XII—XII of FIG. 10.

FIG. 12 is a cross sectional view schematically showing such a movement described above, taken on the line XII—XII of FIG. 10. When the cover 50K is pressed downward, the operation arm 50S presses the second end **63*b* of the driving member 63 downward, and the link plate 62 rotatingly moves rightward (in FIG. 11) via the coil spring 69, accordingly. Such a rotating movement of the link plate 62 rotates the printing head 60 against the pressing force of the coil spring 66. The printing head 60 thereby moves from its retreated position to a printing position facing the platen 12 of the tape cartridge 10 set in the tape printing device 1. When the cover 50K is closed, the printing head 60 is accordingly shifted to the printing position. When the cover 50K is opened, on the contrary, the printing head 60 is shifted to the retreated position to allow the tape cartridge 10 to be detached or attached. The printing head 60 once retreated is kept in the retreated position by means of the coil spring 66 while the cover 50K is open, and goes back to the printing position to press against the platen 12 when the cover 50K** is closed.

As described previously, the first engagement piece 18D and the second engagement piece 18H are formed on the bottom wall 18 of the tape cartridge 10 to engage with the first engaging element 22A and the second engaging element 24A so as to prevent unintentional rotation of the ink ribbon core 22 and the ribbon winding core 24 (see FIGS. 3 and 4). The first engagement piece 18D and the second engagement piece 18H are formed respectively by cutting the parts of the bottom wall 18 (hatched portions designated as X and Y in FIG. 3). The tape cartridge holder unit 50A has two cone-shaped contact projections 70A and 70B at a position substantially in the middle of the hatched portions X and Y as shown in FIG. 10. When the tape cartridge 10 is set in the tape cartridge holder unit 50A, the contact projections 70A and 70B are fitted in the hatched portions X and Y of the bottom wall 18 of the tape cartridge 10 to press the first and the second engagement pieces 18D and 18H in a direction away from the first engaging element 22A of the ink ribbon core 22 and the second engaging element 24A of the ribbon 20 winding core 24. This pressing movement releases engagement of the first and the second engagement pieces 18D and 18H with the ink ribbon core 22 and the ribbon winding core 24, thus allowing the ink ribbon core 22 and the ribbon winding core 24 to rotate without any additional load.

A transmission mechanism for transmitting rotation of the stepping motor 80 to a platen driving shaft 72 of the platen 12 is described in detail. As shown in FIG. 11, a first gear 81 is attached to a rotational shaft 80A of the stepping motor 80, and a clutch arm 80B engages with the rotational shaft 80A with predetermined friction. The clutch arm 80B, together with a second gear 82 and a third gear 83, constitutes a one-way clutch. When the stepping motor 80 is rotated in a direction shown by the arrow C in FIG. 11, the friction between the rotational shaft 80A and the clutch arm 80B rotates the clutch arm 80B with the second gear 82 in the directions shown by the arrow C to engage with the third gear 83. Rotation of the stepping motor 80 is thus transmitted to the third gear 83. Functions of the one-way clutch will be further described later.

Rotation of the third gear 83 is then transmitted to a fifth gear 85 and a sixth gear 86 via a fourth gear 84 through repeated gear-down operation. A rotational shaft of the fifth gear 85 is connected to a ribbon winding core driving shaft 74 to wind the ink ribbon R according to rotation of the stepping motor 80. A rim 74A actually driving the ribbon winding core 24 is attached to the ribbon winding core driving shaft 74 with a predetermined friction. Under normal operating conditions, the rim 74A rotates with the ribbon winding core driving shaft 74 rotated by the stepping motor 80. When the ribbon winding core 24 is made unrotatable, for example, due to completion of winding of the ink ribbon R, on the other hand, the rim 74A slips against rotation of the ribbon winding core driving shaft 74.

Rotation of the sixth gear 86 is further transmitted to a seventh gear 87 to rotate the platen driving shaft 72. The platen driving shaft 72 has a rim 72A which engages with the inner surface of the platen 12 to rotate the platen 12. Rotation of the stepping motor 80 transmitted to the third gear 83 by means of the one-way clutch finally rotates the platen driving shaft 72 and the ribbon winding core driving shaft 74, accordingly. The tape T held between the platen rubber 14 on the circumference of the platen 12 and the head body 65 of the printing head 60 is thus continuously fed with progress of printing, and the ink ribbon R is wound on the ribbon winding core 24 synchronously with feeding of the tape T.

The platen driving shaft 72 has, on an outer surface thereof, three engagement projections 72B which are formed at the equal intervals to engage with the engagement grooves 12A formed on the inner surface of the platen 12. The ribbon winding core driving shaft 74 also has three engagement projections 74B which are formed at the equal intervals on an outer surface thereof to engage with the engagement grooves 24B formed on the inner surface of the ribbon winding core 24. When the platen driving shaft 72 and the ribbon winding core driving shaft 74 are rotated at a predetermined rate by the stepping motor 80, the tape T and the ink ribbon R are respectively pulled by a predetermined amount out of the tape core 20 and the ink ribbon core 22 to be overlapped with each other and go through the platen rubber 14 and the printing head 60. In the meanwhile, power supplied to the printing head 60 controls heating of the dot elements on the printing head 60 to melt ink of the ink ribbon R corresponding to the heated dot elements. The melted ink is then thermally transferred to the tape T to complete printing on the tape T. After printing, the tape T with the print is fed out from the tape cartridge 10 while the ink ribbon R used for printing is wound on the ribbon winding core 24.

The tape T conveyed with progress of printing is finally fed out of the tape outlet 10A disposed on the left side wall of the main body of the tape printing device 1. The tape T with the print is normally cut with a cutting mechanism (described later). There is, however, a possibility that the user forcibly pulls out the tape T prior to cutting. Since the printing head 60 presses the tape T against the platen rubber 14 of the platen 12 while the cover 50K is closed, the forcible pull-out of the tape T makes the platen driving shaft 72 rotate. The gear-down operation and a certain amount of retaining torque of the stepping motor 80, however, prevent rotation of the platen driving shaft 72 and the ribbon winding core driving shaft 74 in a conventional driving mechanism. The forcible pull-out of the tape leads to unintentional pull-out of the ink ribbon R, accordingly. When the tape T is cut with the cutting mechanism under such circumstances, the ink ribbon R is also cut undesirably. This makes the tape cartridge 10 unusable any more.

In the embodiment, the one-way clutch including the clutch arm 80B, the second gear 82, and the third gear 83 solves such a problem. When the user forcibly pulls out the tape T, the platen driving shaft 72 rotates with the platen 12 in the structure of the embodiment. Rotation of the platen driving shaft 72 is transmitted to the third gear 83 via the gear train to rotate the third gear 83 clockwise. Rotation of the third gear 83 makes the second gear 82 rotate. However, since the rotational shaft 80A of the stepping motor 80 is not rotated, a rotational force of the third gear 83 presses the clutch arm 80B supporting the second gear 82 to release engagement of the third gear 83 with the second gear 82. This results in separating the third through seventh gears 83 through 87 from the stepping motor 80 to allow the ribbon winding core driving shaft 74 to rotate with rotation of the platen driving shaft 72 due to pull-out movement of the tape T. The rotation of the ribbon winding core driving shaft 74 makes the ink ribbon R wound on the ribbon winding core 24 with pull-out of the tape T, thus effectively preventing unintentional pull-out of the ink ribbon R with the tape T. When the stepping motor 80 starts rotating, the clutch arm 80B is shifted again towards the third gear 83 to engage the second gear 82 with the third gear 83. Since a free end of the clutch arm 80B is fitted in an opening 80C formed on a base 61 as shown in FIG. 11, the movement of the clutch arm 80B is defined in a relatively small range. This moving range is, however, sufficient to make the clutch arm 80B function as the one-way clutch.

Figure 13:
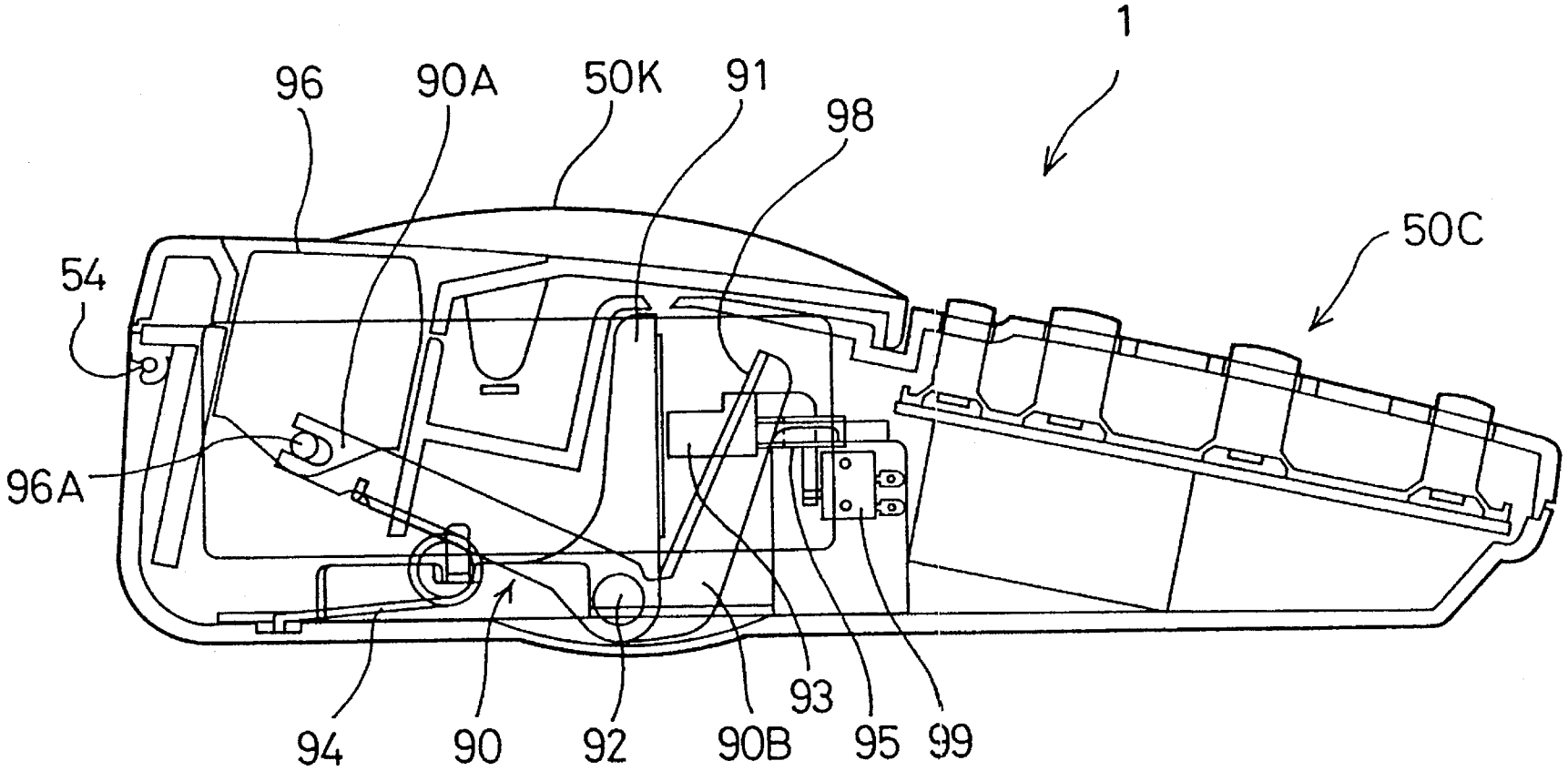
FIG. 13 is an end view showing a cutting mechanism taken on the line XIII—XIII of FIG. 10.

The tape T with the print fed leftward out of the tape cartridge 10 is readily cut with the cutting mechanism, which is shown in detail in FIGS. 10 and 13. FIG. 13 is a cross sectional view mainly showing the cutting mechanism, taken on the line XIII—XIII of FIG. 10. A cutter support shaft 92 protruded from a bottom face of the tape cartridge holder unit 50A holds a substantially L-shaped, pivotably movable tape cutter 90 and a spring 94. A resilient force of the spring 94 keeps the tape cutter 90 under such a condition that a clockwise rotational force is applied onto the tape cutter 90 as shown by the solid line in FIG. 13. With this clockwise rotational force, a left end 90A of the tape cutter 90 presses a cutter button 96 upward. The left end 90A of the tape cutter 90 is formed in a fork shape to receive a pin 96A mounted on a rear face of the cutter button 96. When the cutter button 96 is pressed downward, the left end 90A of the tape cutter 90 shifts downward, accordingly.

A right end 90B of the tape cutter 90 has a movable blade 98 for cutting the tape T, which is arranged at a predetermined angle apart from a fixed blade 91 attached to a side face of the tape cartridge holder unit 50A. A shoulder 93A of a tape support finger 93 (see FIG. 10) is in contact with a rear face of the right end 90B of the tape cutter 90. The tape support finger 93 is pressed against a feeding path of the tape T by a spring 95 as shown in FIG. 10. When the tape cutter 90 rotates to shift the movable blade 98 towards the fixed blade 91, the tape support finger 93 moves towards the feeding path of the tape T. A fixed wall 97 is disposed opposite to the tape support finger 93 across the feeding path of the tape T. The tape T is fixed between the tape support finger 93 and the fixed wall 97 prior to cutting of the tape T by the movable blade 98 and the fixed blade 91. Movement of the tape support finger 93 is detected by a detection switch 99, which prevents printing during the cutting operation of the tape T as described later.

The tape T is cut by pressing the cutter button 96 downward against the resilient force of the spring 94. When the cutter button 96 is pressed downward to rotate the tape cutter 90 counterclockwise (in FIG. 13), the movable blade 98 formed on the right end 90B of the tape cutter 90 also rotates counterclockwise. The tape support finger 93 and the fixed wall 97 securely hold the tape T therebetween, and the movable blade 98 is gradually overlapped with the fixed blade 91 to cut the tape T.

Figure 14:
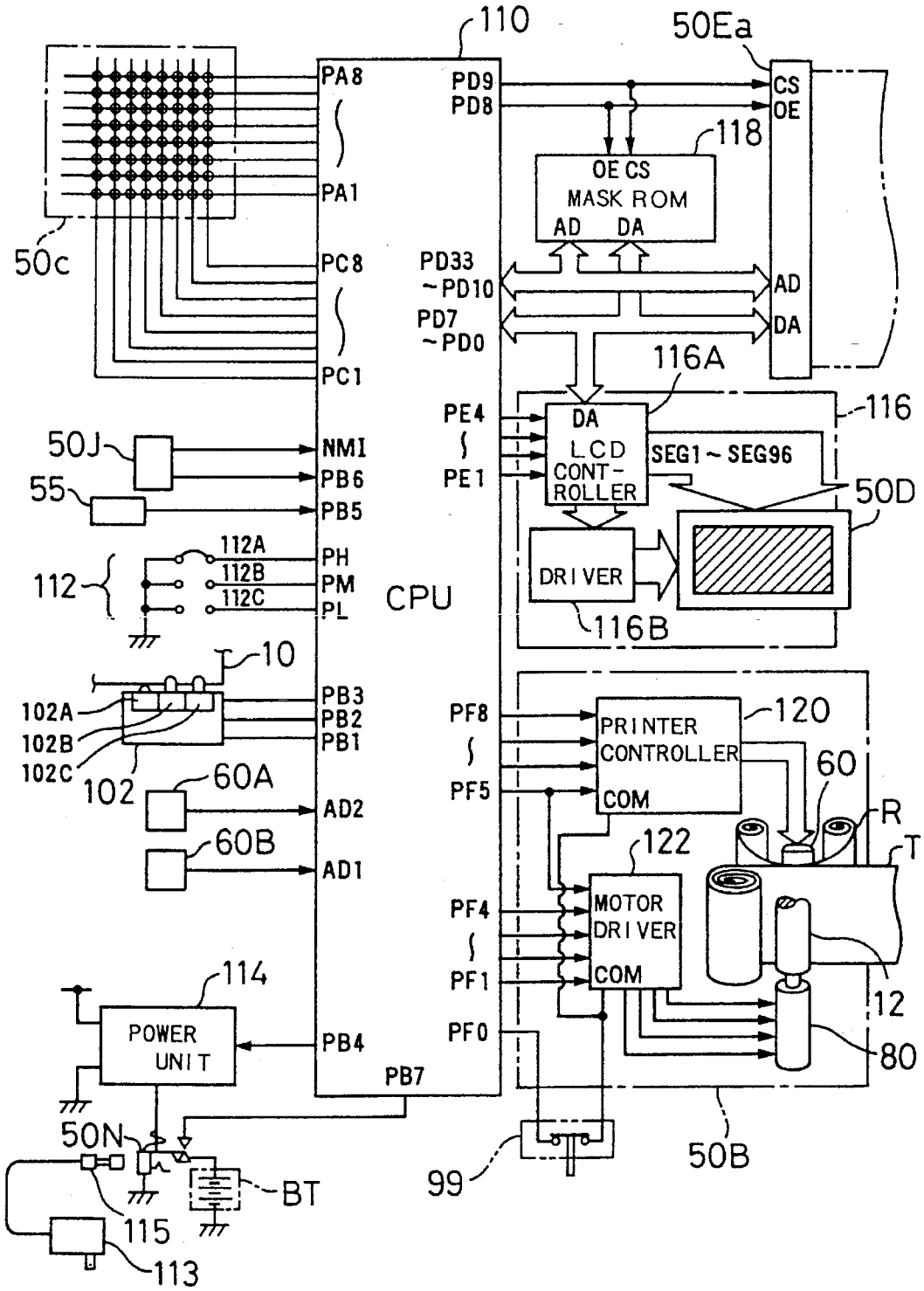
FIG. 14 is a block diagram showing an circuitry structure of tape printing device 1.

Details of the input unit 50C, the display unit 50D, and the printer unit 50B incorporated in the tape printing device 1 are described below after brief description of an electrical structure of the various units including the control circuit unit 50F. The control circuit unit 50F constituted as a printed circuit board is installed with the printer unit 50B immediately below the cover 50K. FIG. 14 is a block diagram schematically showing the general electric structure of the various units. The control circuit unit 50F of the tape printing device 1 includes a one-chip microcomputer 110 (hereinafter referred to as CPU) having a ROM, a RAM, and input and output ports integrally incorporated therein, a mask ROM 118, and a variety of circuits functioning as interfaces between the CPU 110 and the input unit 50C, the display unit 50D, and the printer unit 50B. The CPU 110 connects with the input unit 50C, the display unit 50D, and the printer unit 50B directly or the interface circuits to control these units.

Figure 15:
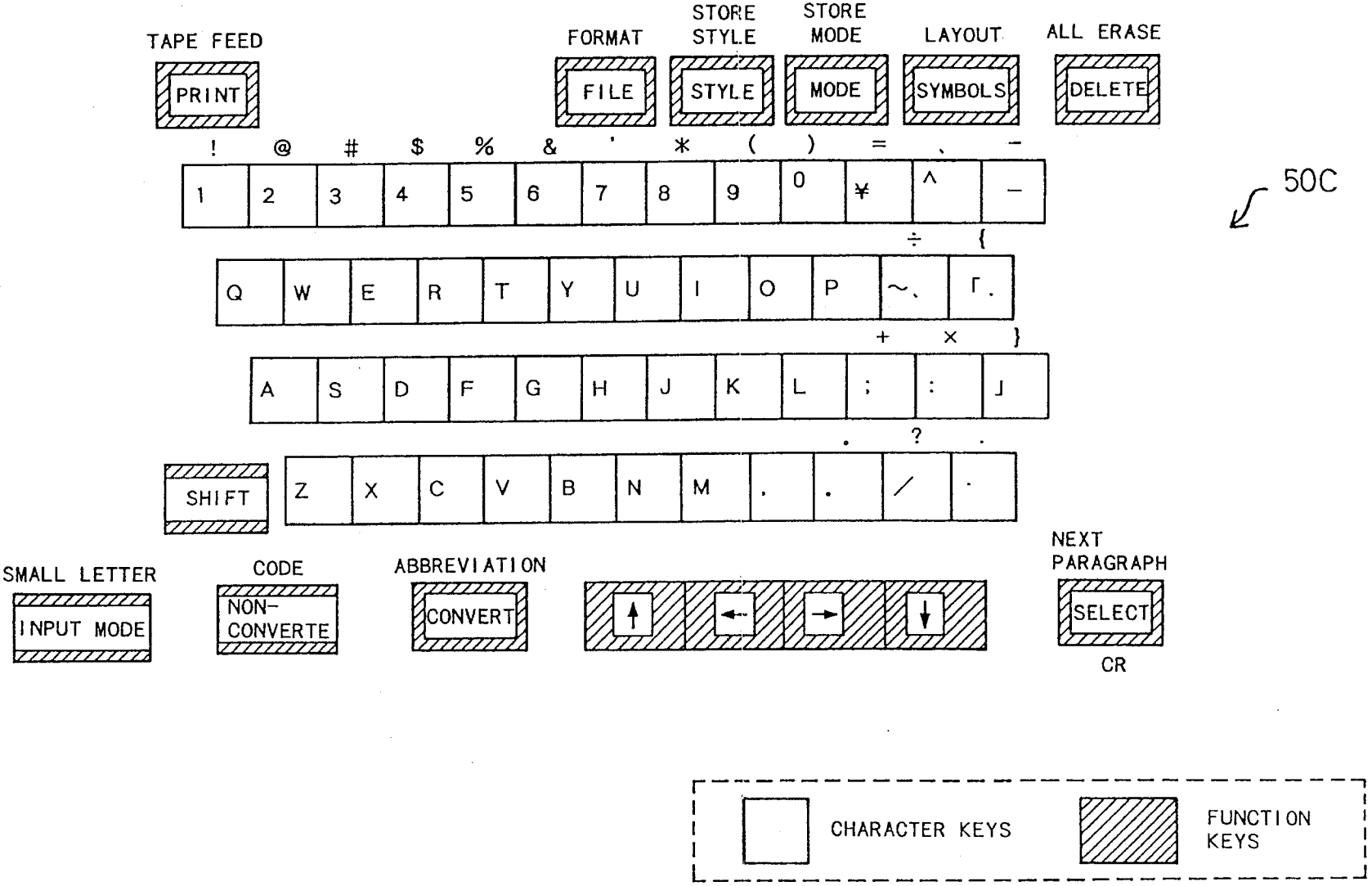
FIG. 15 shows a typical example of a key arrangement on an input unit 50C.

The input unit 50C has forty-eight character keys and fifteen functions keys, sixty-three keys in total, as shown in FIG. 15. The character keys form a so-called full-key structure according to a JIS (Japanese Industrial Standards) arrangement. Like a conventional word processor, the input unit 50C has a commonly known shift key to avoid undesirable increase in the number of keys. The functions keys enhance the ability of the tape printing device 1 by realizing quick execution of various functions for character input, editing, and printing.

These character keys and the function keys are allocated to an 8×8 matrix. As shown in FIG. 14, sixteen input ports PA1 through PA8 and PC1 through PC8 of the CPU 110 are divided into groups, and the sixty-three keys of the input unit 50C are arranged at the respective intersections of the input ports. The power switch 50J is formed independently of the matrix keys and connects with a non-maskable interrupt NMI of the CPU 110. When the power switch 50J is operated, the CPU 110 starts non-maskable interruption to supply or shut off the power.

An output from an opening/closing detection switch 55 for detecting opening and closing of the cover 50K is input to a port PB5, so that the CPU 110 interrupts to monitor the opening and closing conditions of the cover 50K. The opening/closing detection switch 55 detects the movement of the cover 50K according to a movement of an opening/closing detection switch engagement projection 55L (see FIG. 12) disposed on an end of the cover 50K. When the opening/closing detection switch 55 detects opening of the cover 50K while the printing head 60 is driven, the CPU 110 displays a predetermined error command on a main display element 50Da (see FIG. 16) of the display unit 50D and cuts the power supply to the printer unit 50B.

Ports PH, PM, and PL of the CPU 110 are connected with a head rank detection element 112 which adjusts a varied resistance of the printing head 60 by means of a software. The resistance of the printing head 60 significantly varies according to the manufacture process, which changes a power-supply time required for printing of a predetermined density. The head rank detection element 112 measures the resistance of the printing head 60 to determine a rank of the printing head 60 and set three jumper elements 112A, 112B, and 112C of the head rank detection element 112 based on the measurement results. The CPU 110 then reads the conditions of the head rank detection element 112 to correct a driving time or heating amount of the printing head 60, thus effectively preventing the varied density of printing.

Since the printer unit 50B implements thermal transfer printing, the density of printing varies with a temperature and a driving voltage as well as the power-supply time of the thermal printing head 60. A temperature detection circuit 60A and a voltage detection circuit 60B respectively detect the temperature and the driving voltage. These circuits 60A and 60B are integrally incorporated in the printing head 60 and connect with two-channel analog-digital conversion input ports AD1 and AD2 of the CPU 110. The CPU 110 reads voltages input and converted to digital signals through the input ports AD1 and AD2 to correct the power-supply time of the printing head 60.

A discriminating switch 102 disposed on a right lower corner of the tape cartridge holder unit 50A (see FIG. 10) is connected with ports PB1 through PB3 of the CPU 110. The discriminating switch 102 includes three cartridge discriminating switch elements 102A, 102B, and 102C respectively inserted into the three detection holes 18Ka, 18Kb, and 18Kc formed on the tape cartridge 10. Projections of the cartridge discriminating switch elements 102A, 102B, and 102C are designed according to the depths of the detection holes 18K formed on the bottom wall 18 of the tape cartridge 10. When the cartridge discriminating switch element 102 is inserted in a shallow detection hole 18K, the cartridge discriminating switch element 102 is in contact with and pressed by the detection hole 18K to be turned ON. When the cartridge discriminating switch element 102 is inserted in a deep detection hole 18K, on the other hand, the cartridge discriminating switch element 102 is loosely fitted in the detection hole 18K to be kept OFF. The CPU 110 determines the type of the tape cartridge 10 set in the tape cartridge holder unit 50A, that is, the width of the tape T accommodated in the tape cartridge 10 according to conditions of the three cartridge discriminating switch elements 102A, 102B, and 102C of the discriminating switch 102. Tape width information representing the width of the tape T is used for determining a printed character size and controlling the printer unit 50B (described later).

A port PB7 of the CPU 110 receives a signal from a contact of the plug 50N. While the plug 50N receives direct current from an AC adapter 113 through insertion of a jack 115, power supply from a battery BT to a power unit 114 is cut by means of a braking contact to avoid power consumption of the battery BT. In the meantime, a signal output from the contact on the plug 50N is input to the port PB7 of the CPU 110. The CPU 110 reads the signal to determine whether power is supplied from the AC adapter 113 or the battery BT and execute required controls. In the embodiment, when power is supplied from the AC adapter 113, a printing speed of the printer unit 50B is set at a maximum value. When power is supplied from the battery BT, on the other hand, the printing speed of the printer unit 50B is slowed down to reduce an electric current peak supplied to the printing head 60 and save power of the battery BT.

The twenty four mega-bit mask ROM 118 connected to an address bus and data bus of the CPU 110 stores four different fonts of 16×16 dots, 24×24 dots, 32×32 dots, and 48×48 dots. The mask ROM 118 stores alphabetical types such as elite, pica, and courier as well as Chinese characters and other specific characters and symbols required in the respective countries. A 24 bit address bus AD, an 8 bit data bus DA, a chip selecting signal CS, an output enabling signal OE of the mask ROM 118 are connected with ports PD0 through PD33 of the CPU 110. These signals are also input to an external input/output connector 50Ea to allow the extension unit 50E attached to the external input/output connector 50Ea to be accessible in a similar manner to the mask ROM 118.

The extension unit 50E directly connectable with the control circuit unit 50F receives a ROM pack or RAM pack optionally supplied as an external memory element. The control circuit unit 50F is electrically connected with the external input/output connector 50Ea through insertion of the ROM pack or RAM pack into a slot of the extension unit 50E, so that information is transmittable between the CPU 110 and the ROM pack or RAM pack. The ROM pack inserted in the extension unit 50E may store specific characters and symbols for drawings, maps, chemistry, and mathematics as well as linguistic fonts other than English or Japanese, and character fonts such as Gothic and handwriting type faces so as to allow editing of a desirable series of characters. The battery backed-up RAM pack which information is freely written in may alternatively be inserted in the extension unit 50E. The RAM pack stores a greater amount of information than a memory capacity of an internal RAM area of the tape printing device to create a library of printing characters or to be used for information exchange with another tape printing device 1.

Character dot data read out of the mask ROM 118 or the extension unit 50E are input to an LCD controller 116A of a display control circuit 116 as well as the CPU 110.

Figure 16:
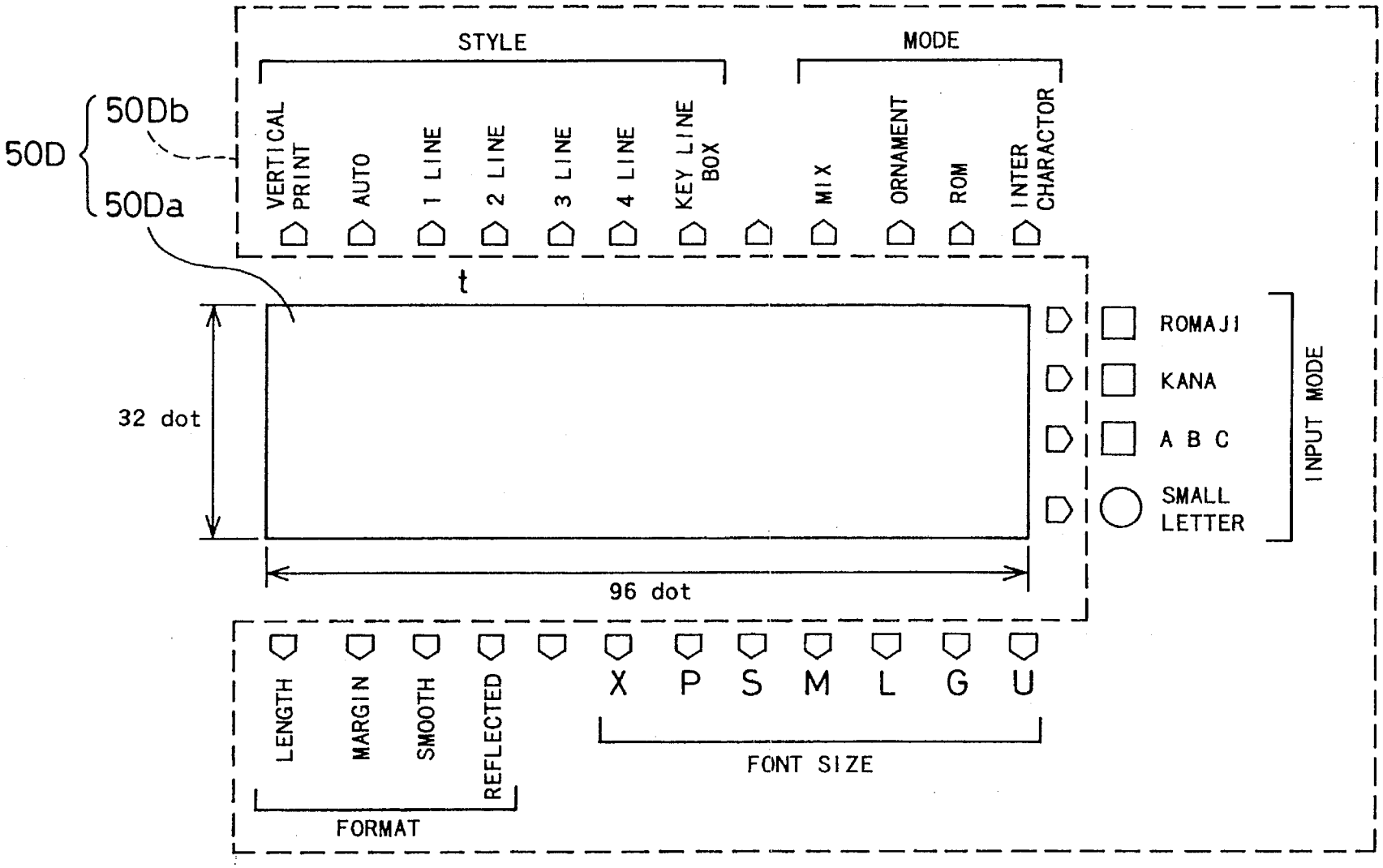
FIG. 16 shows a structure of a display unit 50D.

The display unit 50D controlled by the CPU 110 via the display control circuit 116 is laid under a transparent portion of the cover 50K. The user can thus see the display unit 50D through the cover 50K. The display unit 50D has two different electrode patterns on a liquid-crystal panel; that is, a dot matrix pattern of 32(height)×96(width) dots and twenty eight pentagonal electrode patterns surrounding the dot matrix pattern, as shown in FIG. 16. An area of the dot matrix pattern is designated as a main display element 50Da for displaying a printing image while an area of the pentagonal electrode patterns is referred to as an indicator element 50Db.

The main display element 50Da is a liquid crystal display panel allowing a display of 32 dots in height×96 dots in width. In the embodiment, since a character font of 16 dots in height×16 dots in width is used for character input and editing, a display on the main display element 50Da includes six characters×two lines. Alternatively, the main display element 50Da may include four lines of letters when only an alphabetical font is used. Each character is shown as a positive display, a negative display, or a flickering display according to the editing process.

Figure 17:
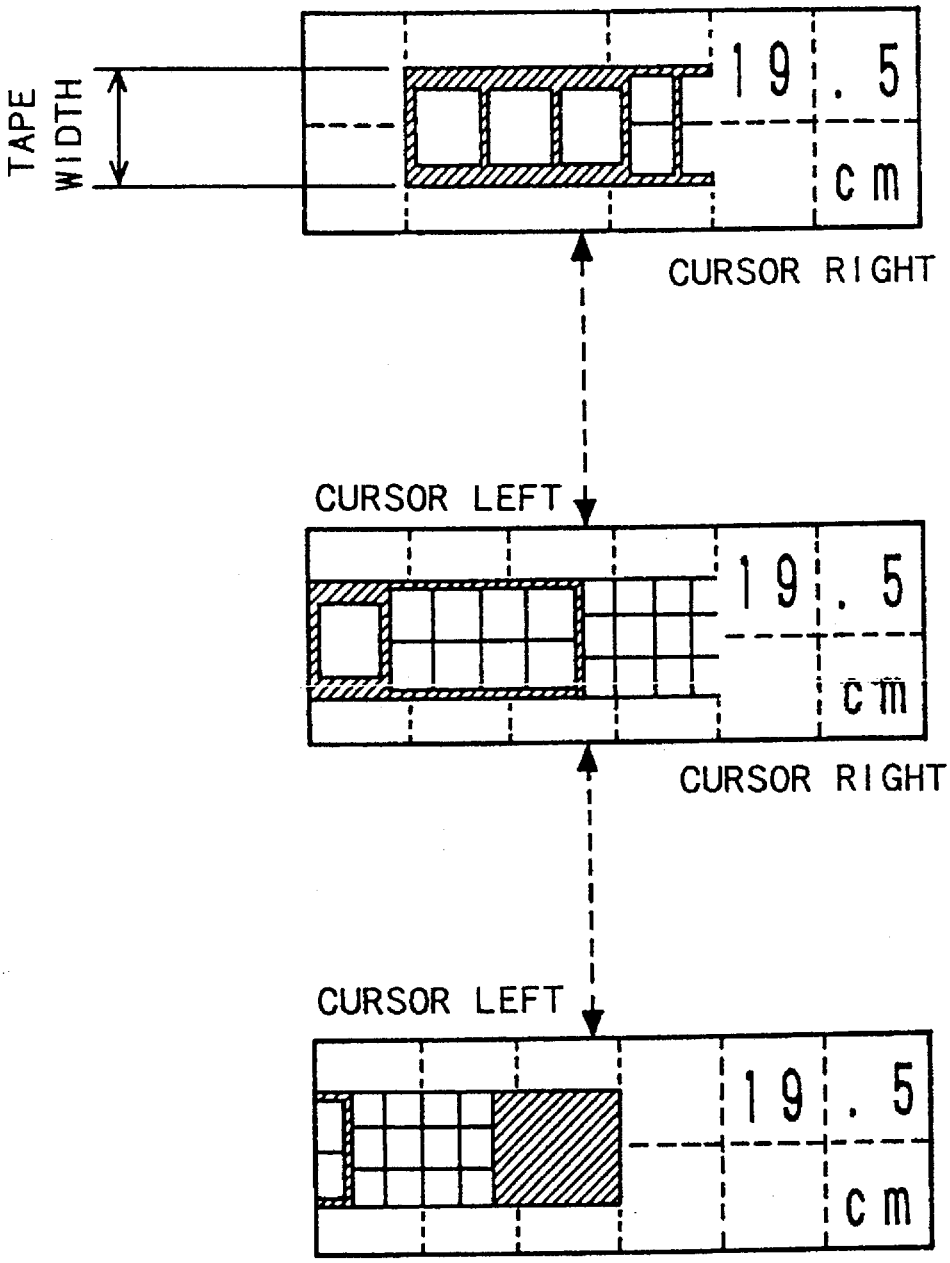
FIG. 17 shows an exemplified layout displayed on the display unit 50D.

The display on the dot-matrix main display element 50Da is controlled according to the requirement. For example, a layout of a printing image may be displayed after a certain key input operation. When the user instructs display of a layout, as shown in FIG. 17, a tape width is shown as a negative display and a series of printing characters are displayed in white, where each dot of the main display element 50Da corresponds to 4×4 dots in printing. A whole length of the tape is displayed numerically as supplementary information of the printing image. When the layout of the printing image is larger than the area of the main display element 50Da, the whole layout may be observed and checked through vertical or horizontal scroll with cursor keys operation.

The indicator element 50Db surrounding the main display element 50Da displays a variety of functions executed by the tape printing device 1. Display elements t each corresponding to a pentagonal electrode pattern of the indicator element 50Db represent a variety of functions and conditions printed around the pentagonal patterns of the display unit 50D. These functions and conditions include a character input mode such as 'romaji' (Japanese in Roman characters) or 'small letter', a printing and editing style such as 'line number' and 'keyline box', and a print format like 'justification' or 'left-weight'. When a function or a condition is executed or selected, the display element corresponding to the function or condition lights up to inform the user.

The printer unit 50B of the tape printing device 1 includes the printing head 60 and the stepping motor 80 as mechanical constituents, and a printer controller 120 for controlling the mechanical constituents and a motor driver 122 as electrical constituents. The printing head 60 is a thermal head having ninety-six heating points arranged in a column at a pitch of 1/180 inch, and internally provided with the temperature detection circuit 60A for detecting the temperature and the voltage detection circuit 60B for detecting the supply voltage as described previously. The stepping motor 80 regulates a rotational angle by controlling a phase of a four-phase driving signal. A tape feeding amount of each step by the stepping motor 80 is set equal to 1/360 inch according to the structure of the gear train functioning as a reduction gear mechanism. The stepping motor 80 receives a two-step rotation signal synchronously with each dot printing executed by the printing head 60. The printer unit 50B thereby has a printing pitch of 180 dots/inch in the longitudinal direction of the tape as well as the direction of the tape width.

A detection switch 99 for detecting operation of the cutting mechanism is connected to a common line of connecting signal lines between the printer controller 120, the motor driver 122, and the CPU 110 as shown in FIG. 14. When the cutting mechanism is driven during printing operation, the detection switch 99 detects operation of the cutting mechanism and inactivates the printer unit 50B. Since signals are continuously sent from the CPU 110 to the printer controller 120 and the motor driver 122, printing may, however, be continued after the user interrupts to use the cutting mechanism.

Actuation of the cutting mechanism during a printing process interferes with normal feeding of the tape T. The detection switch 99 of the embodiment is thus directly connected with the common line of the motor driver 122 to forcibly cut the power off so as to immediately stop the printing process or more specifically the tape feeding. In an alternative structure, an output of the detection switch 99 may be input to the CPU 110, and the printer unit 50B is inactivated according to a software as is the case of untimely opening of the cover 50K. The detection switch 99 may be replaced by a mechanical structure which presses the clutch arm 80B according to the movement of the movable blade 98 to prevent rotation of the stepping motor 80 from being transmitted to the platen driving shaft 72.

The tape printing device 1 is further provided with a power unit 114, which receives a stable back-up or logic circuit 5 V power from the battery BT by an RCC method using an IC and a transformer. The CPU 110 includes a port PB4 for regulating the voltage.

Figure 18:
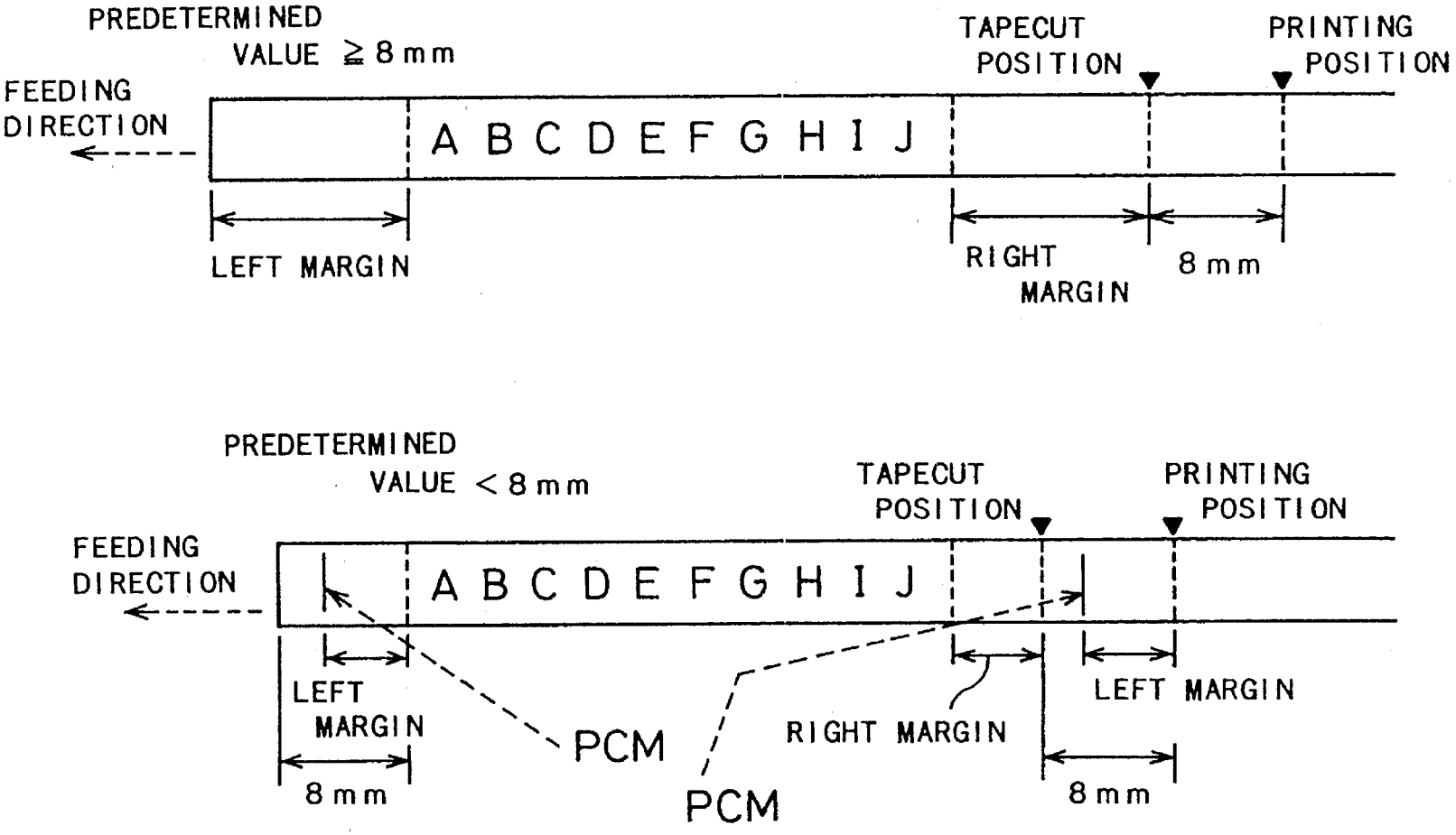
FIG. 18 shows typical examples of left and right margins set on the tape.

The tape printing device 1 of the embodiment has a margin setting function for setting specified lengths of left and right margins before and after a series of printing characters as shown in FIG. 18. The margin setting function is realized by a left margin tape-feeding phase control signal output prior to transmission of 96 bit serial printing data and a right margin tape-feeding phase control signal output after transmission of all the serial printing data. When a specified length of the left margin is smaller than a predetermined distance between a printing position and a tape cut position (less than 8 mm in the embodiment), the specified length of the left margin can not be set. In such a case, while the tape T is fed by a specified length of the right margin after completion of printing, a cut mark PCM is printed when the printing head 60 is positioned before a subsequent printing position by the specified length of a subsequent left margin. The user can cut the tape T fed out of the tape cartridge 10 at the position of the cut mark PCM. Labels having a desirable length of the left margin are obtained by such a simple process.

The internal ROM of the CPU 110 stores a variety of programs for controlling the peripheral circuits. The internal RAM of the CPU 110 includes a first part designated as a system's area used for execution of the variety of programs stored in the internal ROM and a second part defined as a user's area including a text area for character editing and a file area for storing contents of the text.

The text area receives 125 characters of fixed input at the maximum, and stores character codes as well as style data and mode data used for editing the characters. The memory contents in the text area may be supplemented or updated according to character input and editing operation.

The internal RAM has a file area of 1,500-character capacity while the optionally supplied RAM pack has a file area of 2,000-character capacity. The file area stores and manages a maximum of 99 variable length files having ID numbers of 1 through 99 according to a file management program stored in the internal ROM. The file management program is also used for basic operations such as file register and file delete.

A characteristic control for printing a plurality of lines executed by the control circuit unit 50F thus constructed is explained below.

The tape printing device 1 of the embodiment includes four different font data of 16×16 dots to 48×48 dots as basic fonts in the mask ROM 118 as shown in FIG. 19. In each font, the height and the width are respectively expandable by two times and four times. There are thus ten possible combinations of printable dots or fonts including the maximum font of 96×192 dots as shown in FIG. 19. When a series of characters are printed in a plurality of lines, specification of the font for printing characters on each line is required as well as input of characters to be printed on the line.

In the embodiment, there is a specific mode for inputting a relative size of characters to be printed on each line through key operation of the input unit 50C, instead of directly specifying the character font. For example, in three-line printing, the character size is relatively large on the first line and the second line, and relatively small on the third line. The tape printing device 1 of the embodiment is further provided with a simpler mode, wherein the user selects an optimal combination of relative character sizes out of a plurality of standard combinations, and the device 1 then determines a number of dots in an actual font according to the width of the tape set in the device 1. There are five options for three-line printing as shown in FIG. 20; that is, (1) same character size ×3, (2) small, small, large, (3) small, large, large, (4) large, small, small, and (5) large, large, small. The user selects one of these five options instead of inputting the relative character size of each line. Although design and ornamental effects may be sacrificed, there is still a simpler 'Auto' mode which automatically sets an identical character size for each line. The device 1 of the embodiment also has a manual mode wherein the user manually determines a dot number of characters printed on each line. In this manual mode, the user should confirm that a total dot number of plural lines is within 96 in the direction of the height.

Figure 21:
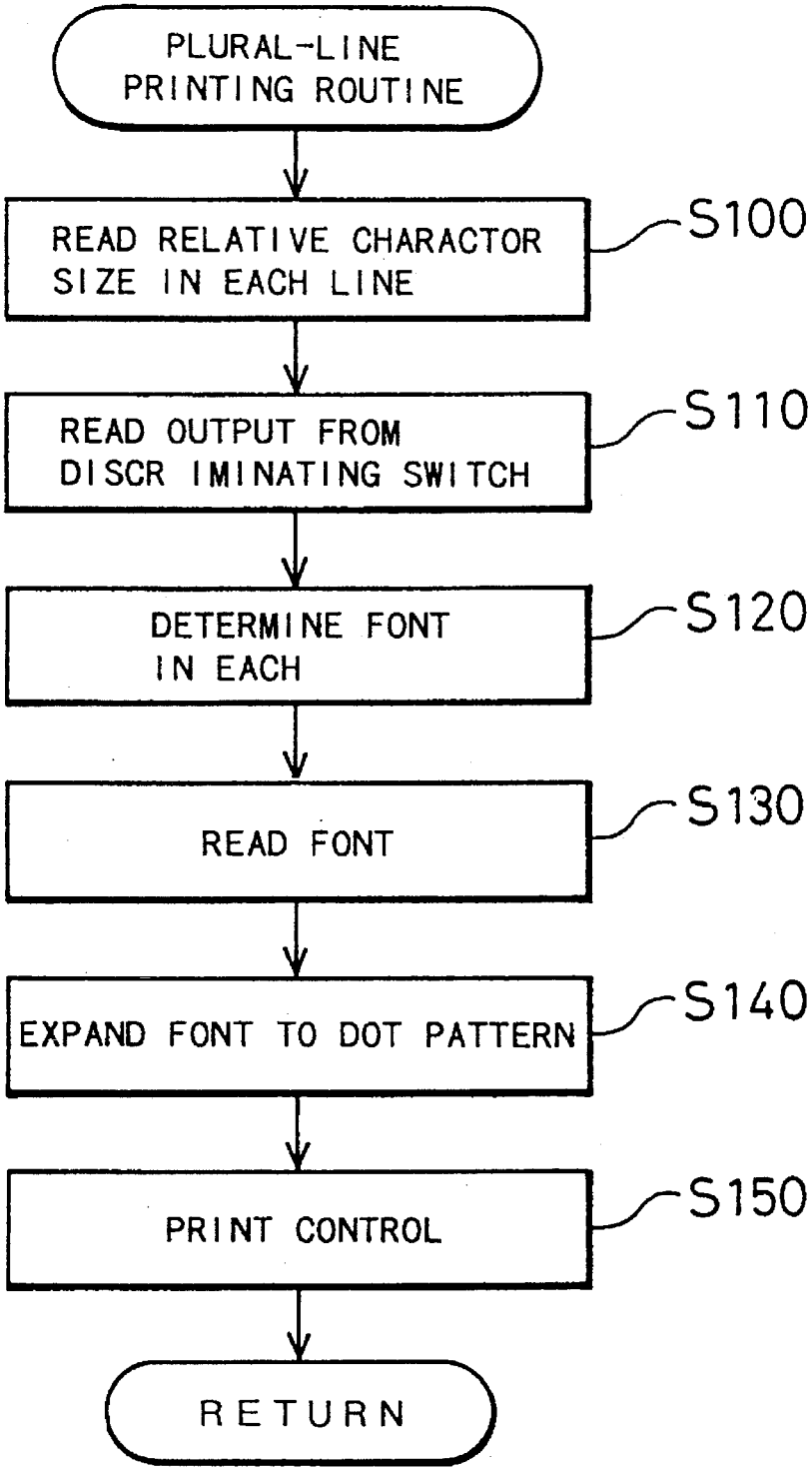
FIG. 21 is a flowchart showing a plural-line printing routine.

When the user presses a 'Print' key of the input unit 50C after completion of the whole input operation, the CPU 110 starts a plural-line printing routine shown in the flowchart of FIG. 21. When the program enters the plural-line printing routine, the CPU 110 first reads printing information at steps S100 and S110. More concretely, the CPU 110 reads relative character sizes of plural lines selected prior to a printing instruction at step S100, and then reads a detection signal of the cartridge discriminating switch 102 at step S110. At step S120, the CPU 110 determines the width of a tape T currently set in the tape printing device 1 based on detection of the cartridge discriminating switch 102, and determines a character font of each line based on the width of the tape T and the relative character size of each line by referring to a font map previously stored in the internal ROM.

FIG. 20 shows an example of a font map used in three-line printing. In this font map, each combination of the tape width and the relative character sizes of three lines determines a font used for printing each line. For example, when the tape width is 12 mm and the relative sizes are 'large, small, small', the selected font is S for the first line and P for the second and the third lines. In two-line printing, the font of each line is determined in the same manner as above (its procedure is not described here).

After determination of the font for each line, the program goes to step S130 at which the CPU 110 successively reads the determined font corresponding to character codes representing a desirable series of characters previously input by the user, out of the mask ROM 118. The CPU 110 then expands the font to dot patterns at step S140, creates 96 bit serial data by extracting the dot patterns by every column, and transfers the serial data to the printer unit 50B at step S150.

As previously described, the tape cartridge 10 shows the width of the tape T accommodated therein as a combination of depths of the three detection holes 18Ka, 18Kb, and 18Kc formed on the bottom wall 18 of the tape cartridge 10. The tape printing device 1 of the embodiment automatically determines the width of the tape T accommodated in the tape cartridge 10 based on three-bit information output from the discriminating switch 102 for detecting the depths of the detection holes 18K.

The tape printing device 1 of the embodiment thus automatically computes and determines specification of printed characters such as a character font number corresponding to the tape width. When the user simply instructs printing after edition of a desirable series of characters, the tape printing device 1 detects the width of the tape T currently set in the device 1, determines an optimal combination of character fonts with predetermined right, left, top, and bottom margins corresponding to the width of the tape T with its automatic setting function, and executes printing.

The tape cartridge 10 and the tape printing device 1 of the embodiment make the user free from troublesome management of a plurality of tape cartridges having tapes of different widths therein. The tape printing device 1 can produce a desirable label with an optimal character font corresponding to the tape width without requiring complicated specification of the character font.

Figure 22A:
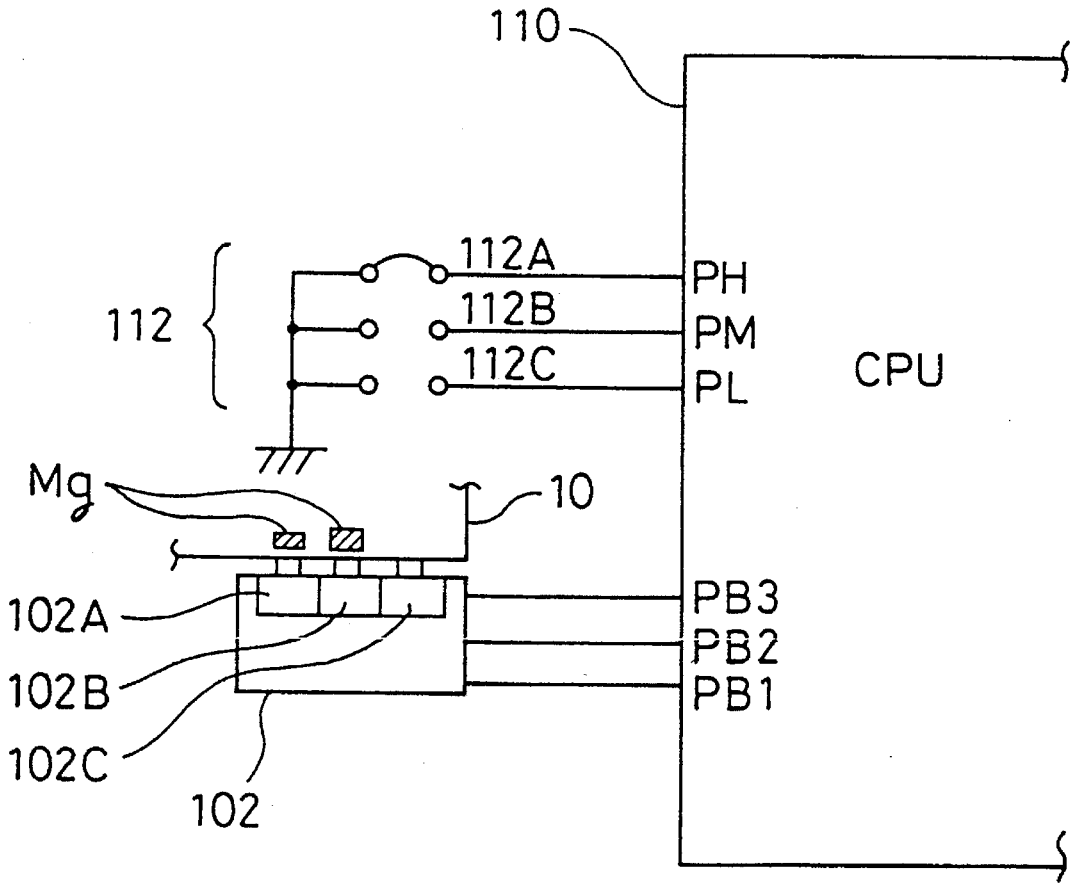
FIG. 22A through 22C shows a modification of the first embodiment.

An example of modification of the embodiment is given below. Although the type of the tape cartridge 10 is detected according to the depths of the three detection holes 18K in the above embodiment, a magnetic detection mechanism may be applicable instead of the structure of the embodiment. In the magnetic detection mechanism, a magnetic detection element detects existence and non-existence of magnets. In this modified structure, the three detection holes 18Ka, 18Kb, and 18Kc shown in FIG. 4 have identical depths to receive small permanent magnets Mg, respectively. As shown in FIG. 22A, each discriminating switch element 102 has a Hall element to allow detection of magnetic information. In the combination shown in FIG. 8, 'S (shallow)' and 'D (deep)' should respectively be replaced by 'Magnet' and 'Non magnet'. This modified structure effectively detects the type of the tape cartridge as in the structure of the first embodiment.

Figure 22B:
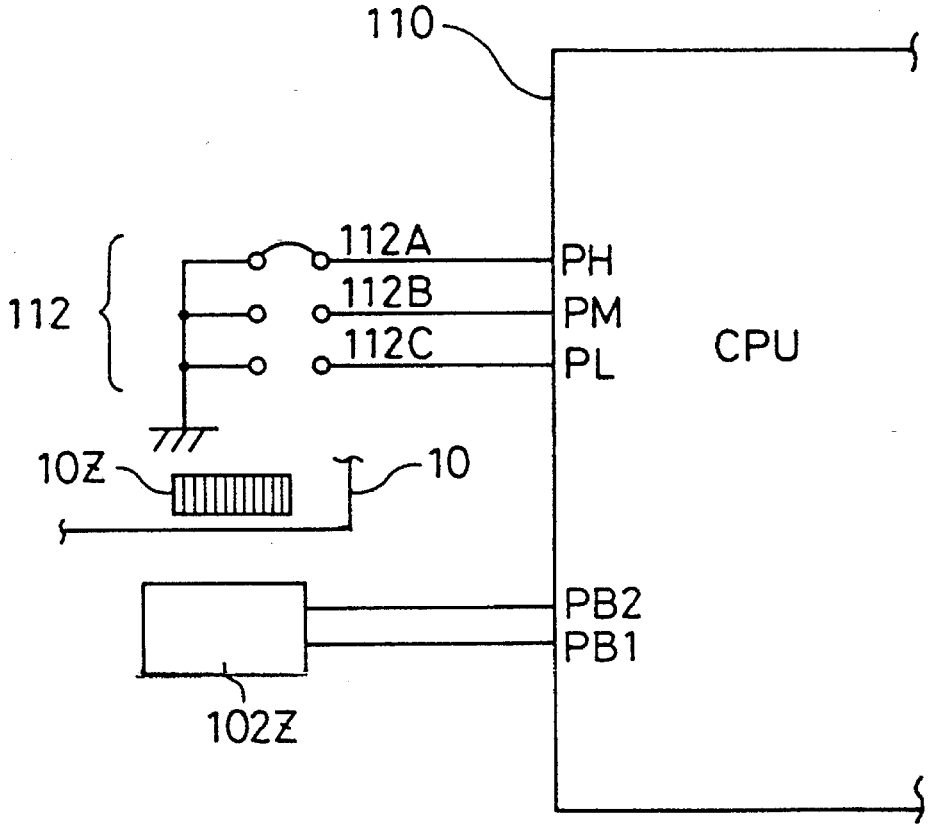
Figure 22C:
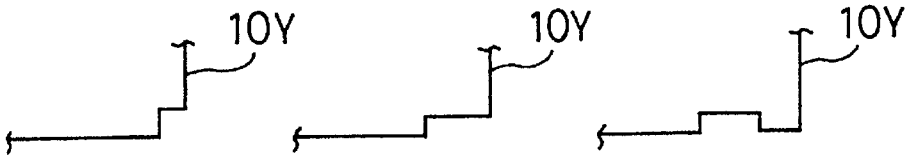

Discrimination of the cartridge 10 may be implemented optically. FIG. 22B shows an exemplified structure of optical identification where a bar code label 10Z applied on each cartridge 10 is scanned optically by an optical reader 102Z. The type of the cartridge 10 is identified by reading an output of the optical reader 102Z via a port. Since identification of the cartridge does not require such a large information capacity that each bar code generally contains, simpler optical scanning may be applied for the same purpose; for example, determining existence or non-existence of the detection holes optically instead of mechanically as in the first embodiment. In another application, cartridges 10 may respectively have distinct outer shapes different from one another as cartridges 10Y shown in FIG. 22C to allow identification based on their outer shapes.

Figure 23:
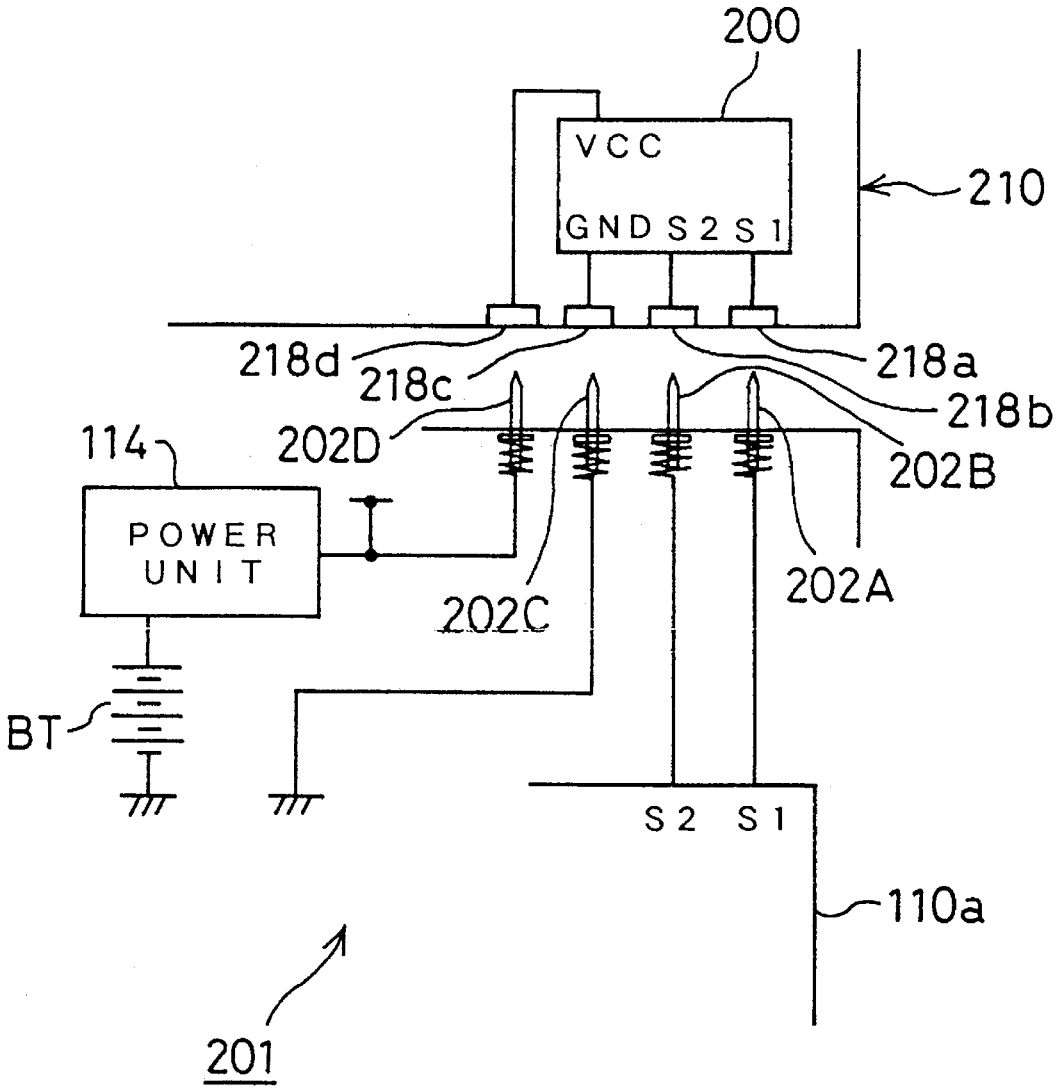
FIG. 23 shows an essential part of a second embodiment in accordance with the invention.

A second embodiment of the invention is described hereinafter. A tape cartridge 210 and a tape printing device 201 of the second embodiment have similar hardware structures to those of the first embodiment except the following elements shown in FIG. 23.

(1) The tape cartridge 210 has a one-chip micro-processor 200 including a ROM, a RAM, an SIO (communication control element), an electrically erasable, programmable ROM (hereinafter referred to as EEPROM).

(2) The tape cartridge 210 has four contacts 218*a*, 218*b*, 218*c*, and 218*d* in place of the three detection holes 18Ka through 18Kc of the first embodiment. Each contact 218 connects to serial communication terminals S1 and S2, an earth terminal GND, and a power terminal VCC of the one-chip micro-processor 200.

(3) The tape printing device 201 has four axially extensible contact pins 202A, 202B, 202C, and 202D in place of the cartridge discriminating switch 102 of the first embodiment. Each contact pin 202 is connected to serial communication ports S1 and S2 of a CPU 110*a*, an earthing line, and a power line from a power unit 114 when the tape cartridge 210 is set in the tape printing device 201.

When the tape cartridge 210 is set in a tape cartridge holder unit 50A, the contact pins 202A through 202D of the tape printing device 201 are brought into contact with the contacts 218*a* through 218*d* of the tape cartridge 210. The one-chip micro-processor 200 then receives power supplied from the power unit 114 to execute a program previously stored in the internal ROM. The CPU 110*a* of the tape printing device 201 and the one-chip micro-processor 200 of the tape cartridge 210 are connected to each other to allow serial communication.

Figure 24A:
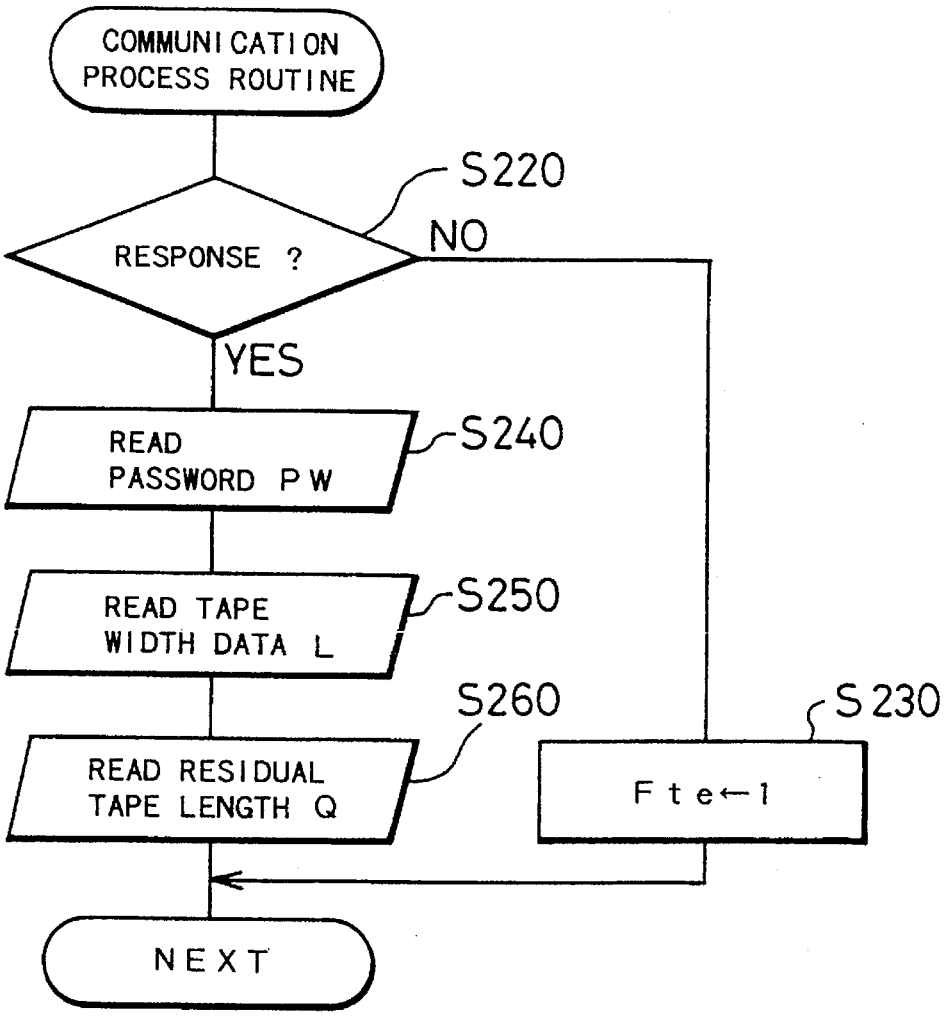
FIG. 24A is a flowchart showing a communication routine in the second embodiment.

The CPU 110*a* of the tape printing device 201 executes a communication process routine shown in FIG. 24A through a timer interruption generated by an internal timer at predetermined time intervals. When the program enters the communication process routine, the CPU 110*a* determines whether it detects a response from the one-chip microprocessor 200 of the tape cartridge 210 at step S220. When no response is detected at step S220, it is presumed that the tape cartridge 210 is not substantially or accurately set in the tape cartridge holder unit 50A. In such a case, the program goes to step S230 at which a flag Fte is set equal to one, and then exits from the routine via NEXT. The flag Fte represents insufficient setting of the tape cartridge 210.

When the CPU 110*a* detects a response from the one-chip micro-processor 200 at step S220, the program goes to step S240 at which the CPU 110*a* reads a password PW previously set in the one-chip micro-processor 200. The password PW consists of four or more alphabetical letters and figures and is set when the CPU 110*a* of the tape printing device 201 transfers data input from an input unit 50C to the one-chip micro-processor 200 according to another process routine (not shown). At step S240, the one-chip micro-processor 200 transmits data specified by the password PW through serial communication. When no password PW is set previously, vacant data is transferred.

The CPU 110*a* then reads tape width data corresponding to a width L of a tape T previously stored in the one-chip micro-processor 200 of the tape cartridge 210 at step S250. The CPU 110*a* does not read information representing a type of the tape cartridge 210 but directly reads the tape width data. This structures allows the tape printing device 201 to be applicable to tapes T of any possible width other than tapes of predetermined widths accommodated in the tape cartridges 210 previously manufactured.

At step S260, the CPU 110*a* reads data of a residual tape length Q out of the one-chip micro-processor 200. The residual tape length Q represents the length of the tape T remaining in the tape cartridge 210 and is updated by the tape printing device 201 through a post-printing process (described later). After execution of step S260, the program exits from the routine via NEXT.

Figure 24B:
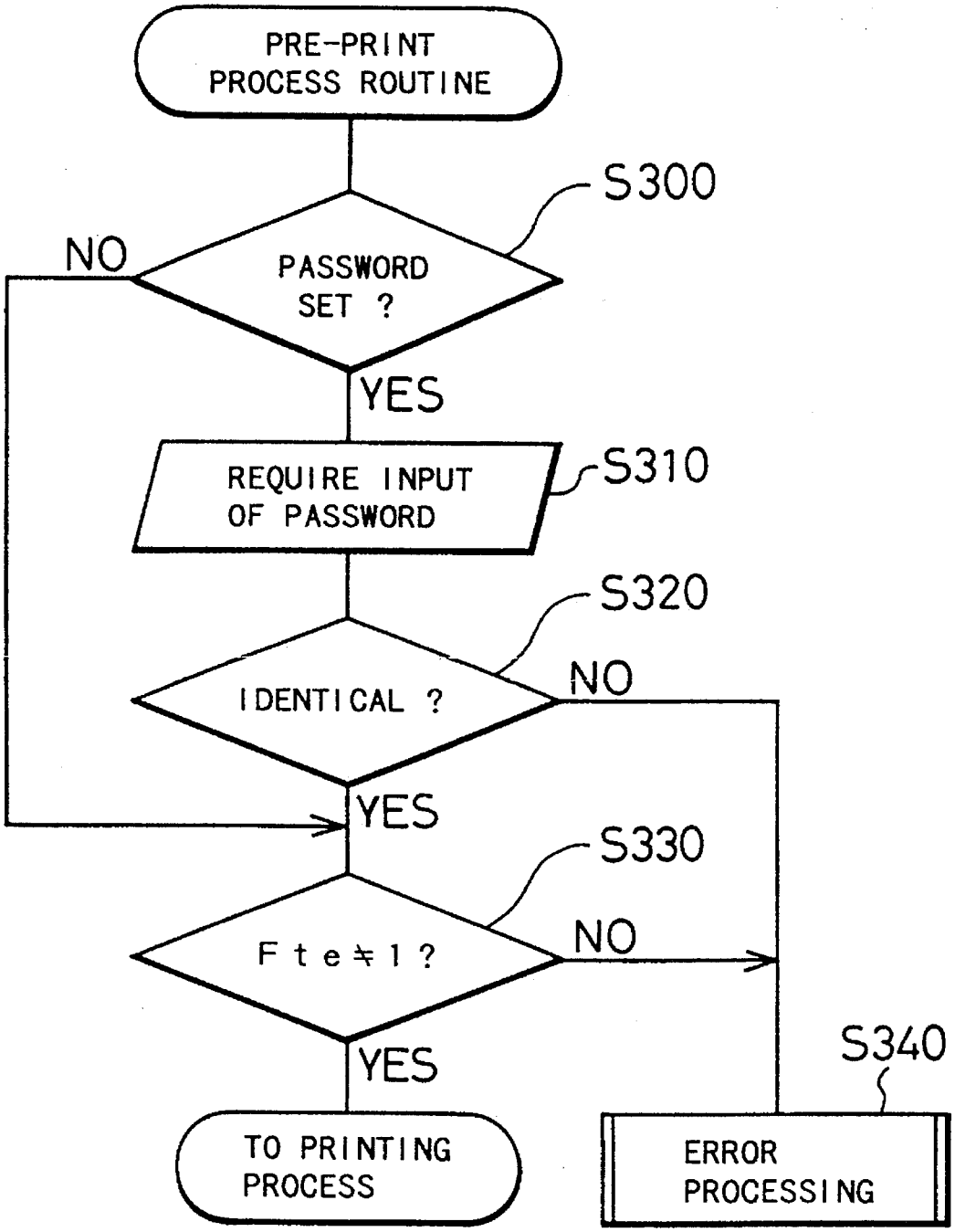
FIG. 24B is a flowchart showing a pre-printing routine in the second embodiment.

A pre-printing routine executed by the CPU 110*a* of the tape printing device 201 is described according to the flowchart of FIG. 24B. This pre-printing routine is executed immediately before execution of a printing process by the tape printing device 201. At step S300, the CPU 110*a* determines whether the password PW is previously set. The password PW represents data read from the tape cartridge 210 at step S240 of FIG. 24A when the tape cartridge 210 is set in the tape printing device 201. The CPU 110*a* determines setting of the password PW if the data read at step S240 is not vacant. The program then goes to step S310 at which the user is required to input a password. More concretely, a display such as 'password?' on the display unit 50D asks the user to input a password.

The user inputs a password previously set for the tape cartridge 210 through the input unit 50C according to the input requirement. At step S320, the CPU 110*a* compares the input password with the password PW previously set in the tape cartridge 210. When the input password is identical with the password PW, the CPU 110*a* determines that the user can use the tape cartridge 210 currently set in the tape printing device 201. At step S330, the CPU 110*a* checks the value of the flag Fte. The flag Fte is set equal to one when the tape cartridge 210 is not accurately or substantially set in the tape printing device 201 or when the residual tape length Q reaches to zero. When the flag Fte is not equal to one, the CPU 110*a* determines accurate setting of the tape cartridge 210 and a sufficient amount of the residual tape length Q and executes a printing process such as the plural-line printing routine shown in the flowchart of FIG. 21.

When the input password is not identical with the password PW at step S320 or when the flag Fte is equal to one at step S330, the program goes to step S340 at which the CPU 110*a* determines setting of a wrong tape cartridge 210 or inaccurate setting of the tape cartridge 210 and executes a predetermined error process. The error process includes output of an error message such as 'CARTRIDGE REPLACEMENT REQUIRED'. After the tape cartridge 210 is replaced by a new one, the CPU 110*a* executes the communication routine shown in FIG. 24A again.

Figure 25:
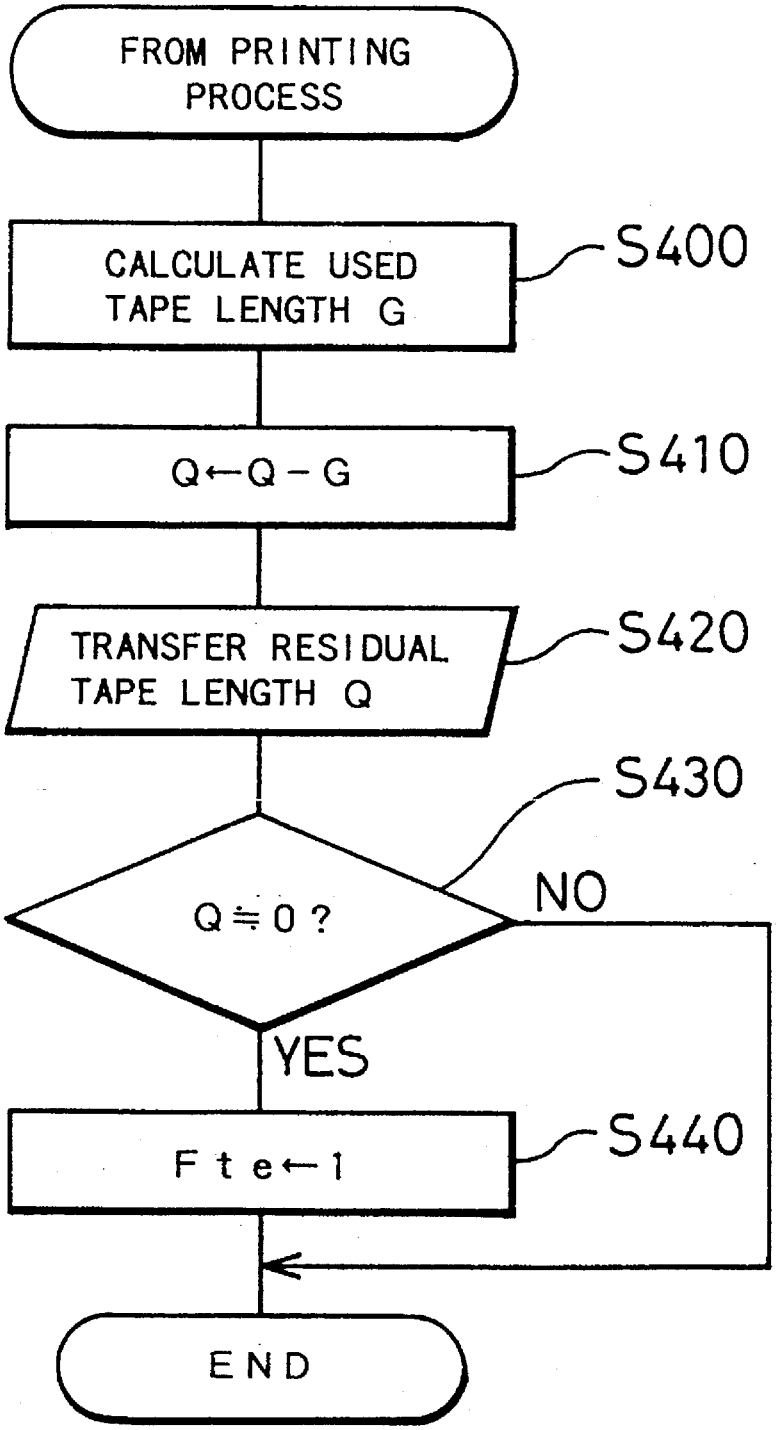
FIG. 25 is a flowchart showing a post-printing routine in the second embodiment.

FIG. 25 is a flowchart showing a post-printing process routine executed after completion of the printing process. At step S400, the CPU 110*a* calculates a length G of the tape T used in the printing process (hereinafter referred to as the used tape length). The used tape length G is determined by counting a number of steps sent to the stepping motor 80 for feeding the tape T.

At step S410, the used tape length G is subtracted from the residual tape length Q. The program then goes to step S420 at which the current residual tape length Q updated at step S410 is transmitted to the one-chip micro-processor 200 of the tape cartridge 210. Since the tape cartridge 210 may be removed from the tape printing device 201 at any desirable time, the current residual tape length Q is written in the tape cartridge 210 immediately after completion of the printing process.

The program proceeds to step S430 at which it is determined whether the updated residual tape length Q is substantially equal to zero. When a sufficient amount of the tape T remains in the tape cartridge 210, the program exits from the routine. When the residual tape length Q is substantially equal to zero, the program goes to step S440 at which the flag Fte is set equal to one and exits from the routine.

In the structure of the second embodiment described above, information on the tape cartridge 210 is set in the EEPROM in the one-chip micro-processor 200 of the tape cartridge 210. The tape printing device 201 reads the information at any required time and updates the information according to the requirement. The EEPROM stores updating information such as the password and the residual tape length as well as essential information of the tape cartridge 210 such as the tape width. This structure allows identification of the user and required error processing according to the residual tape length other than expansion of a font corresponding to the tape width.

Figure 26:
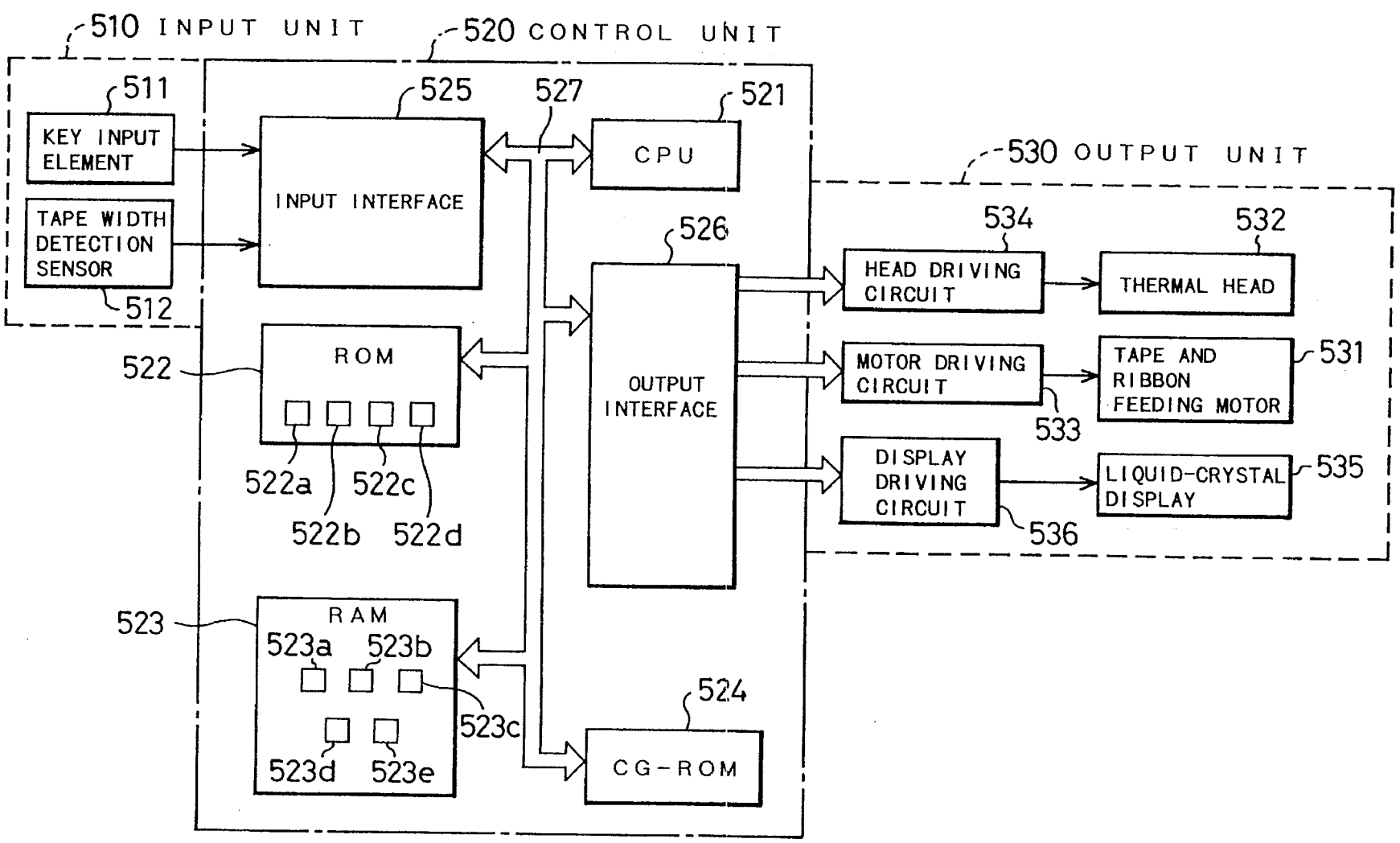
FIG. 26 is a block diagram illustrating a general electric structure of a third embodiment in accordance with the invention.

A third embodiment of the invention is described hereinafter according to the drawings. A tape printing device 501 of the third embodiment is applicable to tapes of five different widths, 6 mm, 9 mm, 12 mm, 18 mm, and 24 mm like the first and the second embodiments. The appearance of the tape printing device 501 is similar to that of the first or the second embodiment. FIG. 26 is a functional block diagram illustrating a general electric structure of the tape printing device 501.

As shown in FIG. 26, the tape printing device 501 includes an input unit 510, a control unit 520, and an output unit 530 as in the case of a conventional data processing apparatus. The control unit 520 executes required processing based on information from the input unit 510 and activates the output unit 530 to display or print the results of the processing.

The input unit 510 includes a key input element 511 having a plurality of press-down keys and dial keys (not shown in detail), and a tape width detection sensor 512. The key input element 511 generates character code data and various control data sent to the control unit 520. The tape width detection sensor 512 detects the width of a tape T currently set in the tape printing device 501 and gives the tape width information to the control unit 520. Each tape cartridge has a physical discrimination element such as a plurality of holes for defining the width of the tape T accommodated in the tape cartridge. The tape width detection sensor 512 reads the physical discrimination element to output the tape width information. Details of this processing are similar to those of the first embodiment and thereby not described here.

In the tape printing device 501 of the third embodiment, the key input element 511 has a variety of margin setting keys for specifying left and right margins arranged before and after a series of characters printed on the tape T. These margin setting keys may have other functions and be realized as complex-functional keys. The tape width information detected by the tape width detection sensor 512 is utilized as one determining factor for determining the left and right margins.

The output unit 530 consists of a printing structure and a display structure. For example, a tape and ribbon feeding motor 531 constituted as a stepping motor feeds a tape (not shown) and an ink ribbon (not shown) to a predetermined printing position or out of the tape printing device 501. A thermal head 532 is fixed to implement thermal transfer printing onto a running tape. When the thermal head 532 has ninety six thermal resistance elements (hereinafter referred to as dot elements) arranged in a column, a maximum of 96 dots may be printed at once. The tape and ribbon feeding motor 531 and the thermal head 532 are respectively driven by a motor driving circuit 533 and a head driving circuit 534 under control of the control unit 520. Desirable margins may be set in each label by controlling a tape feeding amount by the tape and ribbon feeding motor 531 and a printing timing of a front cut mark by the thermal head 532 as described later. A cutter (not shown) manually operated by the user or driven by the motor is used for cutting the tape at a desirable position. The cutter is naturally disposed a predetermined space apart from the thermal head 532 because of their physical dimensions. The predetermined space (for example, 8 mm) is taken into account when the margins are set on the tape.

The output unit 530 of the tape printing device 501 further includes a liquid-crystal display 535 which shows several characters of a minimum font on a plurality of lines. The liquid-crystal display 535 is driven by a display driving circuit 536 under control of the control unit 520. During a margin length setting process, an image including margins currently set is displayed on the liquid-crystal display 535.

The control unit 520, for example, realized as a microcomputer, includes a CPU 521, a ROM 522, a RAM 523, a character generator ROM (CG-ROM) 524, an input interface element 525, and an output interface element 526, which are connected to one another via a system bus 527.

The ROM 522 stores a variety of processing programs and fixed data such as dictionary data used for conversion of Japanese alphabets into Chinese characters. For example, the ROM 522 stores a print format setting program 522*a* including a margin length setting process shown in the flowchart of FIG. 27 and a printing program 522*b* including a margin setting process shown in the flowchart of FIG. 28. The ROM 522 further stores a default value 522*c* of a print format including margin lengths (described later) as well as a margin conversion table 522*d* used for converting relative margin lengths to absolute values.

The RAM 523 used as a working memory stores fixed data obtained through input operation by the user. The RAM 523 includes a print format area 523*a* for storing a print format including margin lengths, a printing buffer 523*b* for expanding a series of printing characters to dots and storing the dots, a display buffer 523*c* for storing an image displayed for setting margin lengths, a text area 523*d* for storing character data, and a previous right margin buffer 523*e* for storing a right margin length in previous printing.

The CG-ROM 524 stores a dot pattern of characters and symbols in the tape printing device 501, and outputs the dot pattern when receiving code data specifying certain characters and symbols. The control unit 520 may include two CG-ROMs, one for display and the other for printing.

The input interface element 525 functions as an interface between the input unit 510 and the control unit 520 while the output interface element 526 works as an interface between the control unit 520 and the output unit 530.

The CPU 521 executes a required processing program stored in the ROM 522 based on input signals from the input unit 510 while using the RAM 523 as a working area and reading the fixed data stored in the ROM 522 and the RAM 523 according to the requirement. The CPU 521 then activates the output unit 530 to display processing conditions or results on the liquid-crystal display 535 or to print the same on a tape.

When a print format setting mode is specified through operation of the key input element 511, the CPU 521 starts the print format setting program 522*a* stored in the ROM 522.

Figure 27:
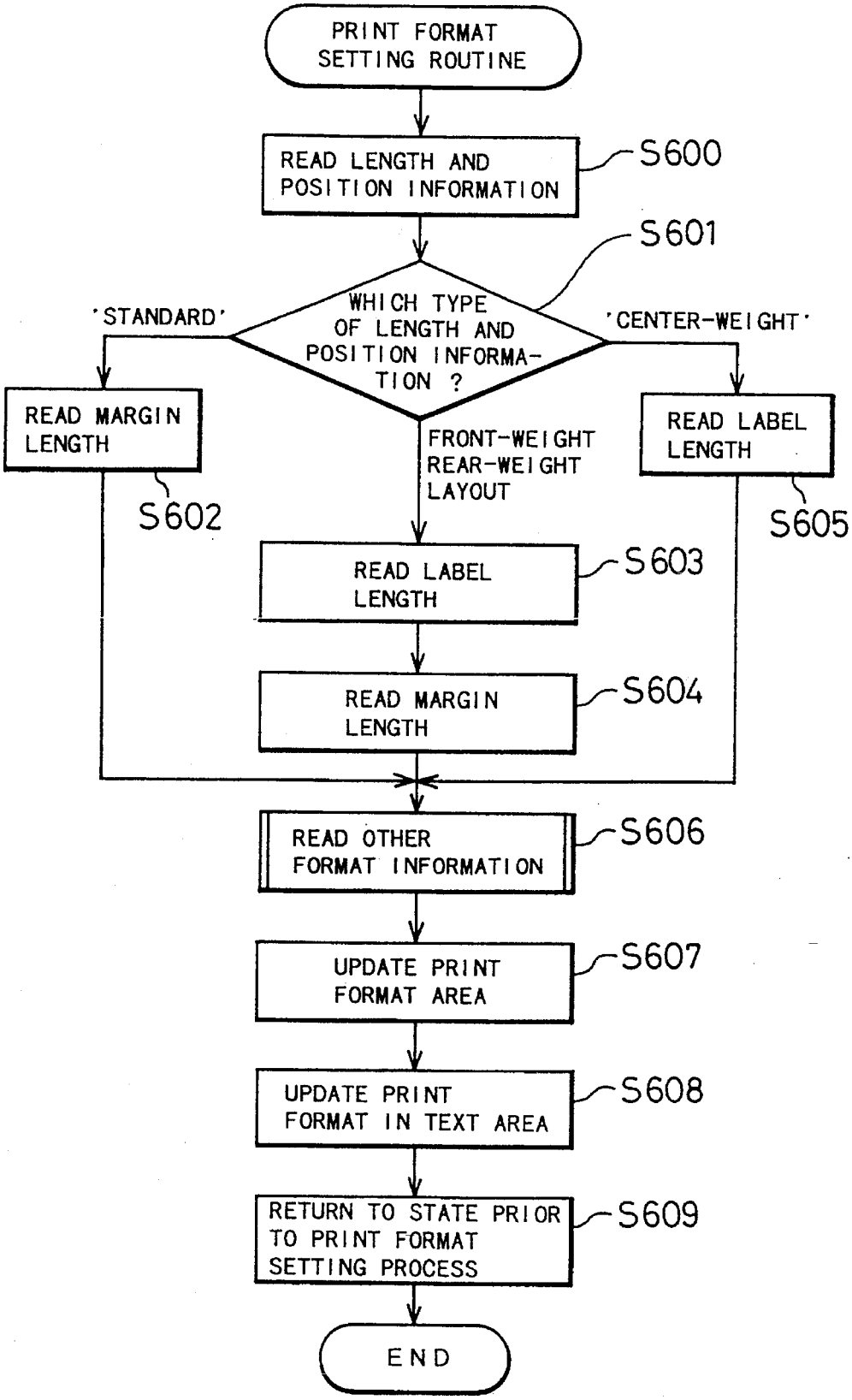
FIG. 27 is a flowchart schematically showing a routine of specifying a print format in the third embodiment.

Details of the processing in the print format setting mode executed by the CPU 521 are described according to the flowchart of FIG. 27.

When a print format setting button is pressed, the CPU 521 starts a print format setting routine of FIG. 27. At step S600, the CPU 521 reads information representing a length of a label and a printing position of a series of characters on the label (hereinafter referred to as length and position information). The program then goes to step S610 at which the CPU 521 determines the type of the length and position information.

In the tape printing device 501 of the third embodiment, the user may specify the length of a label with a desirable print thereon. There are five modes of length-position combinations, that is, 'standard', 'left-weight', 'center-weight', 'right-weight', and 'justification'. In the 'standard' mode, the user does not specify a label length. An effective length of the label is a total of a printing area and right and left margins specified as described later. In the 'left-weight' mode, a left margin of a desirable length is first set from a front end of a label of a desirable length specified by the user. A printing area required for printing a series of characters is then determined on the label. A right margin arranged after the printing area is a residue of the desirable label length. In the 'center-weight' mode, a printing area is set on the center of a label of a desirable length specified by the user. Left and right margins are residues of the desirable label length arranged before and after the printing area. Specification of the left and right margins is not required in this mode. In the 'right-weight' mode, a right margin of a desirable length is first set from a rear end of a label of a desirable length specified by the user. A printing area required for printing a series of characters is then determined on the label. A left margin arranged before the printing area is a residue of the desirable label length. In the 'justification' mode, left and right margins of desirable lengths are respectively set on front and rear portions of a label of a desirable length specified by the user. A printing area is then laid out on the residual center portion of the label and characters are set in the printing area with equal interval. For example, the user selects one of these five modes shown in a menu.

When the 'standard' mode is selected, the program goes to step S602 at which the CPU 521 reads margin length information, and then proceeds to step S606 for reading other format information required for setting a print format.

When any of the 'left-weight' mode, the 'right-weight' mode, and the 'justification' mode is selected, the program goes to steps S603 and S604 where the CPU 521 successively reads label length information and margin length information, and then proceeds to step S606 for reading other format information required. When the 'center-weight' mode is selected, the program goes to step S605 at which the CPU 521 reads label length information, and then proceeds to step S606 for reading other format information required.

In this embodiment, a margin length read at step S602 or S604 is a relative value selected out of a menu by the user; for example, 'minimum', 'small', 'average', and 'large'. The margin length specified as a relative value is converted to an absolute value in printing process as described later.

Contents stored in the print format area 523*a* are also shown in a first menu displayed for inputting the above information. The default value 522*c* of the print format stored in the ROM 522 is set in the print format area 523*a* when a power switch is turned on.

When completion of the print format setting process is determined after reading of the other format information such as a printing density at step S606, the program successively goes to steps S607, S608, and S609 at which the CPU 521 stores the current format information in the print format area 523*a* (updates the print format area 523*a*), updates the print format set for a series of characters stored in the text area 523*d*, and returns to the state prior to instruction of the print format setting process. The program then exits from the print format setting routine.

Figure 28:
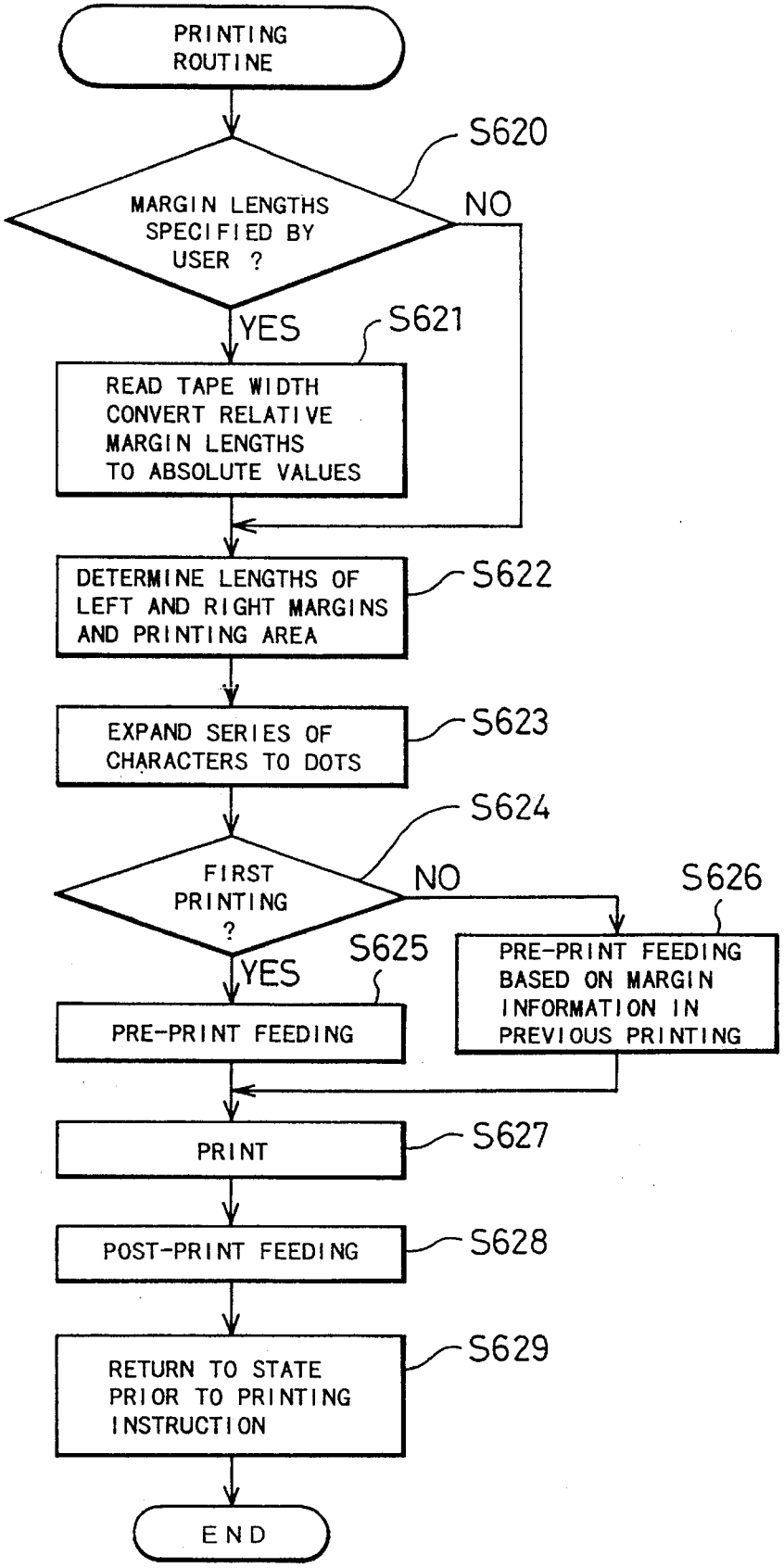
FIG. 28 is a flowchart schematically showing a printing routine in the third embodiment.

FIG. 28 is a flowchart schematically showing a printing routine. The user may instruct printing at any desirable time as long as the text area 523*d* stores a series of characters with the currently set print format.

When a printing key is operated, the CPU 521 starts the printing program 522*b* shown in FIG. 28. At step S620, it is determined whether the user has specified a relative margin length based on the format information stored in the text area 523*d*, that is, whether the length and position information includes specification of the margin length. When the answer is YES, the program goes to step S621 at which the relative margin length is converted to an absolute value based on tape width information and the margin conversion table 522*d*.

The tape width information may be read directly from the tape width detection sensor 512 at this moment, or alternatively read out of the RAM 523 which has previously received the tape width information from the tape width detection sensor 512 when the tape cartridge is set in the tape printing device 501. Conversion of the relative margin length to the absolute value may be realized through operation without the margin conversion table 522*d*.

For example, when the relative margin length is 'small', one fourth the tape width is determined as an absolute value of the margin length. When the relative margin length is 'average', half the tape width is determined as an absolute margin length. When the relative margin length is 'large', the whole tape width is determined as an absolute margin length. When the relative margin length is 'minimum', the absolute value is set equal to one millimeter irrespective of the tape width.

When the length and position information does not include specification of the margin length or when conversion of the relative margin length to the absolute value is completed, the program goes to step S622 at which the CPU 521 determines lengths of right and left margins and a printing area based on information including the length and position information, the absolute margin length, and a specified label length. At step S623, a series of characters in the text area 523*d* are expanded to dots in the printing buffer 523*b*.

The CPU 521 then determines whether printing is at a first time or at a second or subsequent time at step S624. When this is first printing, the program goes to step S625 at which the tape is fed by a predetermined length before printing. When this is second or subsequent printing, the program goes to step S626 at which a pre-print tape feeding process is executed (the tape may be or may not be fed) according to information representing a previous right margin length set in the previous printing. After printing the series of characters at step S627 and feeding the tape by a predetermined length after printing at step S628, the program goes to step S629 at which the CPU 521 returns to the state prior to operation of the printing key. The program then exits from the printing routine.

The pre-print feeding and the post-print feeding are executed according to the lengths of the right and left margins determined at step S622 to set desirable lengths of left and right margins on the label. A front cut mark may be printed during the pre-print feeding process.

The first printing denotes printing at a first time after the current tape cartridge is set in the tape printing device 501 or after the power of the tape printing device 501 is turned on. The second or subsequent printing denotes printing other than the above. Some trouble may occur due to the slack of the ink ribbon right after replacement of the tape cartridge or by replacement of the tape cartridge during power cut-off. The pre-print feeding process for the first printing is thereby different from that for the second or subsequent printing. Even in the case of first printing as defined above, when the tape has been fed manually irrespective of printing, the pre-print feeding process for the second or subsequent printing should be executed. The manual tape feeding is implemented through specific key operation by the user (details are not described here).

The relationship between the tape feeding process and the margin arrangement is described for the post-print feeding process (step S628), for the pre-print feeding process in first printing (step S625), and for the pre-print feeding process in second or subsequent printing (step S626).

The post-print feeding and the pre-print feeding in second or subsequent printing are executed in such a manner as to minimize a waste length of the tape.

(1) Post-print Feeding Process

The post-print feeding is conducted for setting a desirable length of a right margin arranged after a printing area. This process is identical in first printing and in second or subsequent printing.

Figures 29A, 29B, 29C:
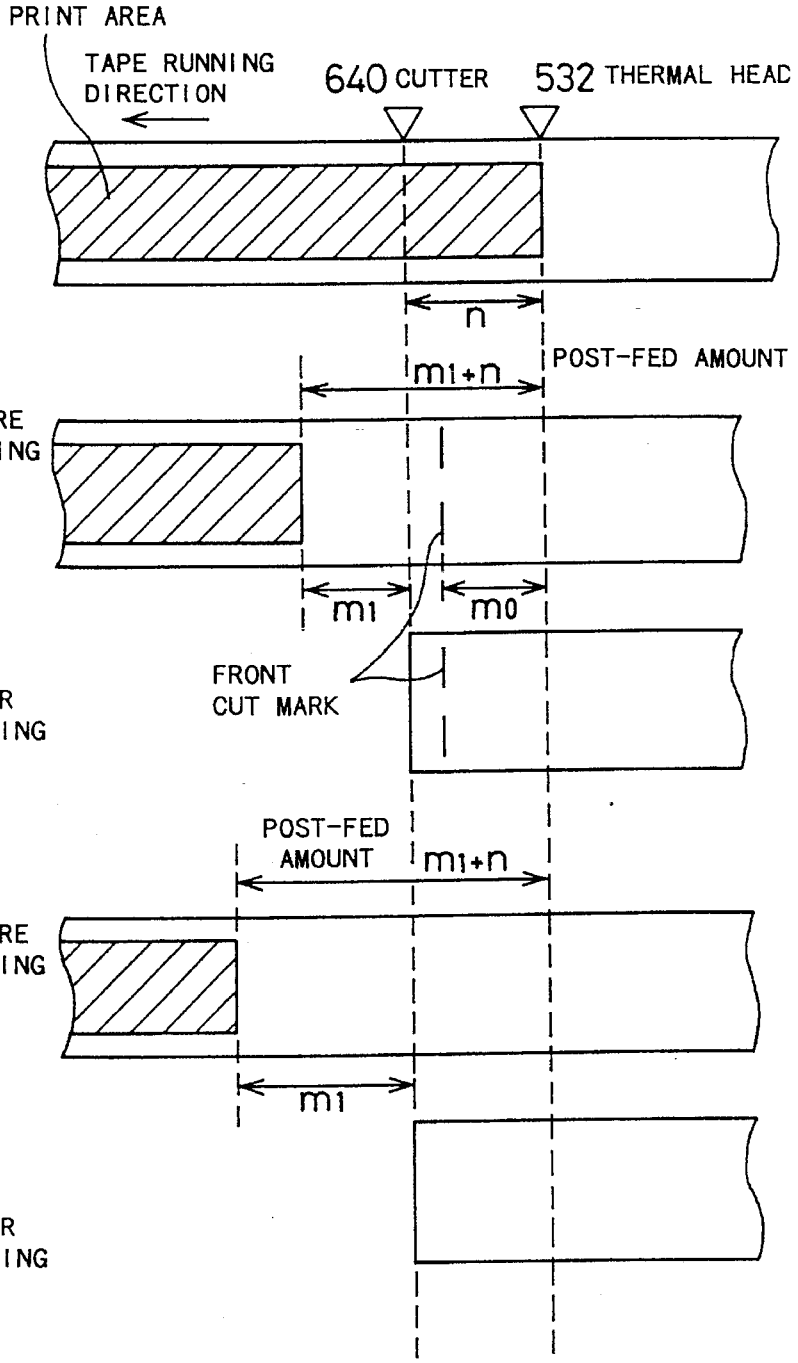
FIGS. 29A, 29B and 29C illustrate typical examples of a post-print feeding process in the third embodiment.

FIGS. 29A, 29B, and 29C illustrate typical examples of the post-print feeding process. When printing a series of characters is concluded, a print end on the tape is placed at a position of the thermal head 532 as shown in FIG. 29A. As an example, a desirable length ml of a right margin is to be set on a label which is cut by a cutter 640. In this case, the tape should be fed by a total of the right margin length ml and a predetermined distance n (for example, 8 mm) between the thermal head 532 and the cutter 640 as shown in FIG. 29B or 29C. In the post-print feeding, the tape should be fed by the total length m1+n.

When printing for a next label is conducted after post-print feeding of the length m1+n, the predetermined distance n between the thermal head 532 and the cutter 640 defines a left margin for the next label. This means that no pre-print feeding is required for the next left margin. In the embodiment, this post-print feeding process is adequately modified according to information of a left margin length m0 for the previous printing so as to reduce the waste length of the tape. When the left margin length m0 for the previous printing is less than the predetermined distance n between the thermal head 532 and the cutter 640, a front cut mark is printed at a position ahead of a feeding end of the tape by the distance m0 as shown in FIG. 29B. The waste length of the next label is accordingly decreased as clearly shown in description of the pre-print feeding process for second or subsequent printing. When the left margin length m0 for the previous printing is equal to or greater than the predetermined distance n between the thermal head 532 and the cutter 640, printing of the front cut mark is not required as shown in FIG. 29C.

The front cut mark denotes a starting position of an effective area as a next label. The user then cuts the tape at the position of the front cut mark to eliminate an nonrequired portion before the front cut mark. In this case, the left margin of a next label is between the front cut mark and the position of the thermal head 532.

(2) Pre-print Feeding Process for First Printing

In the pre-print feeding process for the first printing, it is naturally not required to consider the post-print feeding in previous printing. There may be, however, a potential trouble due to slack of the ink ribbon or the like.

The tape is thereby fed by the head-cutter-distance n for prevention of the potential trouble before a front cut mark is printed. The tape is then fed again by a left margin length m2 for the first printing.

(3) Pre-print Feeding Process for Second or Subsequent Printing (3-1)

When a left margin length m0 for the previous printing is equal to a left margin length m2 for the current printing and each margin length m0 or m2 is equal to or greater than the head-cutter-distance n, the pre-print feeding is executed under such a condition as shown in FIG. 29C (after cutting). Since the tape has already been fed by the predetermined distance n, the tape is further fed by a difference m2-n for the left margin m2 prior to the printing process.

(3-2)

When a left margin length m0 for the previous printing is equal to a left margin length m2 for the current printing and each margin length m0 or m2 is smaller than the head-cutter-distance n, the pre-print feeding is executed under such a condition as shown in FIG. 29B (after cutting). In this case, the left margin length m2 for the current printing (=the left margin length m0 for the previous printing) is equal to a distance between the front cut mark and the position of the thermal head 532. No pre-print feeding is thereby required prior to the printing process.

In actual operation, most cases correspond to either (3-1) or (3-2). In the cases of the condition (3-1) and (3-2), no pre-print feeding is required since the post-print feeding for the previous printing has already fulfilled the requirement. This efficiently shortens the average printing time and significantly improves the usability of the tape printing device.

(3-3)

When a left margin length m0 for the previous printing is not equal to a left margin length m2 for the current printing but both the margin lengths m0 and m2 are equal to or greater than the head-cutter-distance n, the pre-print feeding is executed under such a condition as shown in FIG. 29C (after cutting). Since the tape has already been fed by the predetermined distance n, the tape is further fed by a difference m2-n for the left margin m2 prior to the printing process. This feeding process is identical with that of the condition (3-1).

(3-4)

When a left margin length m0 for the previous printing is equal to or greater than the head-cutter-distance n and a left margin length m2 for the current printing is smaller than the predetermined distance n, the pre-print feeding is executed under such a condition as shown in FIG. 29C (after cutting). A length of the tape before the thermal head 532 is greater than the required length of the left margin m2 for the current printing and is thereby not used as the left margin m2. In this case, a front cut mark is printed at the position of the thermal head 532, and the tape is then fed by the left margin length m2 prior to the printing process.

(3-5)

When a left margin length m0 for the previous printing is smaller than the head-cutter-distance n and a left margin length m2 for the current printing is equal to or greater than the predetermined distance n, the pre-print feeding is executed under such a condition as shown in FIG. 29B (after cutting). The distance m0 between the front cut mark and the thermal head 532 is smaller than the required length m2 of the left margin for the current printing. The tape is thereby fed by a difference m2-m0 for the left margin m2 prior to the printing process.

(3-6)

When both a left margin length m0 for the previous printing and a left margin length m2 for the current printing are smaller than the head-cutter-distance n and the left margin length m2 is greater than the left margin length m0 for the previous printing, the pre-print feeding is executed in the same manner as that of the condition (3-5).

(3-7)

When both a left margin length m0 for the previous printing and a left margin length m2 for the current printing are smaller than the head-cutter-distance n and the left margin length m2 is equal to or smaller than the left margin length m0 for the previous printing, the pre-print feeding is executed under such a condition as shown in FIG. 29B (after cutting). The distance m0 between the front cut mark and the thermal head 532 is greater than the required length of the left margin m2 for the current printing and is thereby not used as the left margin m2. In this case, a front cut mark is printed at the position of the thermal head 532, and the tape is then fed by the left margin length m2 prior to the printing process.

As described above, the structure of the embodiment allows desirable lengths of left and right margins to be efficiently set through the pre-print feeding and the post-print feeding process.

In this embodiment, the left and right margins are determined according to the instruction of the user as well as the tape width. Labels thus obtained have a well-balanced combination of left and right margins and a print area in accordance with the tape width.

The user sets the left and right margin lengths as relative values and is thereby not required to adjust the margin lengths every time when a tape of a different width is set in the tape printing device.

The post-print feeding is executed by considering the left margin length for the next printing to minimize the waste length of the label, thereby efficiently saving both the cost and resource.

The left and right margin lengths may be specified as absolute values instead of the relative values ('small', 'average', 'large', and 'minimum') in the above embodiment. For example, the user specifies margin lengths as absolute values for a tape of a minimum width and corrects the absolute values for other tapes. In another application, left and right margins are previously set and stored for each tape width. The left and right margins are then read out according to the width of the tape set in the tape printing device.

The front cut mark is printed in the left margin setting process according to the requirements in this embodiment using the manual cutter. An automatic cutting device may alternatively be applicable to the tape printing device, which allows the tape to be automatically cut at a certain position corresponding to the non-printed front cut mark.

Figure 30:
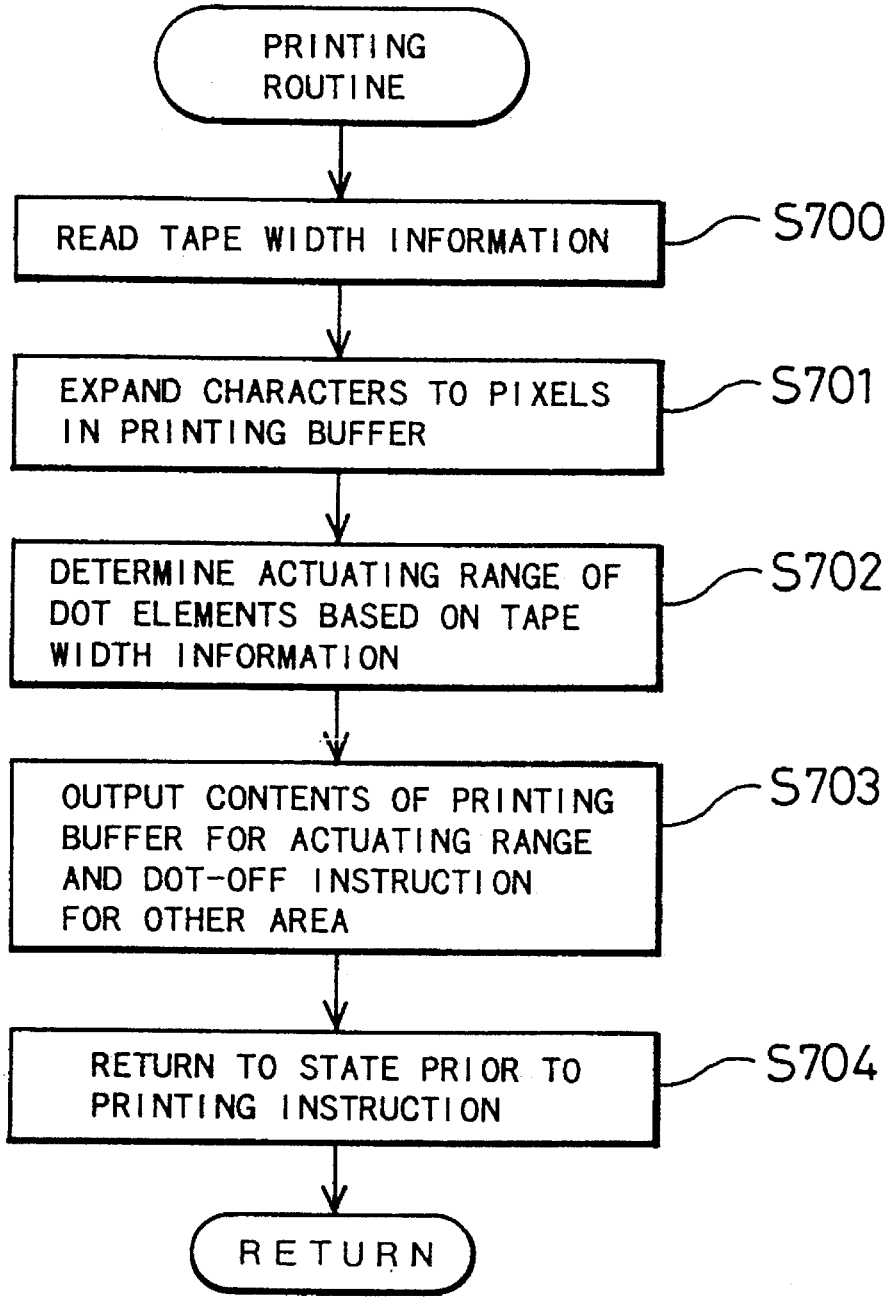
FIG. 30 is a flowchart showing a printing process in a fourth embodiment in accordance with the invention.

A fourth embodiment of the invention where the printing process is varied according to the tape width is described hereinafter. A hardware structure of the fourth embodiment is identical with that of the third embodiment. FIG. 30 is a flowchart showing a printing process in the fourth embodiment. The user can print a desirable series of characters stored in the text area 523*d* of the RAM 523.

When the printing key of the key input element 511 is operated, the CPU 521 starts a printing process program stored in the ROM 522. At step S700, the CPU 521 reads tape width information on a tape currently set in the tape printing device. For example, the CPU 521 reads results of detection by the tape width detection sensor 512. The program then goes to step S701 at which the CPU 521 expands the series of characters in the text area 523*d* to dots in a printing buffer on the RAM 523.

The printing buffer virtually has a width corresponding to the number of dot elements of the thermal head 532, that is, corresponding to the number of dots of a maximum tape width. Expansion of the character information to pixels is executed irrespective of the tape width information.

After completion of the pixel expansion (totally or by a predetermined amount), the CPU 521 transfers dot on/off information obtained through the pixel expansion to the head driving circuit 534 via the output interface element 526. In the embodiment, the transfer output is regulated according to the tape width information.

More concretely, at step S702, the CPU 521 determines a width range of dot data to be read out of the printing buffer based on the tape width information input at step S700. The program then proceeds to step S703 at which the CPU 521 transfers to the head driving circuit 534 the dot data read out of the printing buffer for the determined width range as well as specific dot data representing dot-off instruction for an area out of the width range irrespective of the contents of the printing buffer. The data transfer and tape feeding are conducted by considering the left and right margins as described in detail in the third embodiment.

After completion of dot data transfer (including left and right margin setting), the CPU 521 returns to the state immediately before operation of the printing key at step S704. The program then exits from the printing routine.

The width range determined according to the tape width information corresponds to a range of dot elements on the thermal head 532 within the tape width.

As described above, dot data in the determined width range is transferred to the head driving circuit 534. Dot elements in a predetermined range (a range determined according to the tape width information) of the thermal head 532 are thus heated according to the dot on/off information expanded in the printing buffer while dot elements out of the predetermined range are not heated at all.

The structure of the fourth embodiment actuates only the dot elements in the predetermined range of the thermal head 532 according to the tape width, thus effectively preventing ink from being applied on a platen roller when a printing range is mistakenly set to be out of the tape existence.

Even when the printing range is equal to or smaller than the tape width, noise generated in pixel expansion process may change off-dot data corresponding to an area out of the predetermined range to on-dot data in the printing buffer. In such a case, the structure also prevents dot elements out of the predetermined range of the thermal head 532 from being heated, thereby protecting the platen roller from ink.

This results in effective prevention of potential mechanical troubles as well as stained labels or undesirably long labels.

These effects are realized by changing only the printing process routine but not changing the hardware itself. A complicated, bulky tape printing device is not required for these effects, accordingly.

In another application, the series of characters may be expanded to dots based on the tape width information. When part of a dot pattern of characters is out of the tape width, on-dot data corresponding to the part are forcibly turned to off-data in the printing buffer.

Modification of the fourth embodiment is now described, where the function of the fourth embodiment is realized not by changing the software but by changing the hardware. In this modified embodiment, dot data obtained through pixel expansion of a series of characters in the printing buffer on the RAM 523 is read out of the printing buffer to cover the whole range of the thermal head 532 irrespective of the tape width.

Figure 31:
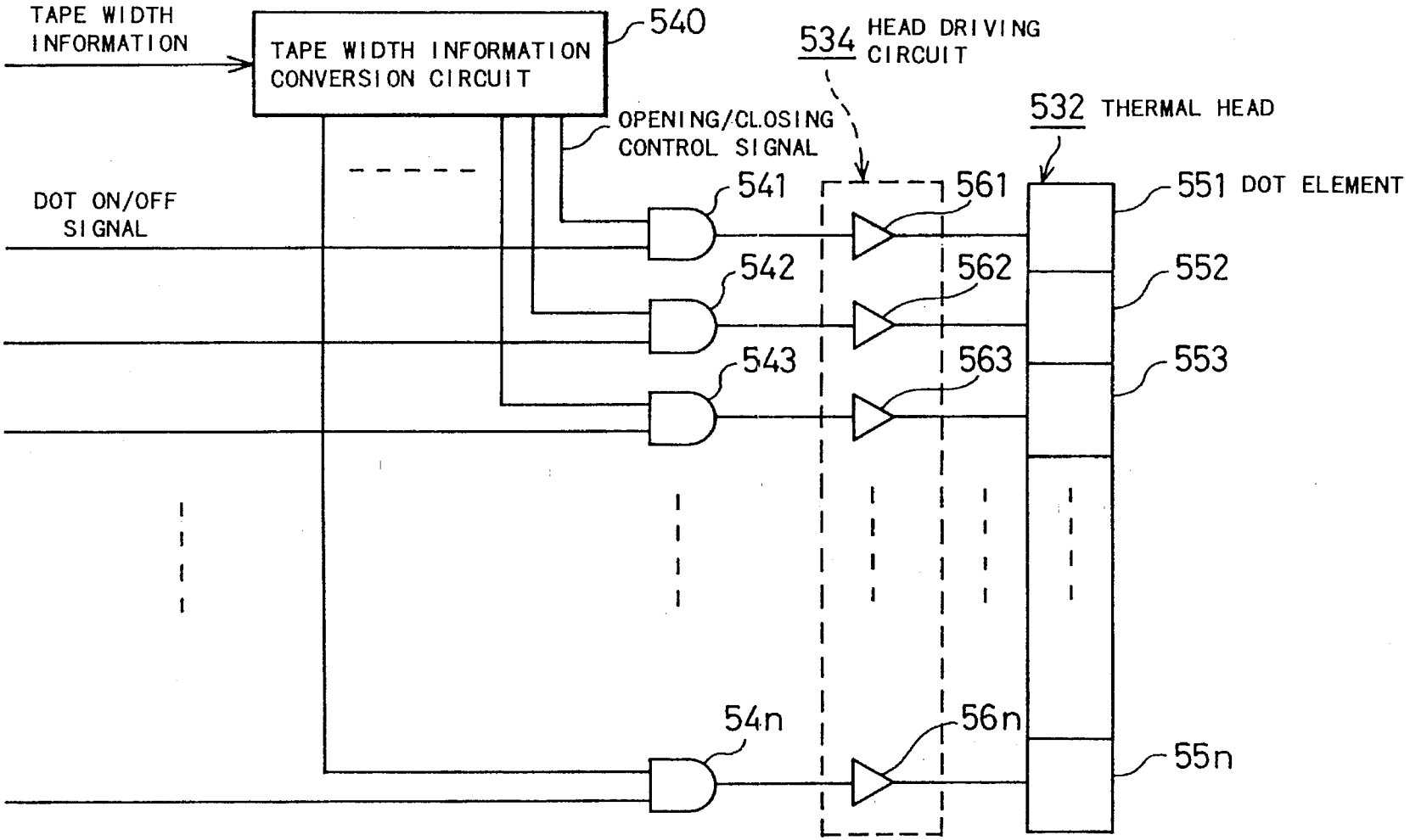
FIG. 31 is a block diagram illustrating a modified structure of the fourth embodiment.

FIG. 31 is a block diagram illustrating an essential structure of the modified embodiment. The thermal head 532 includes a plurality of dot elements 551 through 55*n* arranged in a column, which cover the whole range of a maximum tape width. The dot elements 551, 552, . . . , 55*n* are driven by corresponding driver circuits 561, 562, . . . , 56*n* (the driver circuits constitute the head driving circuit 534).

In this embodiment, the driver circuits 561, 562, . . . , 56*n* are connected with dot on/off signal lines from the output interface element 526 (see FIG. 26) not directly but via corresponding gate circuits 541, 542, . . . , 54*n*.

Each gate circuit 541, 542, . . . , or 54*n* receives an opening/closing control signal output from a tape width information conversion circuit 540 to allow or inhibit passage of a dot on/off signal output from the output interface element 526 based on the opening/closing control signal.

The tape width information conversion circuit 540 receives tape width information detected by the tape width detection sensor 512 (see FIG. 26) via the input interface element 525 (see FIG. 26). The tape width information conversion circuit 540 is realized, for example, as a decoder circuit for outputting a number n of opening/closing control signals according to the tape width information. For example, when a tape of a maximum width is set in the tape printing device, the tape width information conversion circuit 540 allows passage of all the n opening/closing control signals. When a narrower tape is set in the tape printing device, on the other hand, the tape width information conversion circuit 540 allows passage of a certain dot number of opening/closing control signals corresponding to the tape width and inhibits passage of the other opening/closing control signals.

In the structure of the embodiment, certain dot on/off signals corresponding to the tape width extracted from the number n of the dot on/off signals output from the output interface element 526 pass through the gate circuits 54*n* to the driver circuits 56*n*. Certain dot elements on the thermal head 532 corresponding to the tape width are on/off controlled according to the dot on/off information expanded in the printing buffer while the other dot elements are not heated at all.

The structure of the modified embodiment actuates only the certain dot elements of the thermal head 532 corresponding to the tape width, thus effectively preventing ink from being applied on a platen roller when a printing range is mistakenly set to be out of the tape existence. Even when the printing range is equal to or smaller than the tape width, noise generated in pixel expansion process may change off-dot data corresponding to an area out of the predetermined range to on-dot data in the printing buffer. In such a case, the structure also prevents non-required dot elements from being heated, thereby protecting the platen roller from ink.

This results in effective prevention of potential mechanical troubles as well as stained labels or undesirably long labels.

Although the printing head applied in the tape printing device is only a thermal transfer type so far, the principle of the present invention may, however, be applicable to any printing head. The tape width information is detected by the sensor in the above embodiment, but alternatively the tape width information may be set in every replacement of the tape.

The time period of power supply to the thermal head 532, the applied voltage, the pulse width, or the pulse number may be varied according to the type of the tape accommodated in the tape cartridge. Alternatively, the torque of the stepping motor for feeding the tape may be adjusted according to the tape.

Figure 32:
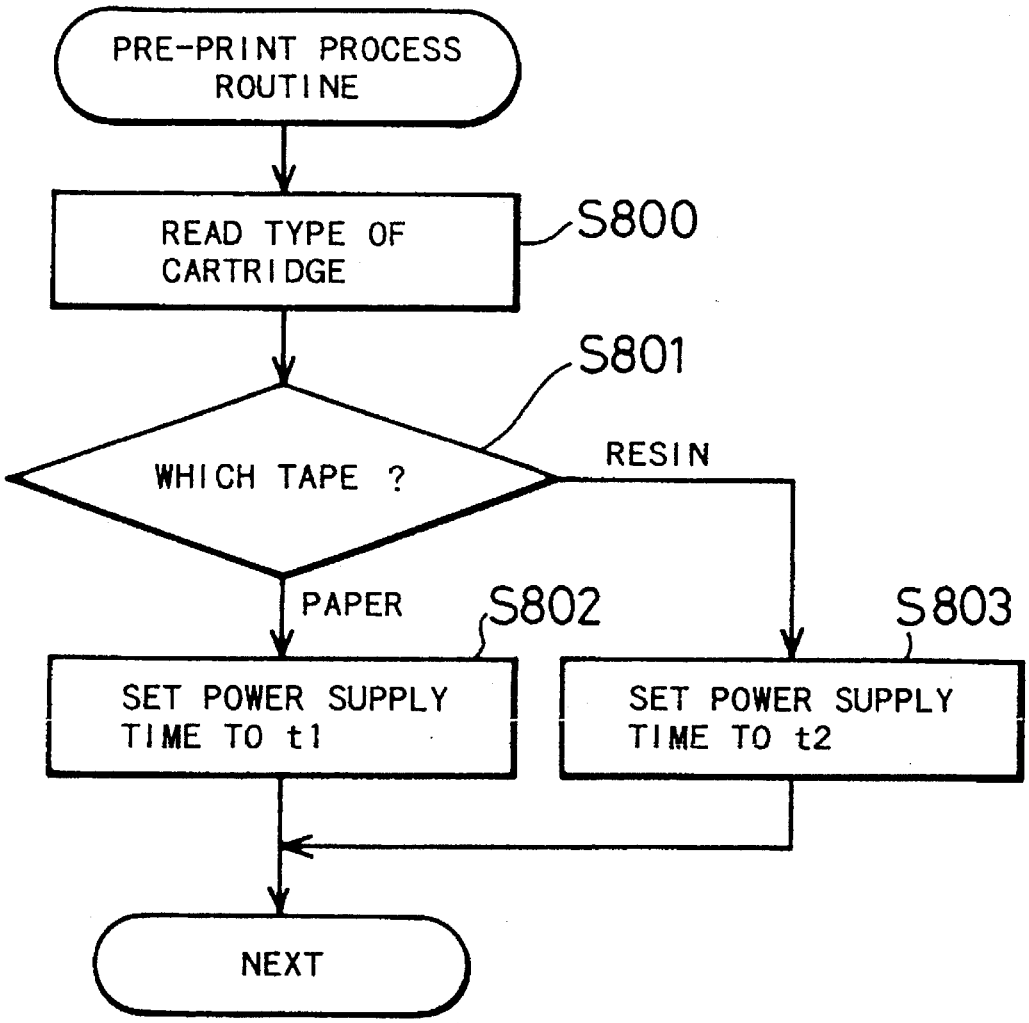
FIG. 32 is a flowchart showing an example of adjusting the power supply time.

FIG. 32 is a flowchart showing an example of adjusting the power supply time. The CPU 521 first reads the type of the tape cartridge at step S800 and determines whether the tape in the tape cartridge is paper tape or resin tape at step S801. When the tape is made of paper, the program goes to step S802 at which a time period of power supply to the thermal head 532 is set equal to a predetermined value t1. When the resin tape is accommodated in the tape cartridge, on the other hand, the program goes to step S803 at which the time period of power supply is set equal to another predetermined value t2, which is greater than the predetermined value t1. The predetermined value t1 or t2 defines the time period for supplying power to dot elements on the thermal head 532 corresponding to black dots to be printed. The shorter power supply time is set for the paper tape since large power may damage the paper tape having lower thermal conductivity. The time period of power supply may be varied according to the type of the ink ribbon other than that of the tape.

Figure 33:
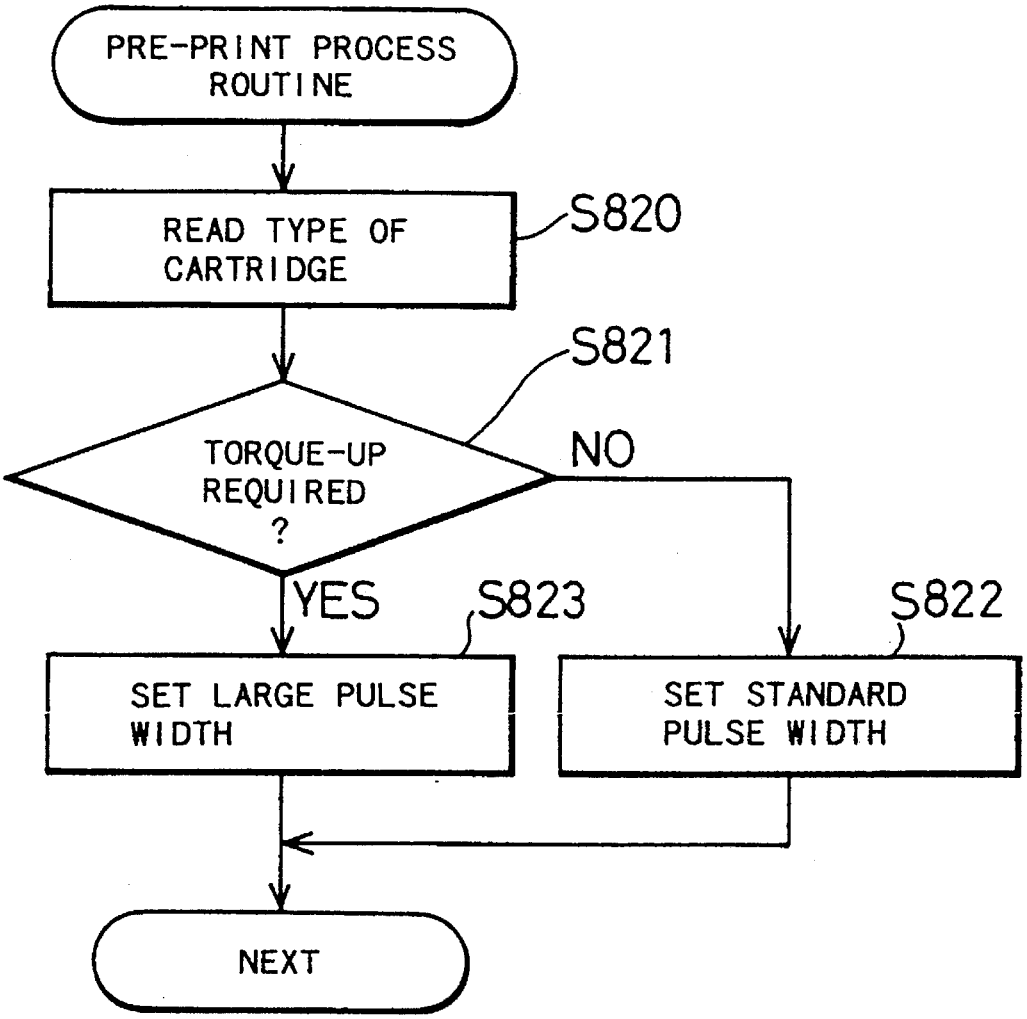
FIG. 33 is a flowchart showing an example of torque variation.

FIG. 33 is a flowchart showing an example of torque variation. In this example, the CPU 521 first reads the type of the tape cartridge at step S820 and determines, according to information of the tape material and tape width, whether the torque should be increased. When the torque-up is required, for example, when a relatively large force is required for tape feeding due to the large tape width or the large friction according to the material or surface roughness of the tape, the program goes to step S823 at which the pulse width of a 4-phase drive output of the motor driving circuit 533 is set to a larger value for the torque-up. When no torque-up is required, on the other hand, the program goes to step S822 at which the pulse width is set to a standard value. The applied voltage or the number of pulses per unit time may be varied instead of the pulse width of the 4-phase drive pulse.

As described above in detail, the first embodiment has a structure for reading information such as a tape width proper to a tape cartridge and adjusting and controlling a character size according to the tape width, a combination of a line number and a character size, and a feeding torque of the tape. The second embodiment records a type of the tape cartridge including the tape width as electrically readable data and allowing specific information to be written. The third embodiment automatically sets lengths of left and right margins on a label according to the tape width. The fourth embodiment prohibits driving of a printing head out of the tape width. The essential features of these embodiments may be combined with one another according to the requirements. Although a series of characters are laid out within the tape width in the first embodiment, the essential features of the fourth embodiment, that is, prohibition of driving the dot elements on the thermal head 532 out of the tape width, may preferably be combined with the first embodiment. When a large number of printing lines are specified, application of even a minimum character size makes the printing range out of the tape width. The structure of the fourth embodiment is effective in such a case. Since there may be potential mistake or noise generation during dot expansion of the series of characters in the text area, the structure of the fourth embodiment which can securely prevent ink from being undesirably applied on a platen roller is preferably combined with the principle of the first embodiment.

There may be many changes, modifications, and alterations without departing from the scope or spirit of essential characteristics of the invention, and it is thereby clearly understood that the above embodiments are only illustrative and not restrictive in any sense. The spirit and scope of the present invention is only limited by the terms of the appended claims.

What is claimed is:

1. A tape printing device which a tape cartridge accommodating a printing tape is replaceably set in, said tape printing device comprising:

feeding means for feeding said printing tape in a direction; a printing head for printing on said tape being fed; a cutting mechanism having a cutting edge and being located downstream said printing head along said direction of feeding said tape, said cutting mechanism for cutting said tape by moving a cutting edge thereof to a specific position where said cutting edge interrupts feeding of said tape;

detection means for detecting a movement of said cutting edge intended for cutting said tape; and printing stop means for halting printing being executed by said printing head when said movement of said cutting edge is detected by said detection means.

2. A tape printing device in accordance with claim 1, wherein said detection means detects a movement of said cutting edge before said cutting edge reaches said specific position where said cutting edge interrupts feeding of said tape, whereby said printing stop means interrupts printing being executed by said printing head, before said cutting edge reaches said specific position where said cutting edge interrupts feeding of said tape.

3. A tape printing device which a tape cartridge accommodating a printing tape is replaceably set in, said tape printing device comprising:

feeding means for feeding said printing tape in a direction; a printing head for printing on said tape being fed; a cutting mechanism having a cutting edge and being located downstream said printing head along said direction of feeding said tape, said cutting mechanism for cutting said tape by moving a cutting edge thereof to a specific position where said cutting edge interrupts feeding of said tape;

detection means for detecting a movement of said cutting edge intended for cutting said tape; and feeding halt means for halting feeding of said tape performed by said feeding means when said movement of said cutting edge is detected by said detection means.

4. A tape printing device in accordance with claim 3, said device further comprising printing stop means for interrupting printing being executed by said printing head when said movement of said cutting edge is detected by said detection means.

5. A tape printing device in accordance with claim 3, wherein said detection means detects a movement of said cutting edge before said cutting edge reaches a specific position where said cutting edge interrupts feeding of said tape, whereby said feeding stop means interrupts feeding of said tape based on the detection result through said detection means, before said cutting edge reaches a specific position where said cutting edge interrupts feeding of said tape.

6. A tape printing device in accordance with claim 4, wherein said detection means detects a movement of said cutting edge before said cutting edge reaches a specific position where said cutting edge interrupts feeding of said tape, whereby said feeding stop means interrupts feeding of said tape based on the detection result through said detection means, before said cutting edge reaches a specific position where said cutting edge interrupts feeding of said tape.

7. A tape printing device which a tape cartridge accommodating a printing tape is replaceably set in, said tape printing device comprising:

feeding means for feeding said printing tape in a direction;

a printing head for printing on said tape being fed;

a cutting mechanism having a cutting edge and being located downstream said printing head along said direction of feeding said tape, said cutting mechanism for cutting said tape by moving a cutting edge thereof to a specific position where said cutting edge interrupts feeding of said tape;

detection means for detecting said cutting edge reaching said specific position where said cutting edge interrupts feeding of said tape; and print halt means for halting feeding of said tape performed by said feeding means, interrupting printing being executed by said printing head when said cutting edge is detected by said detection means and resuming feeding of said tape by said feeding means and printing by said printing head when said cutting edge is not detected by said detection means.

8. A tape printing device in accordance with claim 7, wherein said print halt means further comprises:

traveling detection means for detecting a traveling cutting edge going away from said specific position where said cutting edge interrupts feeding of said tape; and resumption means for resuming feeding of said tape by said feeding means when said cutting edge is detected going away by said traveling detection means.

9. A tape printing device in accordance with claim 7, wherein said print halt means further comprises:

traveling detection means for detecting a traveling cutting edge going away from said specific position where said cutting edge interrupts feeding of said tape;

feeding resumption means for resuming feeding of said tape by said feeding means when said cutting edge is detected going away by said traveling detection means; and printing resumption means for resuming printing by said printing head when said cutting edge is detected going away by said release detection means.

10. A tape printing device which a tape cartridge accommodating a printing tape is replaceably set in, said tape printing device comprising:

a platen for feeding said tape along a predetermined feeding path in a direction through rotation thereof, said platen being rotated by a motor;

a printing head for printing on said tape being fed while holding said tape in cooperation with said platen;

a printing control circuit for controlling said printing head for printing;

a tape cutter having a fixed edge and a traveling edge thereof being located in a specific position where said tape is clamped, and being situated downstream said printing head along said feeding path of said tape, said tape cutter cutting said tape between said fixed edge and said traveling edge thereof by moving said traveling edge to a specific position where said traveling edge interrupts feeding of said tape; and a switch having an operating member and a contact point which is opened through operation of said operating member, said switch being disposed in a specific position where said operating member is operated by said traveling edge of said tape cutter moving toward said fixed edge, wherein said contact point is connected in a circuit for transmitting an instruction signal for printing to said printing control circuit.

11. A tape printing device which a tape cartridge accommodating a printing tape is replaceably set in, said tape printing device comprising:

a platen for feeding said tape along a predetermined feeding path in a direction through rotation thereof, said platen being rotated by a motor;

a printing head for printing on said tape being fed while holding said tape in cooperation with said platen, said printing head being driven by a driving circuit;

a tape cutter having a fixed edge and a traveling edge thereof being located in a specific position where said tape is clamped, and being situated downstream said printing head along said feeding path of said tape, said tape cutter cutting said tape between said fixed edge and said traveling edge thereof by moving said traveling edge to a specific position where said traveling edge interrupts feeding of said tape;

a fixed wall positioned in the vicinity of said feeding path;

a holding member for holding said tape in cooperation with said fixed wall, said holding member being movably disposed in proximity to said cutter and beside said feeding path of said tape, and being moved toward said tape prior to a movement of said traveling edge; and a switch having an operating member an a contact point which is opened through operation of said operating member, wherein said switch is placed in a specific position where said operating member is operated by a movement of said holding member toward said tape, wherein said contact point is connected in a circuit for transmitting an instruction signal for printing to said driving circuit of said printing head.

12. A tape printing device which a tape cartridge accommodating a printing tape is replaceably set in, said tape printing device comprising:

a platen for feeding said tape along a predetermined feeding path in a direction through rotation thereof, said platen being rotated by a motor driven by a motor;

a motor driving circuit for driving said motor;

a printing head for printing on said tape being fed while holding said tape in cooperation with said platen;

a printing control circuit for controlling said printing head for printing;

a tape cutter having a fixed edge and a traveling edge thereof being located in a position where said tape is clamped, and being situated downstream said printing head along the feeding direction of said tape, said tape cutter cutting said tape between said fixed edge and said traveling edge thereof by moving said traveling edge to a specific position where said traveling edge interrupts feeding of said tape; and a switch having an operating member and a contact point which is opened through operation of said operating member, said switch being disposed in a specific position where said operating member is operated by said traveling edge of said tape cutter moving toward said fixed edge, wherein said contact point is connected in a circuit for transmitting an instruction signal for feeding of said tape to said motor driving circuit.

13. A tape printing device in accordance with claim 12, wherein said contact point of said switch is connected in a circuit for transmitting an instruction signal for printing to said printing control circuit.

14. A tape printing device which a tape cartridge accommodating a printing tape is replaceably set in, said tape printing device comprising:

a platen for feeding said tape along a predetermined feeding path in a direction through rotation thereof, said platen being rotated by a motor driven by a motor driving circuit;

a printing head for printing on said tape being fed while holding said tape in cooperation with said platen, said printing head being driven by a head driving circuit;

a tape cutter having a fixed edge and a traveling edge thereof being located in a position where said tape is clamped, and being situated downstream said printing head along the feeding direction of said tape, said tape cutter cutting said tape between said fixed edge and said traveling edge thereof by moving said traveling edge to a specific position where said traveling edge interrupts feeding of said tape; and a fixed wail positioned in the vicinity of said feeding path;

a holding member for holding said tape in cooperation with said fixed wall, said holding member being movably disposed in proximity to said cutter and beside said feeding path of said tape, and being moved toward said tape prior to a movement of said traveling edge; and a switch having an operating member and a contact point which is opened through operation of said operating member, said switch being disposed in a specific position where said operating member is operated by said movement of said holding member toward said tape, wherein said contact point is connected in a circuit for transmitting an instruction signal for feeding of said tape to said motor driving circuit.

15. A tape printing device which a tape cartridge accommodating a printing tape is replaceably set in, said tape printing device comprising:

a platen for feeding said tape along a predetermined feeding path in a direction through rotation thereof, said platen being rotated by a motor;

a printing head for printing on said tape being fed while holding said tape in cooperation with said platen;

a printing control circuit for controlling electric power supplied to said printing head for printing;

a tape cutter having a fixed edge and a traveling edge thereof being located in a specific position where said tape is clamped, and being situated downstream said printing head along said feeding path of said tape, said tape cutter cutting said tape between said fixed edge and said traveling edge thereof by moving said traveling edge to a specific position where said traveling edge interrupts feeding of said tape; and a switch having an operating member and being disposed in a specific position where said operating member is operated by said traveling edge of said tape cutter moving toward said fixed edge, said switch having a contact point which is switched through operation of said operating member, wherein said contact point makes and outputs a signal which lets said printing control circuit halt printing.

16. A tape printing device which a tape cartridge accommodating a printing tape is replaceably set in, said tape printing device comprising:

a platen for feeding said tape along a predetermined feeding path in a direction through rotation thereof, said platen being rotated by a motor;

a motor driving circuit for driving said motor:

a printing head for printing on said tape being fed while holding said tape in cooperation with said platen;

a printing control circuit for controlling electric power supplied to said printing head for printing;

a tape cutter having a fixed edge and a traveling edge thereof being located in a position where said tape is clamped, and being situated downstream said printing head along the feeding direction of said tape, said tape cutter cutting said tape between said fixed edge and said traveling edge thereof by moving said traveling edge to a specific position where said traveling edge interrupts feeding of said tape; and a switch having an operating member and being disposed in a specific position where said operating member is operated by said traveling edge of said tape cutter moving toward said fixed edge, said switch having a contact point which is switched through operation of said operating member, wherein said switched contact point makes and outputs a signal which lets said motor driving circuit halt rotating said motor.

17. A tape printing device which a tape cartridge accommodating a printing tape is replaceably set in, said tape printing device comprising:

feeding means for feeding said printing tape in a direction;

a printing head for printing on said tape being fed;

a cutting mechanism having a cutting edge and being located downstream said printing head along said direction of feeding said tape, said cutting mechanism for cutting said tape by moving a cutting edge thereof to a specific position where said cutting edge interrupts feeding of said tape;

detection means for detecting said cutting edge reaching said specific position where said cutting edge interrupts feeding of said tape; and feeding halt means for halting feeding of said tape performed by said feeding means when said cutting edge is detected by said detection means and resuming feeding of said tape by said feeding means when said cutting edge is not detected by said detection means.

18. A tape printing device in accordance with claim 17, wherein said feeding halt means further comprises:

traveling detection means for detecting a traveling cutting edge going away from said specific position where said cutting edge interrupts feeding of said tape; and resumption means for resuming feeding of said tape by said feeding means when said cutting edge is detected going away by said traveling detection means.

19. A tape printing device which a tape cartridge accommodating a printing tape is replaceably set in, said tape printing device comprising:

feeding means for feeding said printing tape in a direction;

a printing head for printing on said tape being fed;

a cutting mechanism having a cutting edge and being located downstream said printing head along said direction of feeding said tape, said cutting mechanism for cutting said tape by moving a cutting edge thereof to a specific position where said cutting edge interrupts feeding of said tape;

detection means for detecting said cutting edge reaching said specific position where said cutting edge interrupts feeding of said tape; and print halt means for interrupting printing being executed by said printing head when said cutting edge is detected by said detection means and resuming printing by said printing head when said cutting edge is not detected by said detection memos.

20. A tape printing device in accordance with claim 19, wherein said print halt means further comprises:

traveling detection means for detecting a traveling cutting edge going away from said specific position where said cutting edge interrupts feeding of said tape; and resumption means for resuming printing by said printing head when said cutting edge is detected going away by said traveling detection means.

21. A tape printing device having a cartridge holder unit to which a tape cartridge accommodating a printing tape is attached, said printing device comprising:

feeding means for feeding said tape accommodated in said tape cartridge attached to said holder unit in a direction;

a printing head for printing on said tape being fed out of said cartridge;

a freely openable cover for covering said holder unit attached to said holder unit;

a connector which can be connected with a memory package accommodating a memory for storing printing related data, said connector being placed in a position which said connector is freely taken out of and put in when said cover is open; and a control unit for referring to data stored in said memory package via said connector for printing executed by said printing head.

* * * * *